US008459703B2

(12) United States Patent
Anderson et al.

(10) Patent No.: US 8,459,703 B2
(45) Date of Patent: Jun. 11, 2013

(54) PAWL ASSEMBLY

(75) Inventors: Glenn E. Anderson, Malvern, PA (US); Richard E. Schlack, Rising Sun, MD (US); D. Dale Turner, Honeoye Falls, NY (US); James Vickers, Media, PA (US); Stephen K. Spatig, West Chester, PA (US); Richard B. Langkamp, Hemlock, NY (US); H. Allen Riblett, Ardentown, DE (US)

(73) Assignee: Southco, Inc., Concordville, PA (US)

( * ) Notice: Subject to any disclaimer, the term of this patent is extended or adjusted under 35 U.S.C. 154(b) by 1147 days.

(21) Appl. No.: 11/911,198

(22) PCT Filed: Apr. 11, 2006

(86) PCT No.: PCT/US2006/013358

§ 371 (c)(1),
(2), (4) Date: Oct. 10, 2007

(87) PCT Pub. No.: WO2006/110678

PCT Pub. Date: Oct. 19, 2006

(65) Prior Publication Data

US 2009/0267360 A1 Oct. 29, 2009

Related U.S. Application Data

(60) Provisional application No. 60/670,168, filed on Apr. 11, 2006, provisional application No. 60/671,781, filed on Apr. 14, 2005.

(51) Int. Cl.
*E05C 5/00* (2006.01)
*E05C 19/00* (2006.01)

(52) U.S. Cl.
USPC ..... 292/67; 292/63; 292/194; 292/203; 292/303; 292/DIG. 64; 411/175; 411/970

(58) Field of Classification Search
USPC .. 70/370, 77, 78, 84, 135, 140, 208; 292/202, 292/DIG. 53, 80, 1, 57, 63, 67, 87, 90, 194, 292/203, 204, 206, 212, 301, 303, 304, DIG. 61, 292/DIG. 64; 411/174, 175, 437, 970; 48/231.81, 316.7
See application file for complete search history.

(56) References Cited

U.S. PATENT DOCUMENTS 1,451,970 A * 4/1923 Taylor ..... 411/418
2,084,926 A * 6/1937 Tinnerman ..... 403/21

(Continued)

FOREIGN PATENT DOCUMENTS

CN 2305460 Y 1/1999

OTHER PUBLICATIONS

Web pages by Slip-ON Lock Nut Co.; http://www.sliponlocknut.com/about.html, http://www.sliponlocknut.com/index.html, and http://www.sliponlocknut.com/locknut.html; Feb. 28, 2005.

(Continued)

*Primary Examiner* — Thomas A Beach
*Assistant Examiner* — Alyson M Merlino
(74) *Attorney, Agent, or Firm* — Paul & Paul

(57) ABSTRACT

A pawl assembly that can be installed to the output shaft of a latch mechanism more easily, and in some embodiments without the use of tools, as compared to prior art pawls.

33 Claims, 103 Drawing Sheets

U.S. PATENT DOCUMENTS

| | | | | | |
|---|---|---|---|---|---|
| 2,101,287 | A | * | 12/1937 | Tinnerman | 403/21 |
| 2,233,230 | A | * | 2/1941 | Tinnerman | 411/175 |
| 2,323,689 | A | * | 7/1943 | Tinnerman | 411/175 |
| 2,323,690 | A | * | 7/1943 | Tinnerman | 411/175 |
| 2,399,957 | A | * | 5/1946 | Tinnerman | 411/173 |
| 2,399,958 | A | * | 5/1946 | Tinnerman | 411/175 |
| 2,517,364 | A | * | 8/1950 | Torresen | 411/432 |
| 2,672,905 | A | * | 3/1954 | Hartman et al. | 411/175 |
| 3,402,958 | A | * | 9/1968 | Barry | 292/62 |
| 3,829,139 | A | | 8/1974 | Storlie | |
| 4,492,394 | A | | 1/1985 | Dignan | |
| 4,556,244 | A | | 12/1985 | Bisbing | |
| 4,583,775 | A | | 4/1986 | Bisbing | |
| 4,627,249 | A | | 12/1986 | Dumortier | |
| 4,671,547 | A | * | 6/1987 | Weinerman et al. | 292/197 |
| 4,763,935 | A | * | 8/1988 | Bisbing | 292/66 |
| 4,826,376 | A | | 5/1989 | Aldridge et al. | |
| 4,850,633 | A | * | 7/1989 | Emery | 296/39.2 |
| 4,883,397 | A | * | 11/1989 | Dubost | 411/174 |
| 5,234,236 | A | | 8/1993 | Gromotka | |
| 6,041,627 | A | | 3/2000 | Buckland | |
| 6,045,188 | A | * | 4/2000 | Schooler | 297/362.14 |
| 6,578,884 | B2 | * | 6/2003 | Chiang | 292/66 |

OTHER PUBLICATIONS

Southco Handbook 2003; Southco Inc.; Front and Back Cover, pp. 40-58 and pp. 95-97, 2003.

Reader's Digest New Complete Do-It-Yourself Manual, Twelfth Printing, Nov. 1999, p. 213.

Package Insert for a product for securing a downspout to a wall, "Rack, Key, Drive-Downspout Accessories."

* cited by examiner

SECTION A-A

SECTION B-B

SECTION C-C

SECTION B-B

SECTION A-A

SECTION C-C

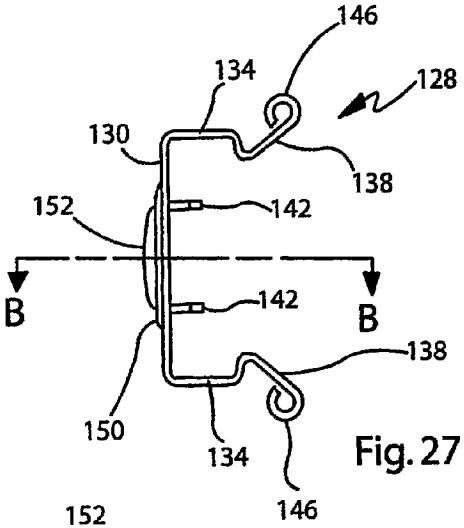
Fig. 27
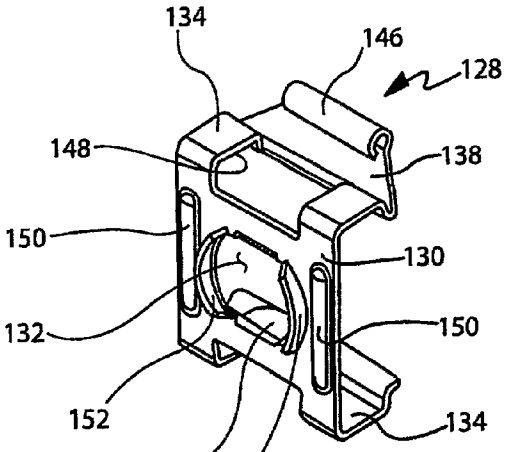
Fig. 28
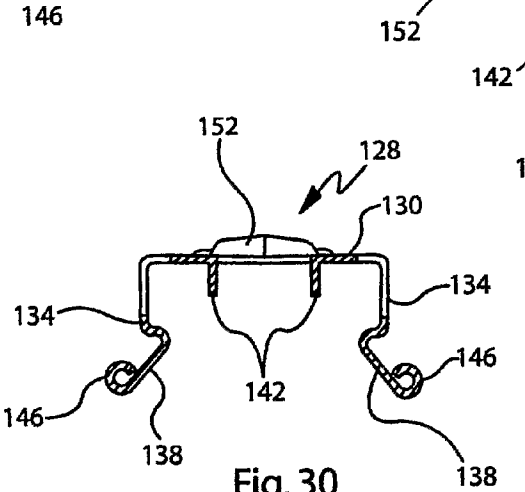
Fig. 29
Fig. 30
SECTION A-A
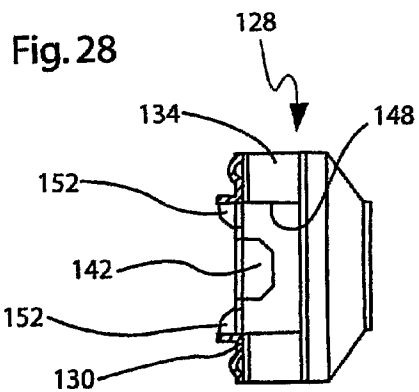
Fig. 31
SECTION B-B 128
134
146
130
138
146
148
134
150
132
142

128
SECTION C-C 128
134
152
130
152
142

128
146
138
144
130
132
144
150
142
150
138
146

128
134
130
152
134
C
C
146
138
142
138
146

150
128
130
144
150
132
144

SECTION B-B

SECTION A-A

SECTION B-B

SECTION A-A

SECTION B-B

SECTION A-A

SECTION B-B

SECTION A-A

SECTION C-C

SECTION C-C

SECTION B-B

SECTION A-A

SECTION B-B

SECTION A-A

SECTION C-C

SECTION B-B

SECTION A-A

SECTION B-B

SECTION A-A

SECTION C-C

SECTION B-B

SECTION A-A

SECTION C-C

SECTION B-B

SECTION A-A

SECTION B-B

SECTION C-C

SECTION A-A

SECTION B-B

SECTION B-B

SECTION A-A

SECTION B-B

SECTION A-A

SECTION B-B

SECTION C-C

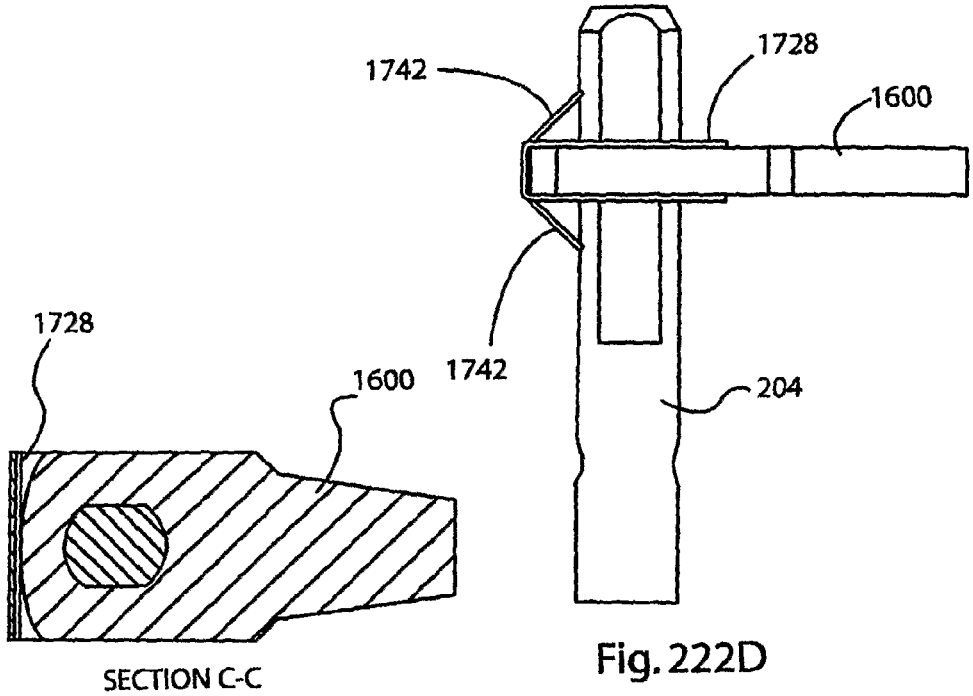
Fig. 222D
Fig. 222C
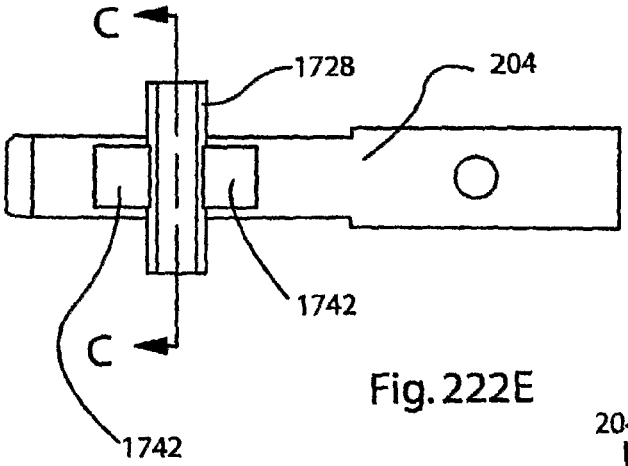
Fig. 222E
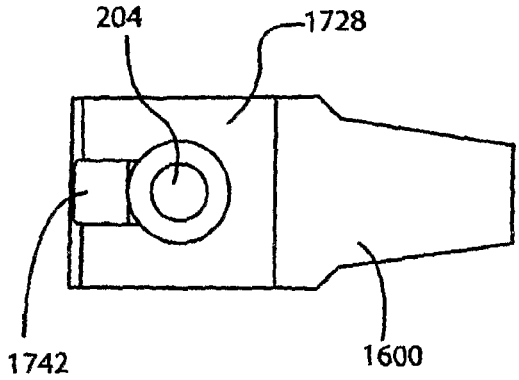
Fig. 222F

SECTION A-A

SECTION B-B

SECTION C-C

PAWL ASSEMBLY

CROSS REFERENCE TO RELATED APPLICATIONS

This application is a national stage under 35 U.S.C. 371 of International Application Serial No. PCT/US2006/013358, filed on Apr. 11, 2006, which claims the benefit of U.S. Provisional Application No. 60/670,168, filed Apr. 11, 2005, and the benefit of U.S. Provisional Application No. 60/671,781, filed Apr. 14, 2005, of which all of the U.S. Provisional Applications are incorporated herein by reference in their entirety.

BACKGROUND OF THE INVENTION

1. Field of Invention

The present invention relates to pawls for use with latches that have an output shaft for supporting a pawl and that operate by at least in part moving the output shaft rotationally as the pawl is moved between latched and unlatched positions. In particular, the present invention concerns a pawl that has a mounting system that makes the pawl much easier to mount to a latch as compared to previously known pawls.

2. Brief Description of the Related Art

The pawls known in the prior art are usually fixed to the output shaft of a latch mechanism by tightening in opposite directions a pair of nuts provided, along with associated lock washers, on either side of the pawl. Accordingly, the prior art pawls required the use of common hand tools for installation and adjustment.

SUMMARY OF THE INVENTION

The present invention is directed to a pawl assembly that can be installed to the output shaft of a latch mechanism more easily, and in some embodiments without the use of tools, as compared to prior art pawls.

BRIEF DESCRIPTION OF THE DRAWINGS

FIGS. 1-48 are views of a first embodiment of the present invention.

Figure 2:
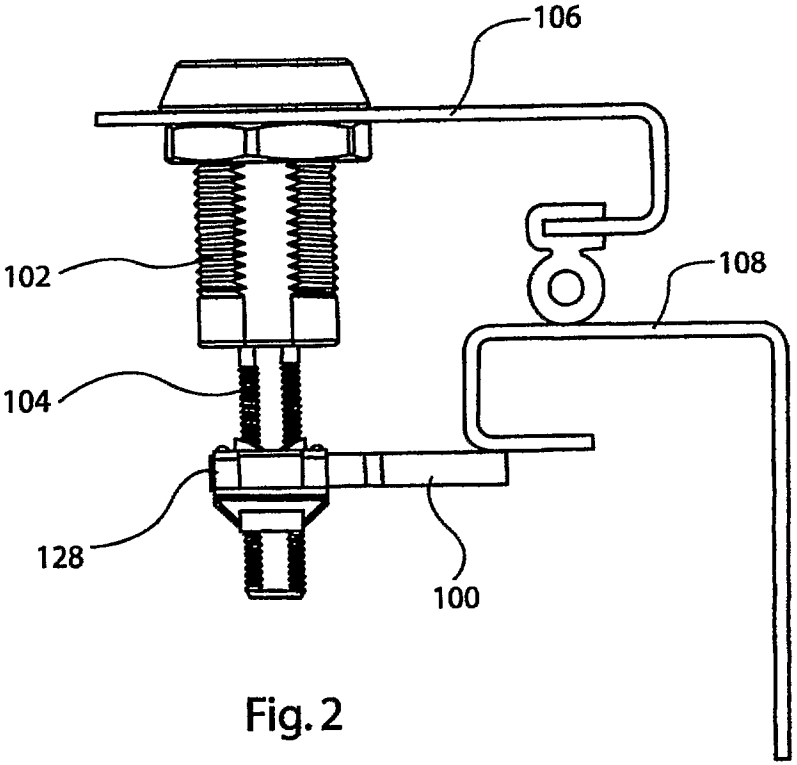
Figure 1:
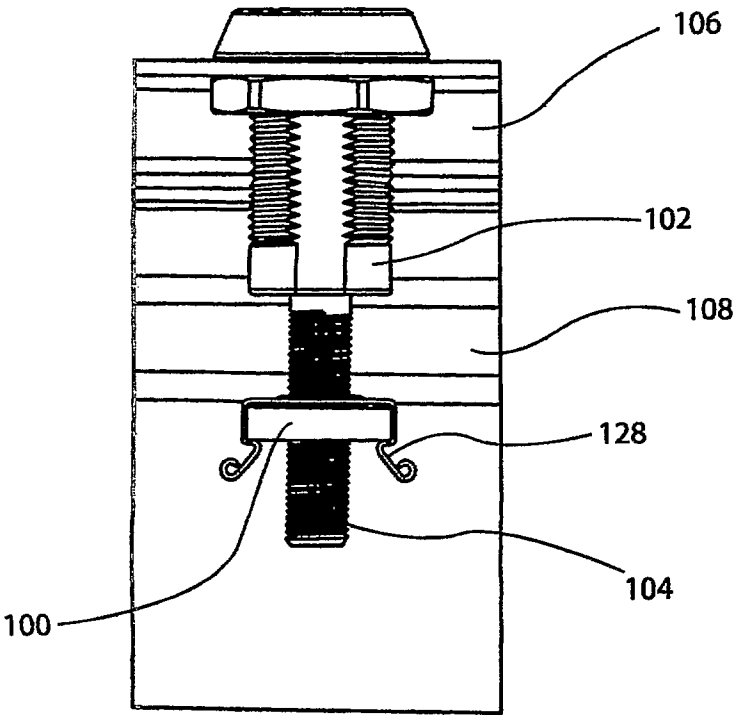
Figure 4:
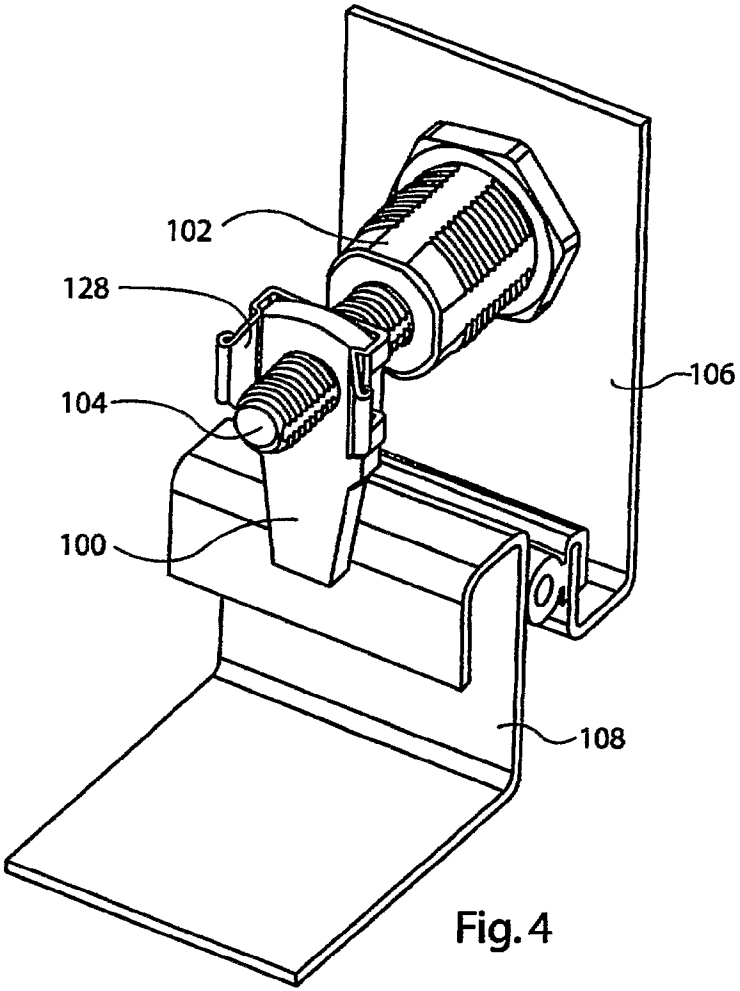
Figure 3:
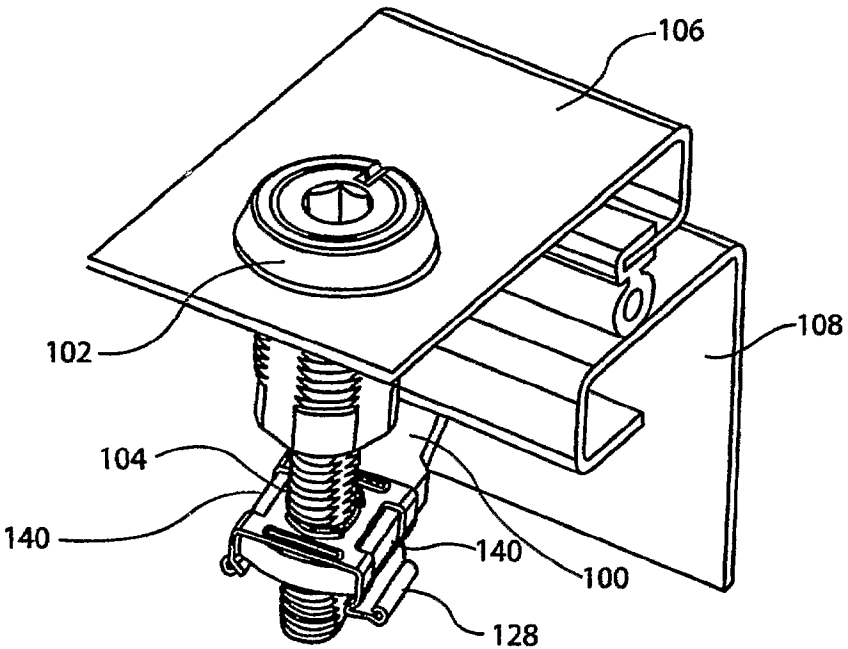
Figure 5:
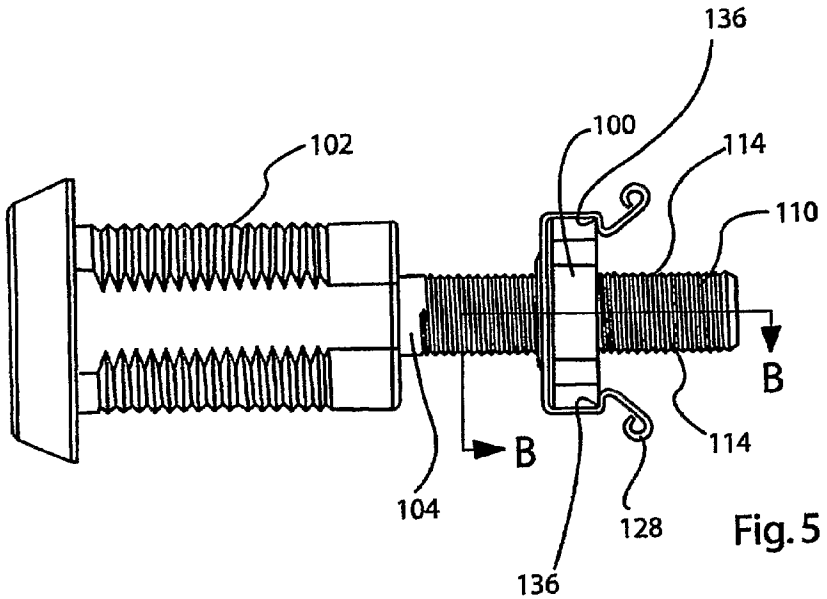
Figure 6:
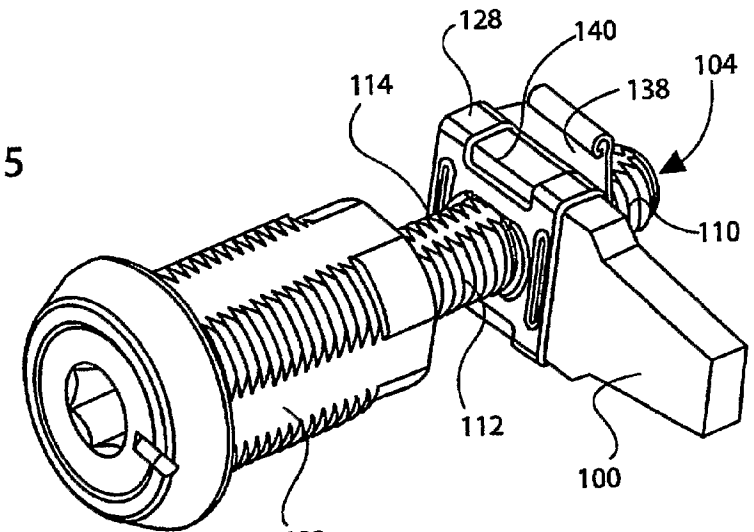
Figure 8:
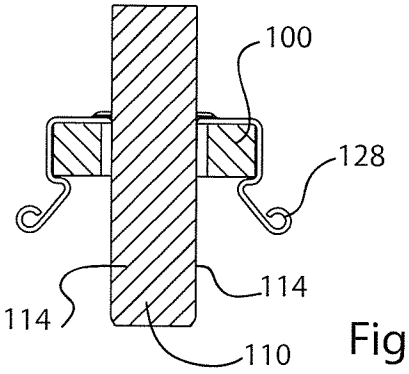
Figure 9:
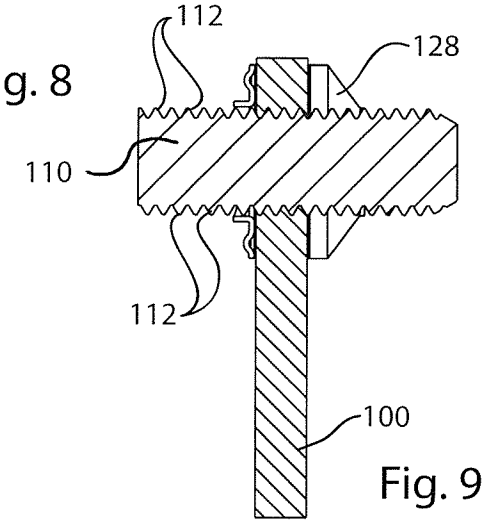
Figure 7:
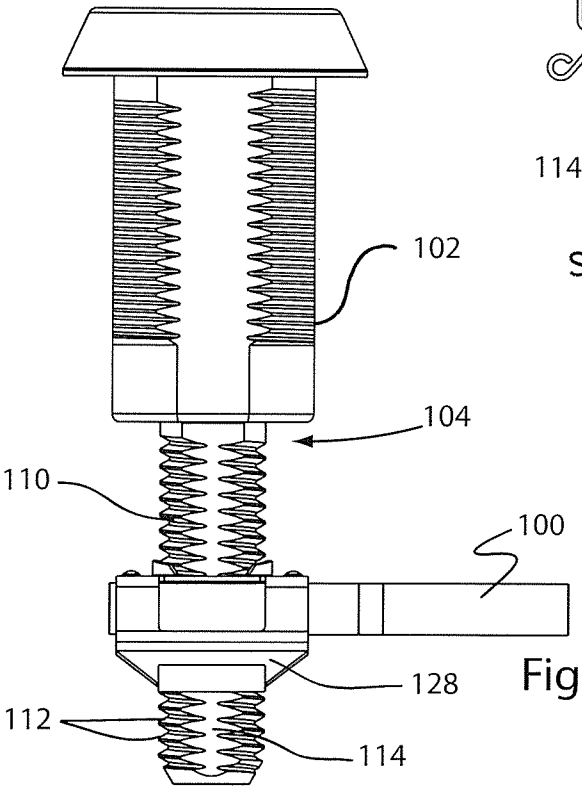
Figure 12:
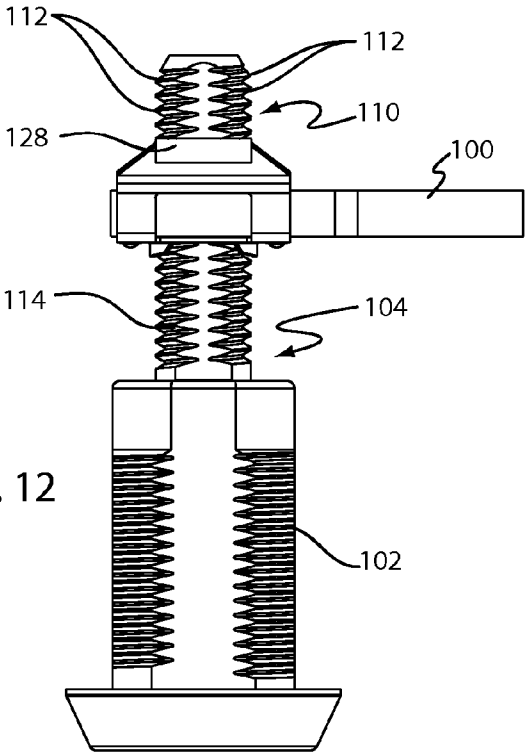
Figure 11:
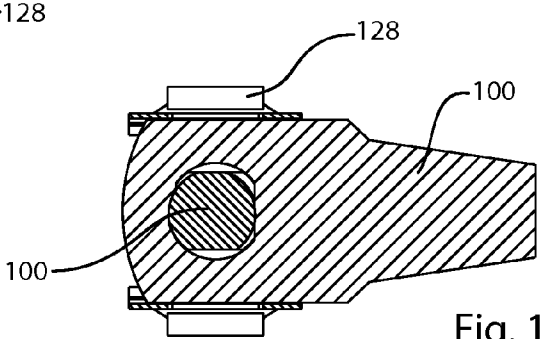
Figure 10:
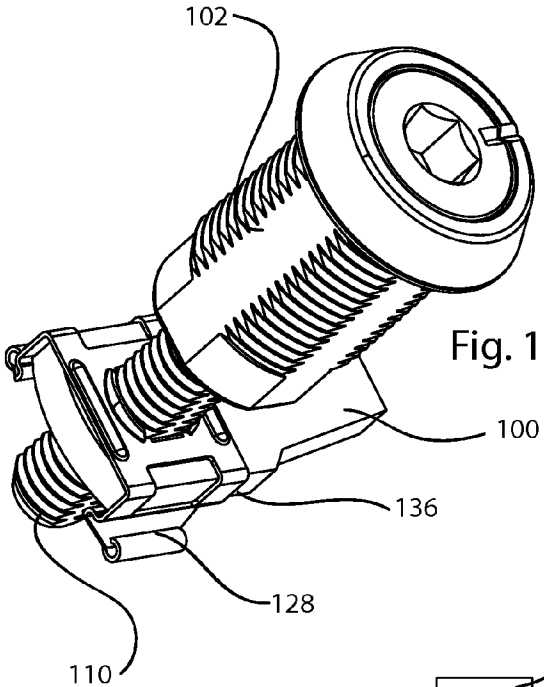
Figure 15:
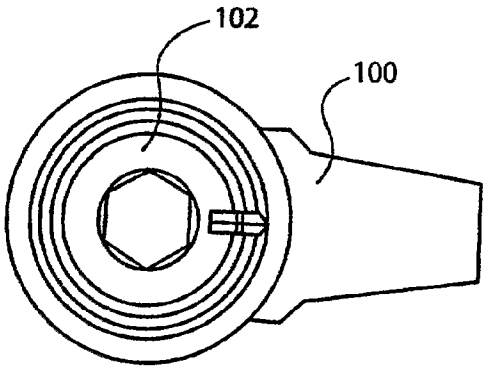
Figure 14:
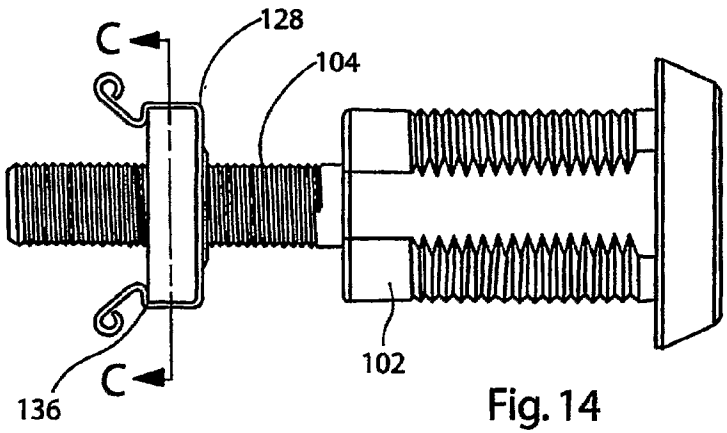
Figure 13:
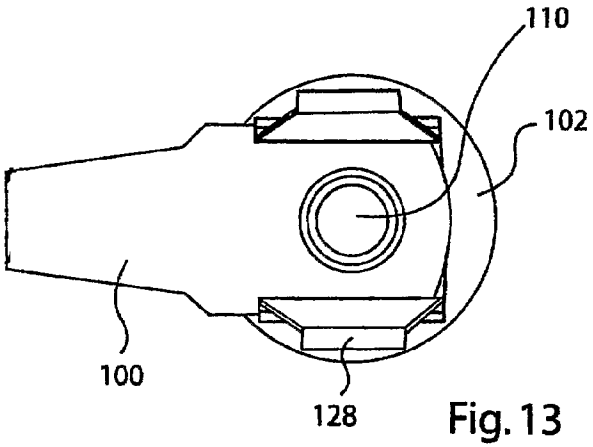
Figure 18:
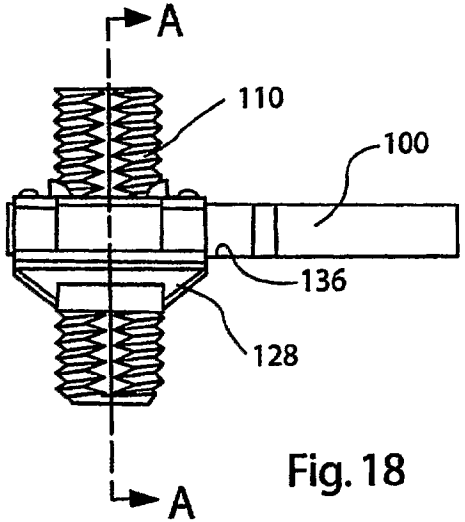
Figure 17:
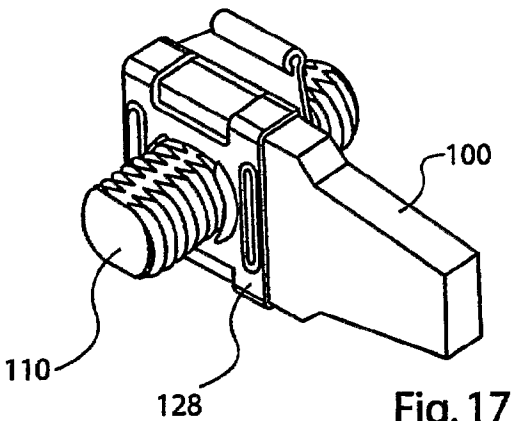
Figure 16:
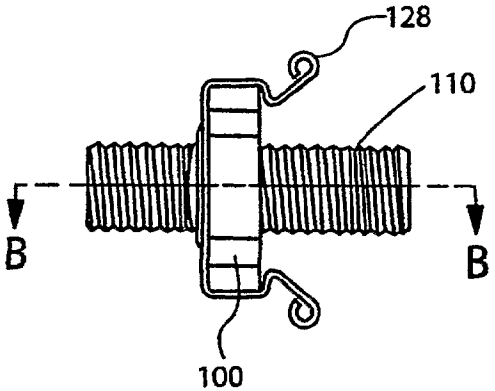
Figure 20:
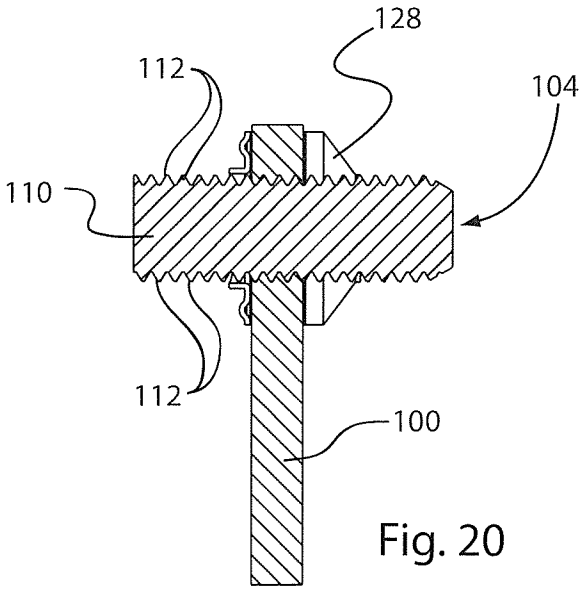
Figure 19:
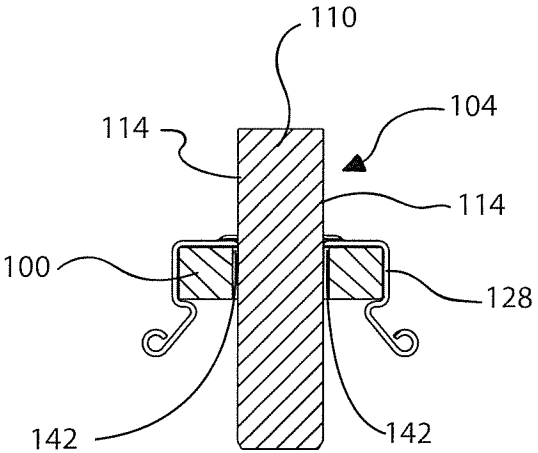
Figure 23:
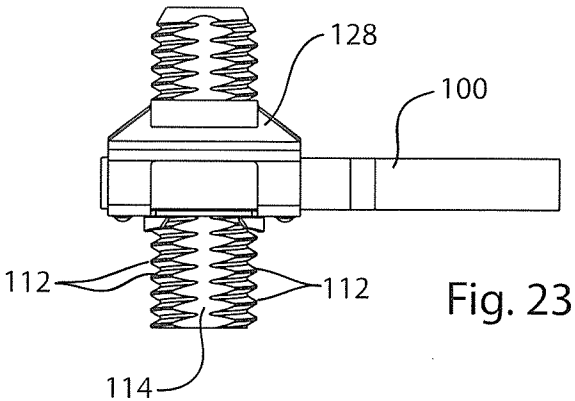
Figure 22:
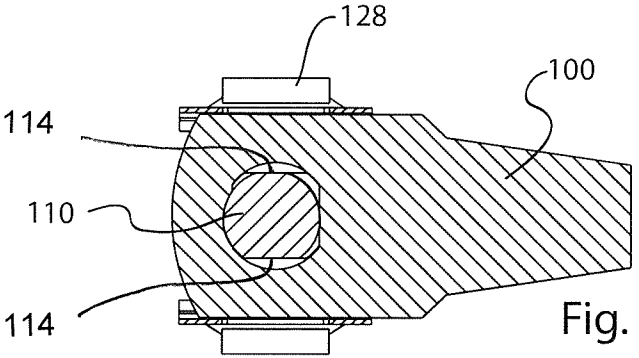
Figure 21:
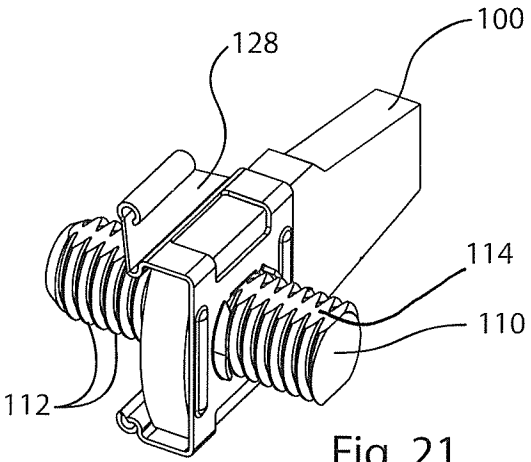
Figure 26:
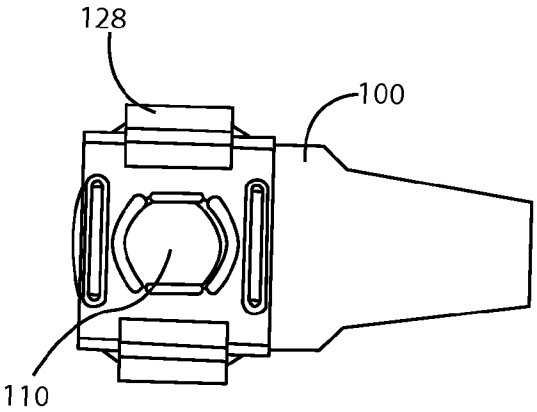
Figure 25:
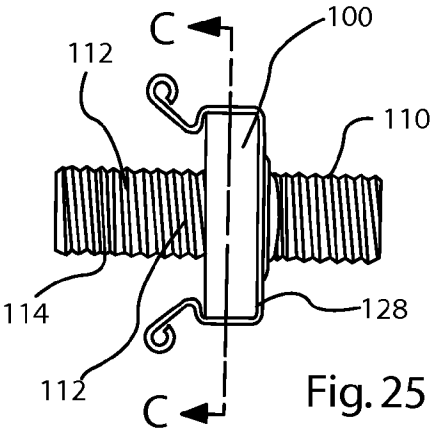
Figure 24:
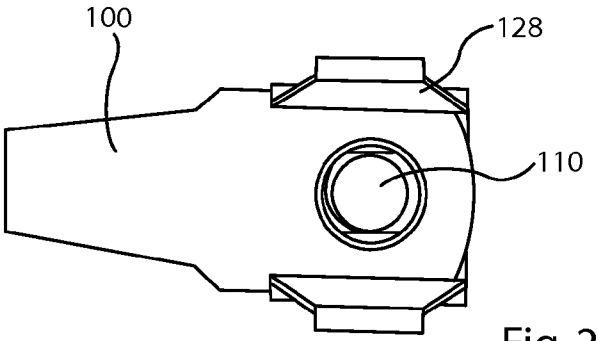
Figures 32, 33, 34, 35, 36, 37:
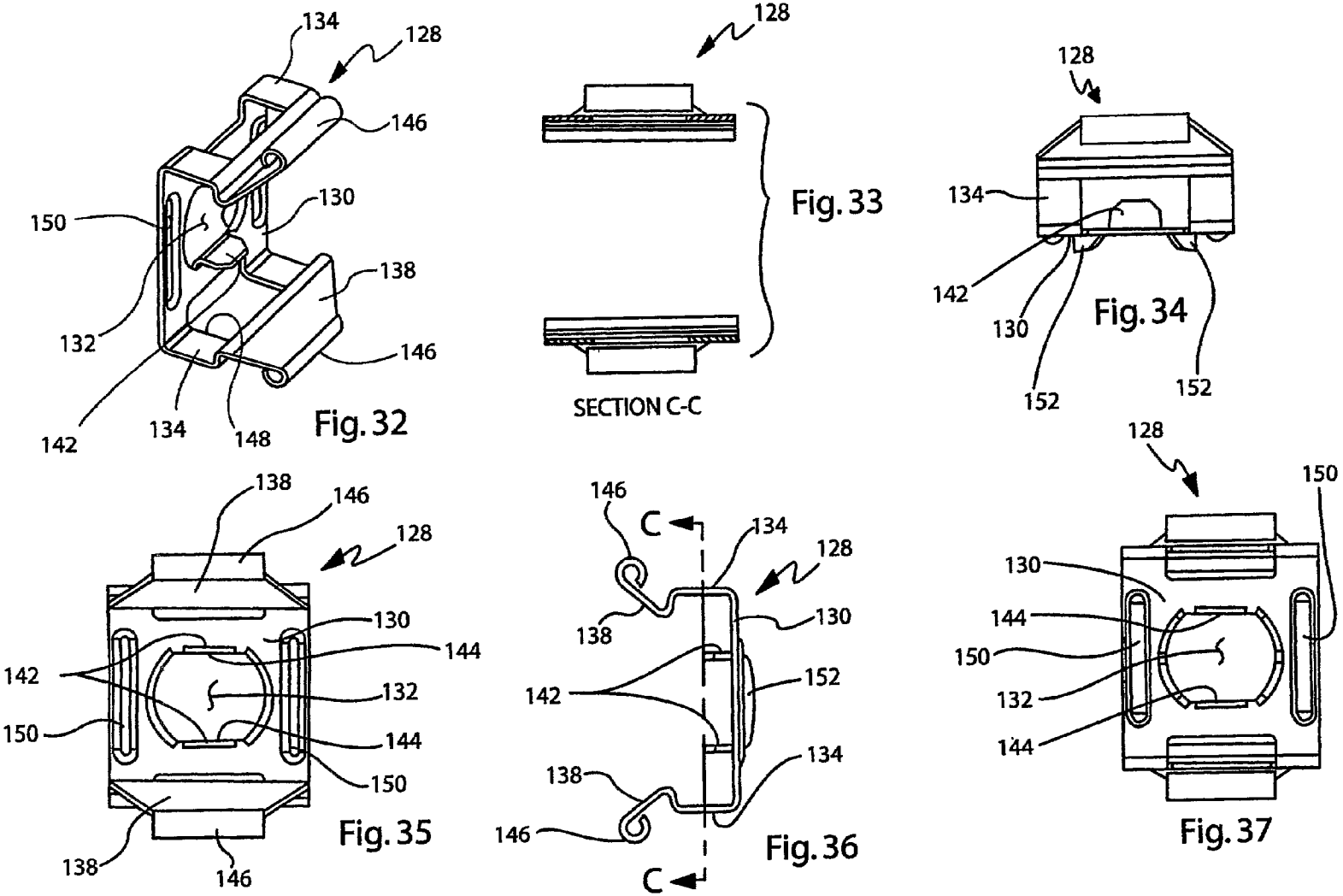
Figure 39:
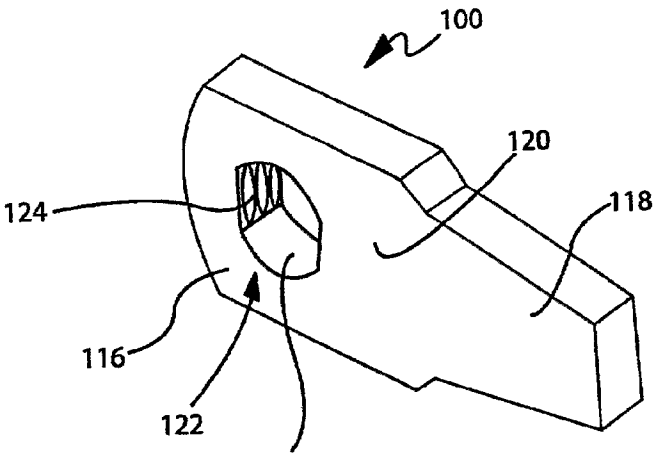
Figure 40:
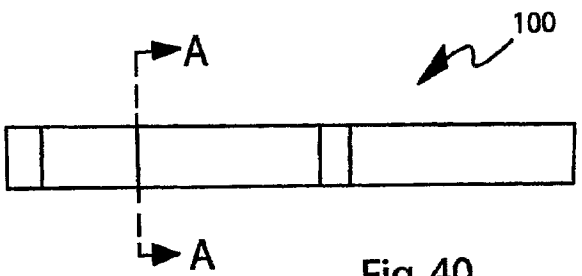
Figure 38:
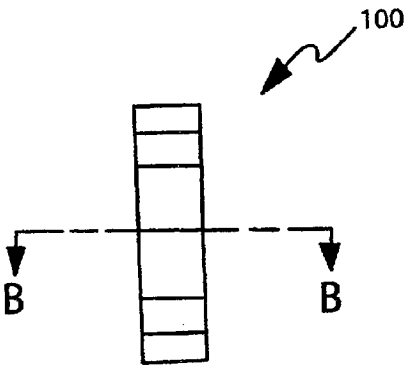
Figure 42:
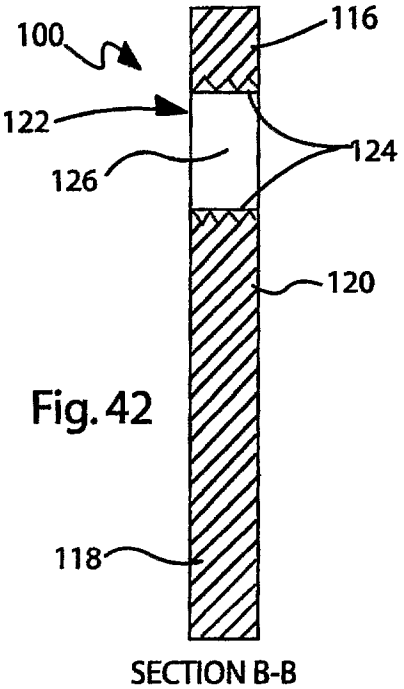
Figure 41:
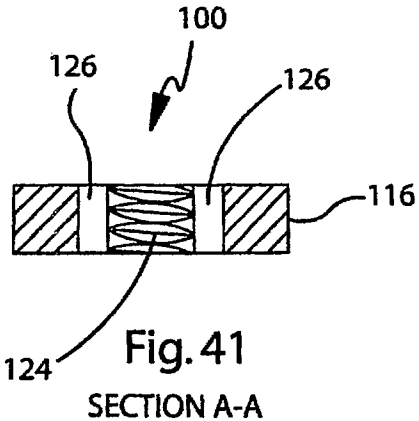
Figure 45:
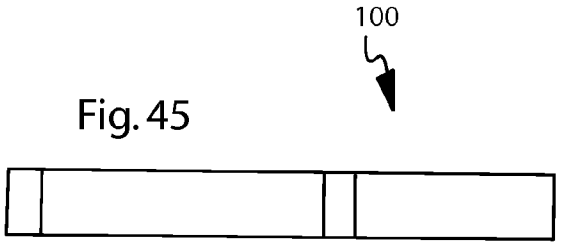
Figure 44:
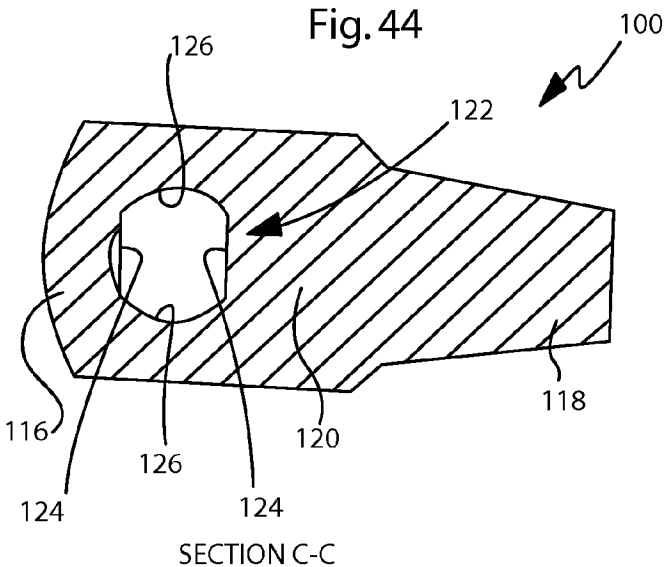
Figure 43:
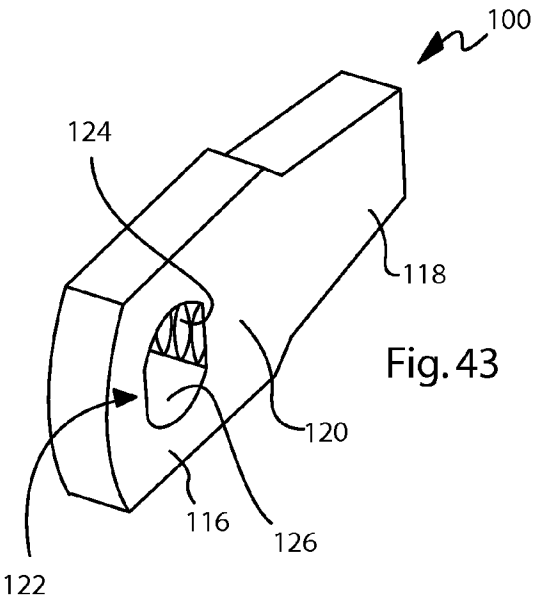
Figure 48:
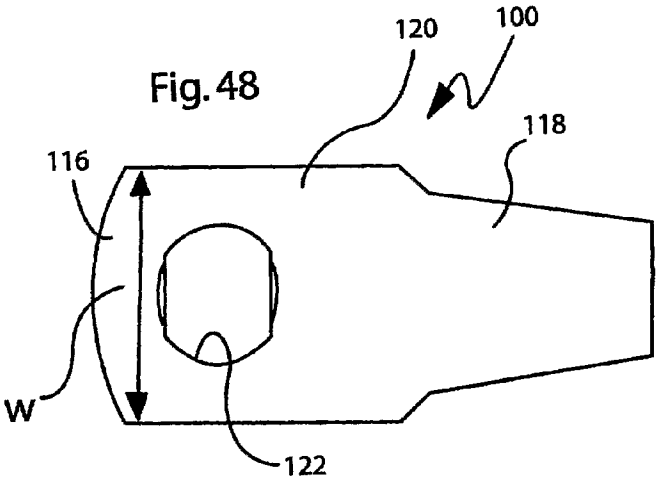
Figure 47:
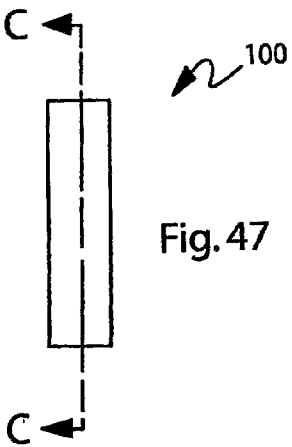
Figure 46:
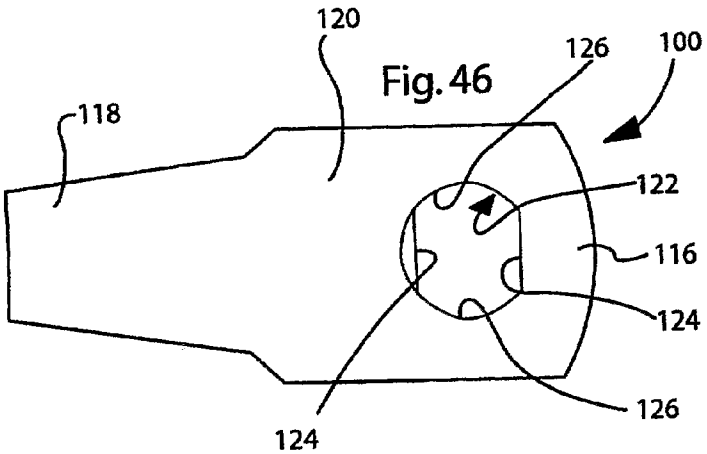
Figure 50:
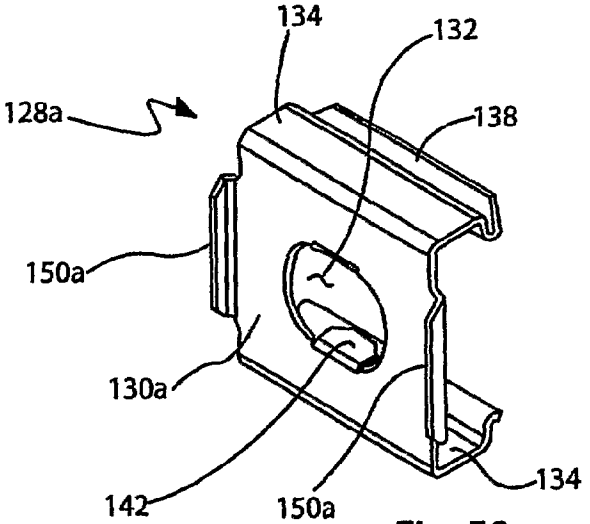
FIGS. 49-59 are views of a second embodiment of the present invention.
Figure 49:
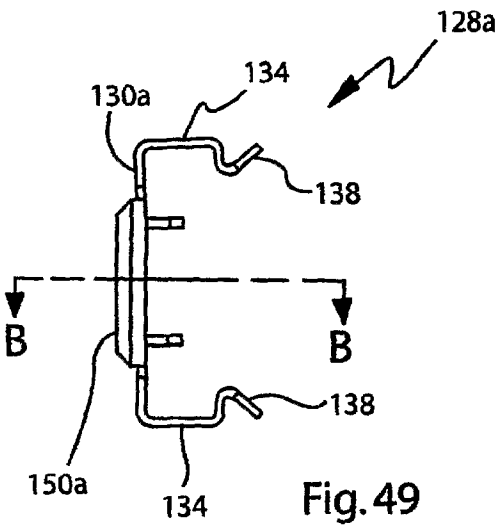
Figure 53:
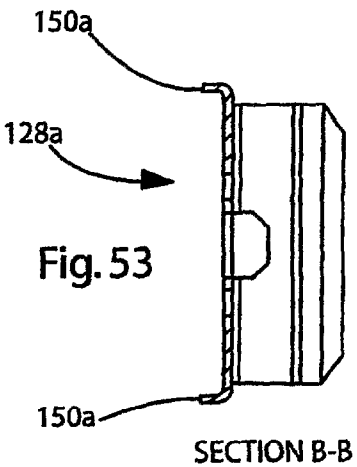
Figure 52:
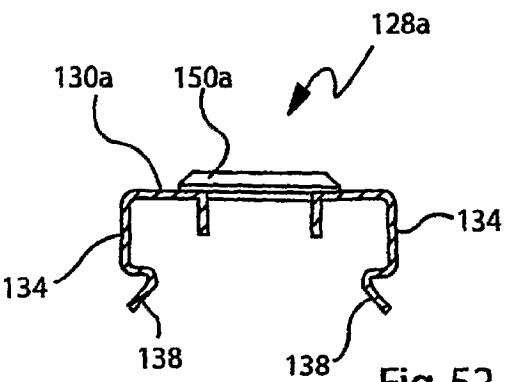
Figure 51:
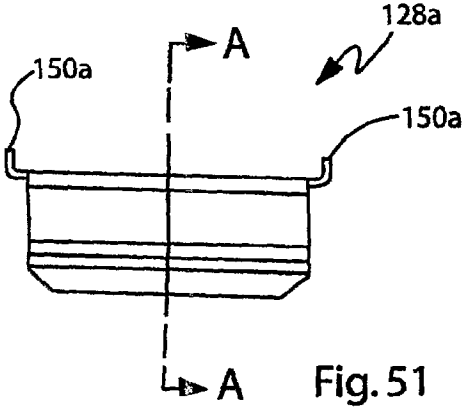
Figure 56:
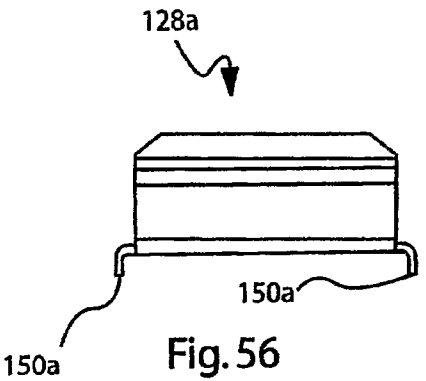
Figure 59:
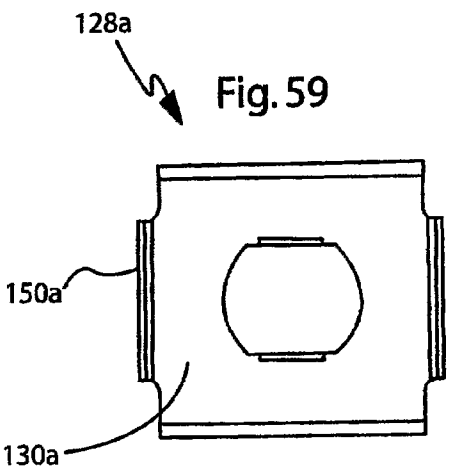
Figure 55:
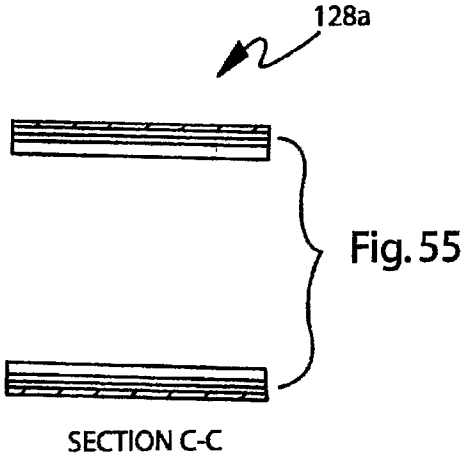
Figure 58:
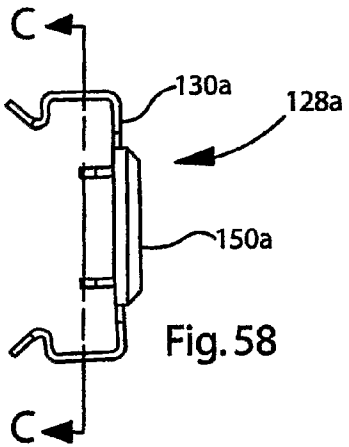
Figure 54:
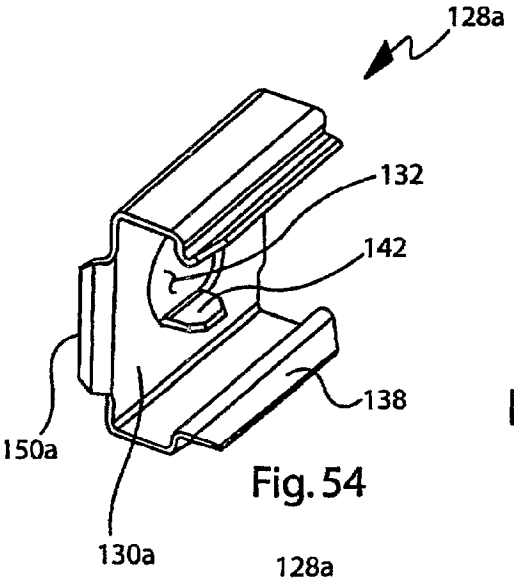
Figure 57:
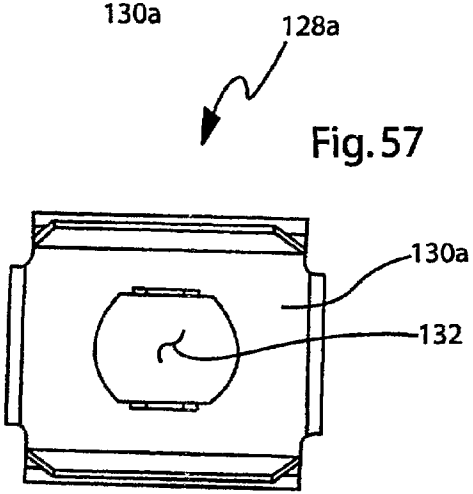
Figure 61:
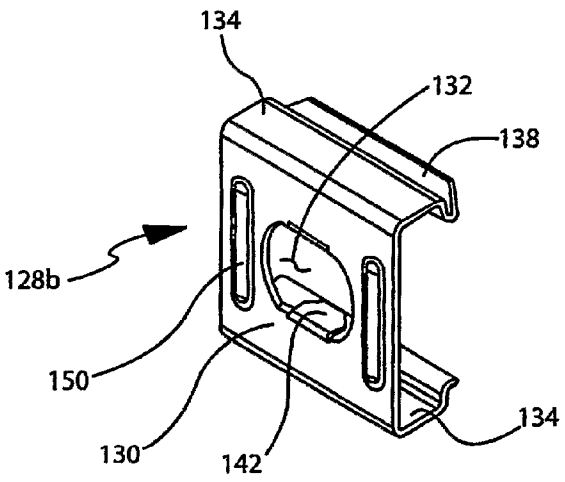
FIGS. 60-70 are views of a third embodiment of the present invention.
Figure 64:
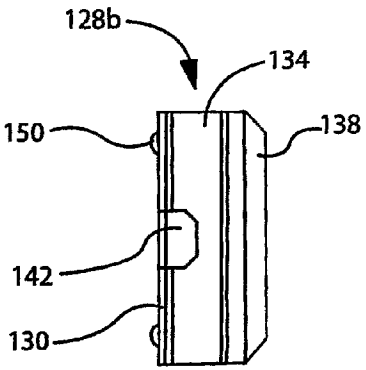
Figure 63:
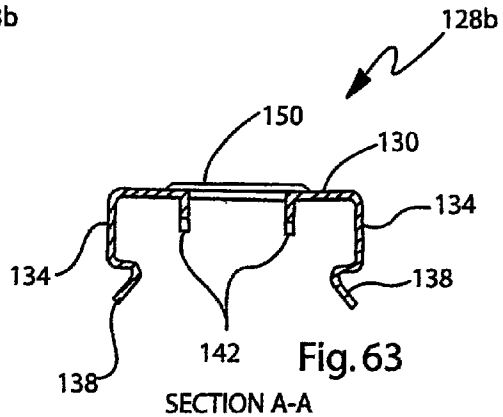
Figure 60:
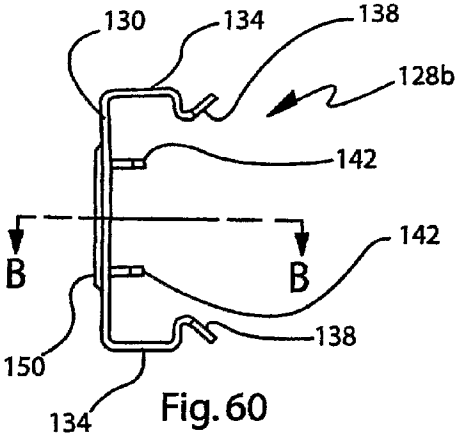
Figure 62:
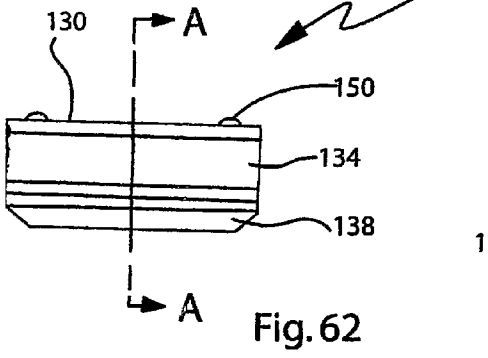
Figure 67:
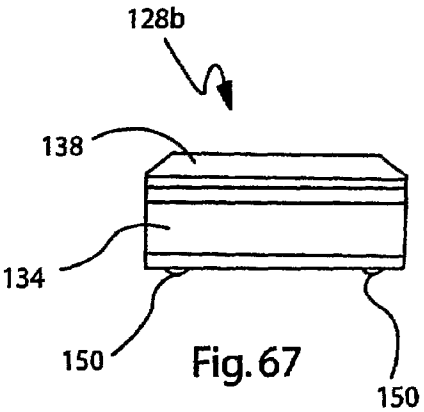
Figure 70:
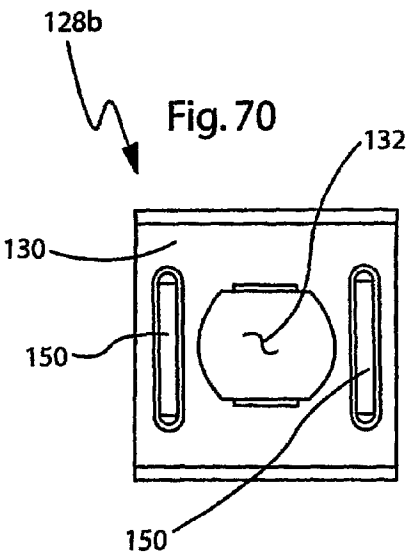
Figure 66:
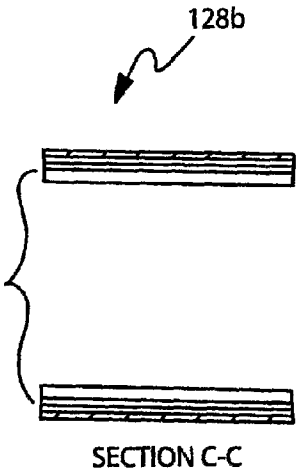
Figure 69:
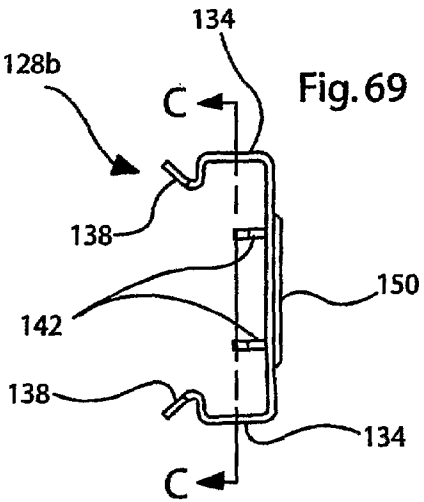
Figure 65:
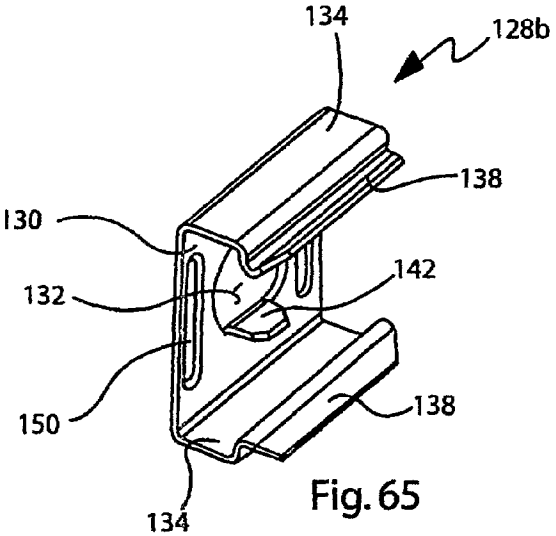
Figure 68:
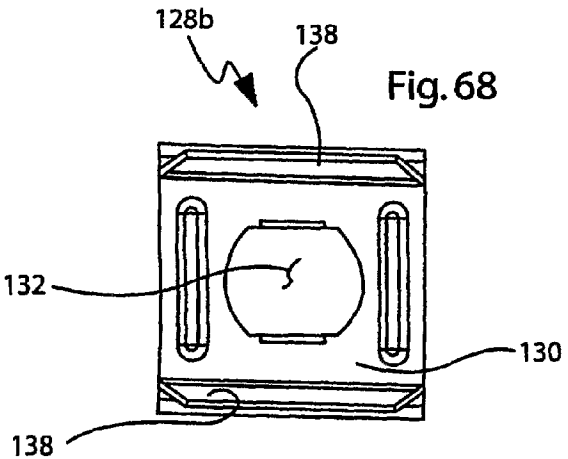
Figure 72:
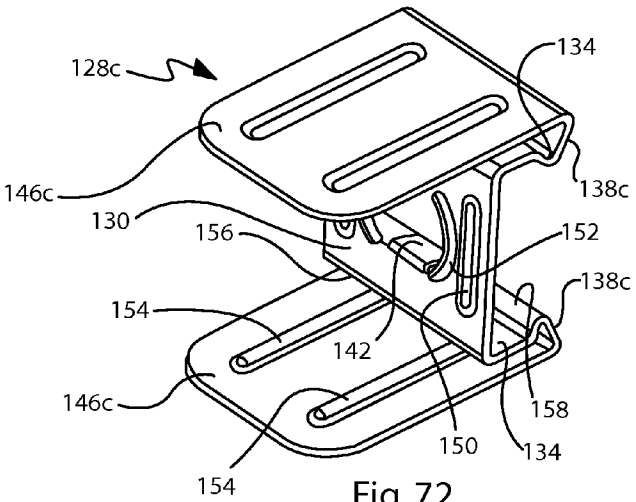
FIGS. 71-103 are views of a fourth embodiment of the present invention.
Figure 75:
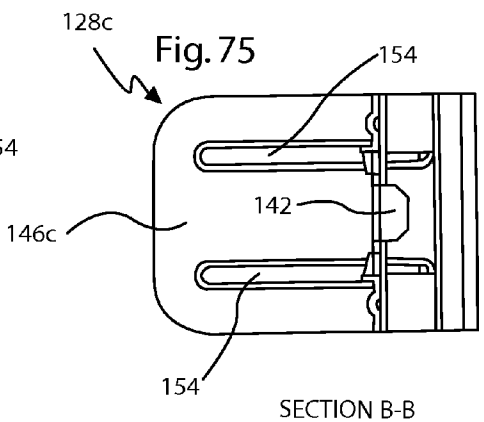
Figure 74:
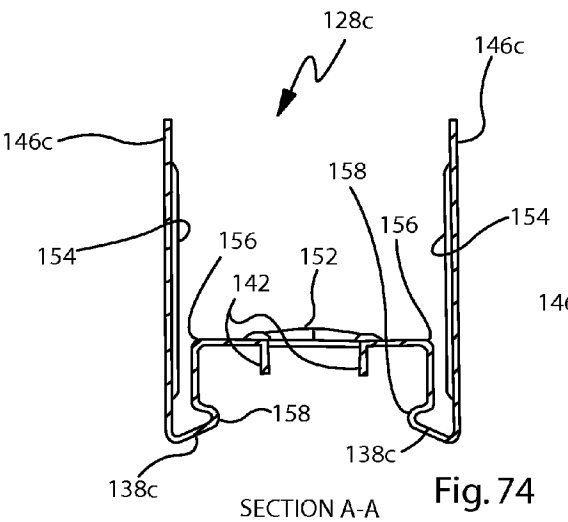
Figure 71:
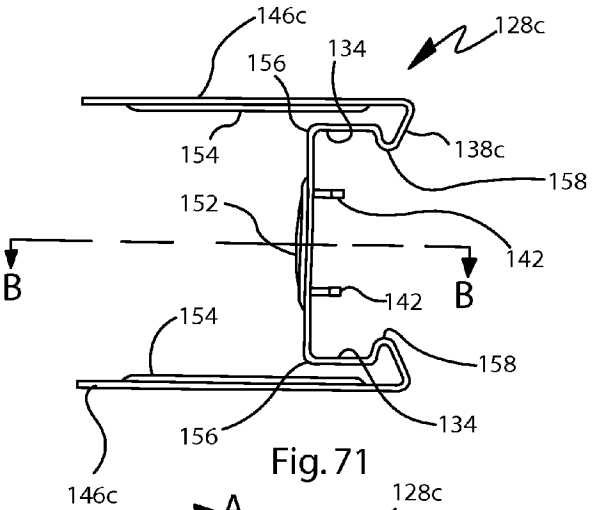
Figure 73:
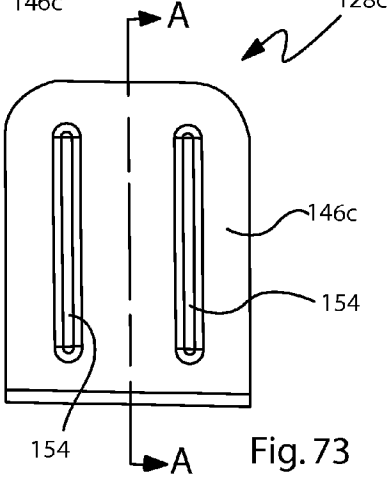
Figure 78:
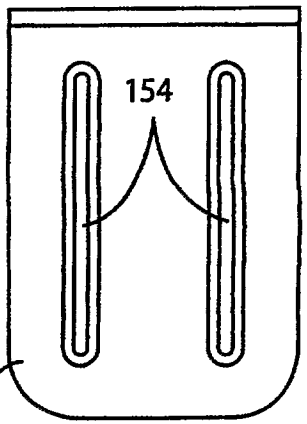
Figure 77:
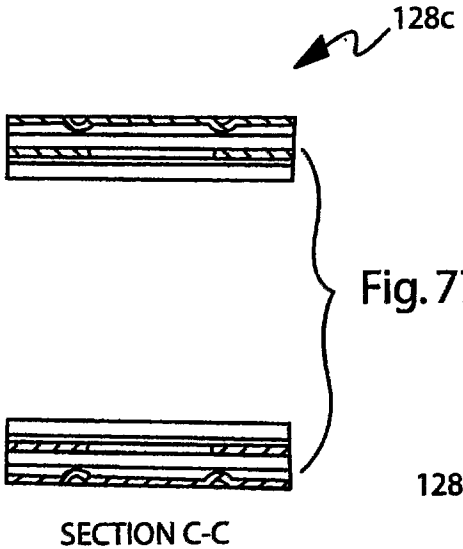
Figure 76:
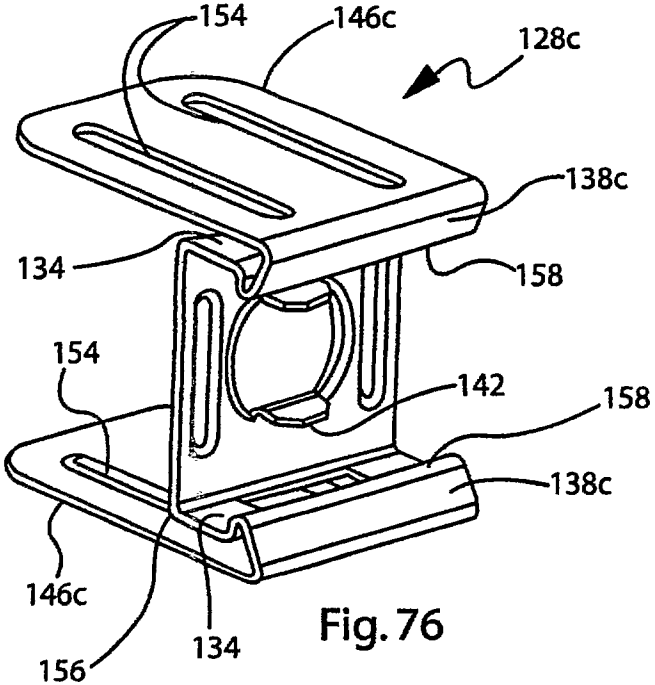
Figures 79, 80, 81:
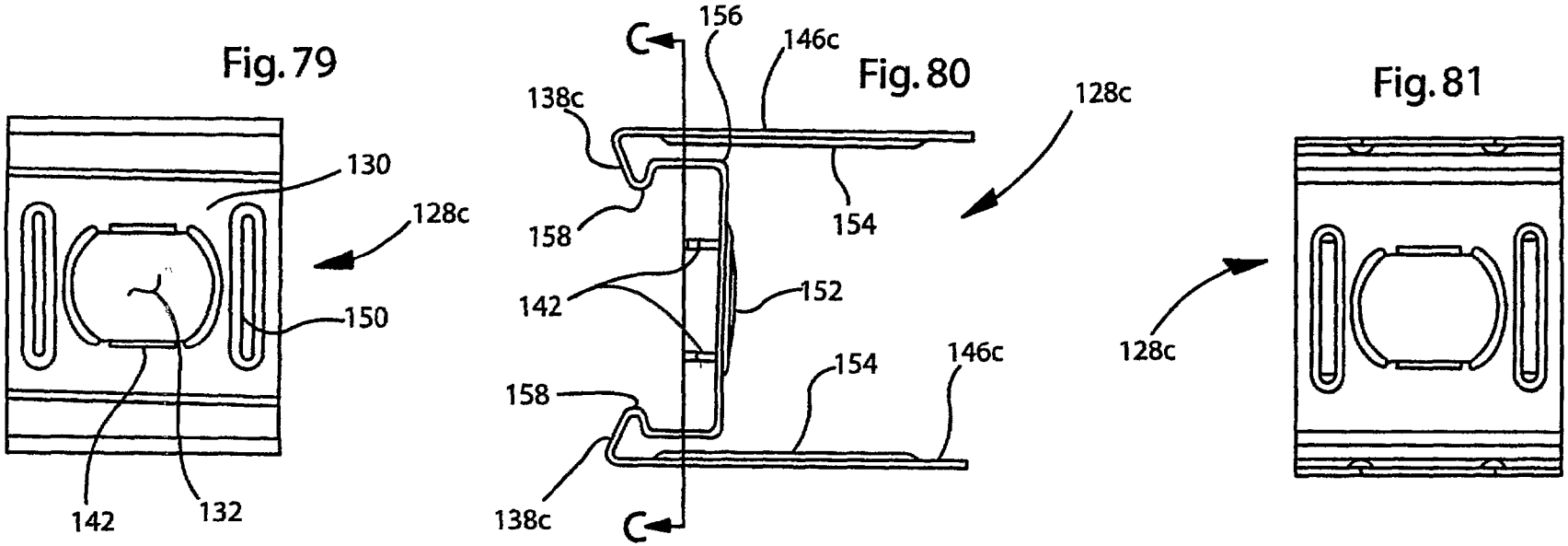
Figure 82:
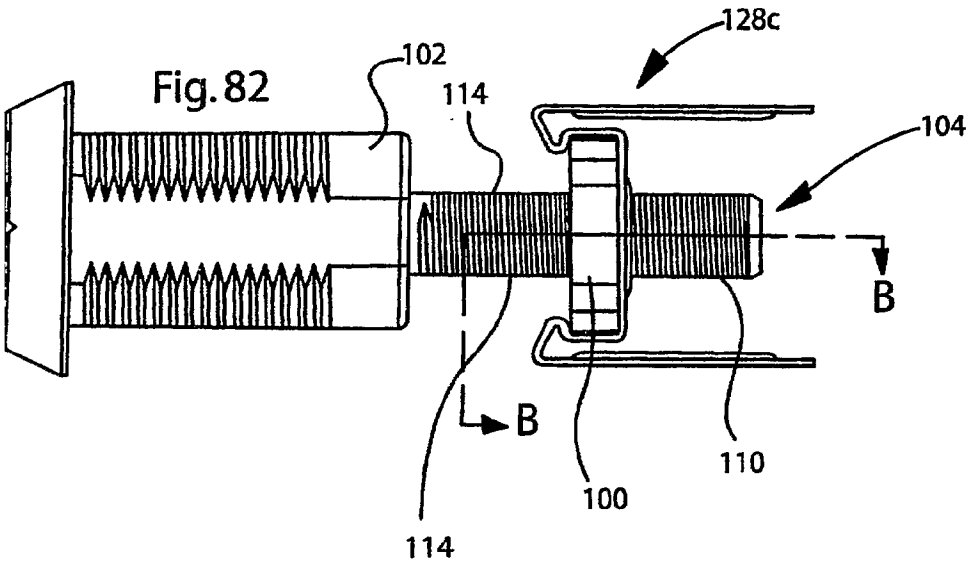
Figure 83:
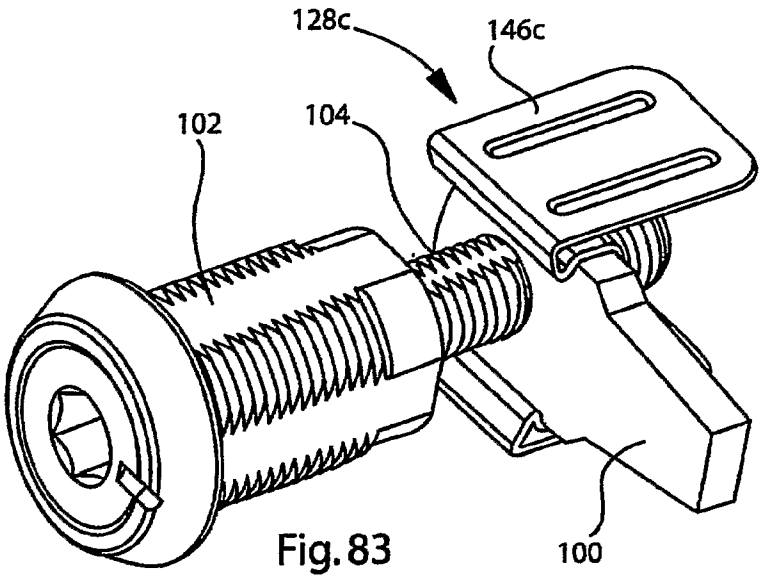
Figure 86:
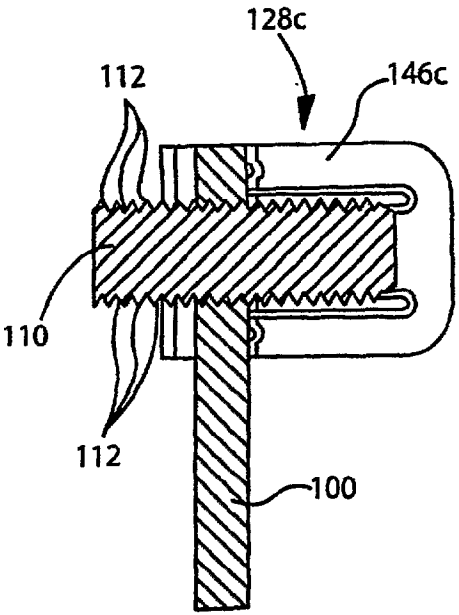
Figure 85:
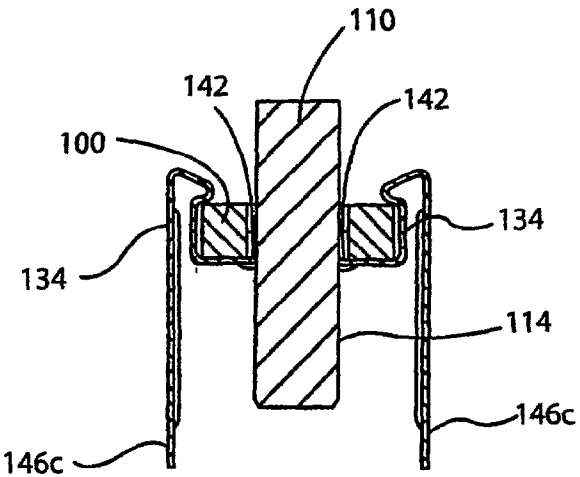
Figure 84:
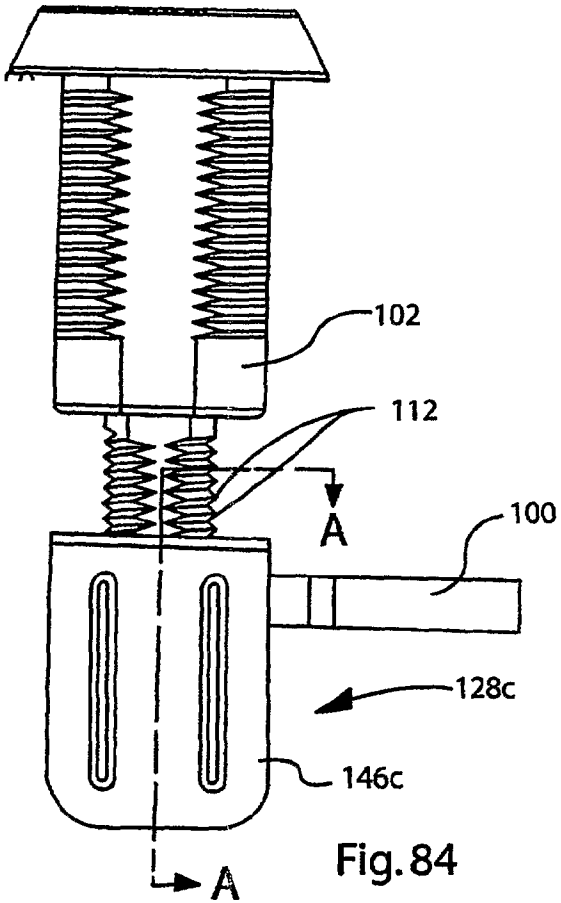
Figure 89:
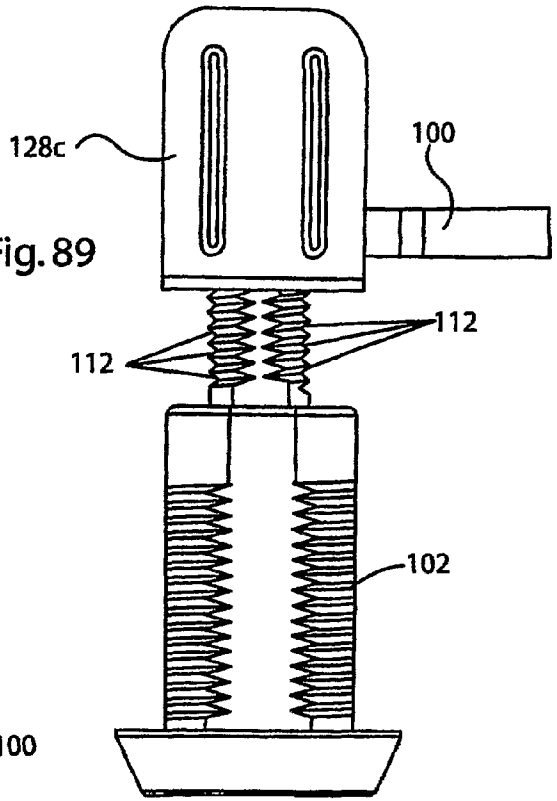
Figure 88:
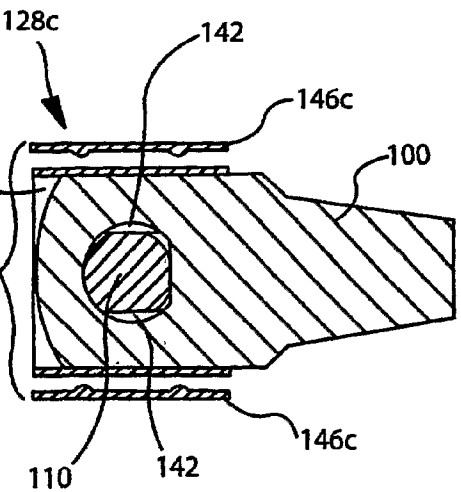
Figure 87:
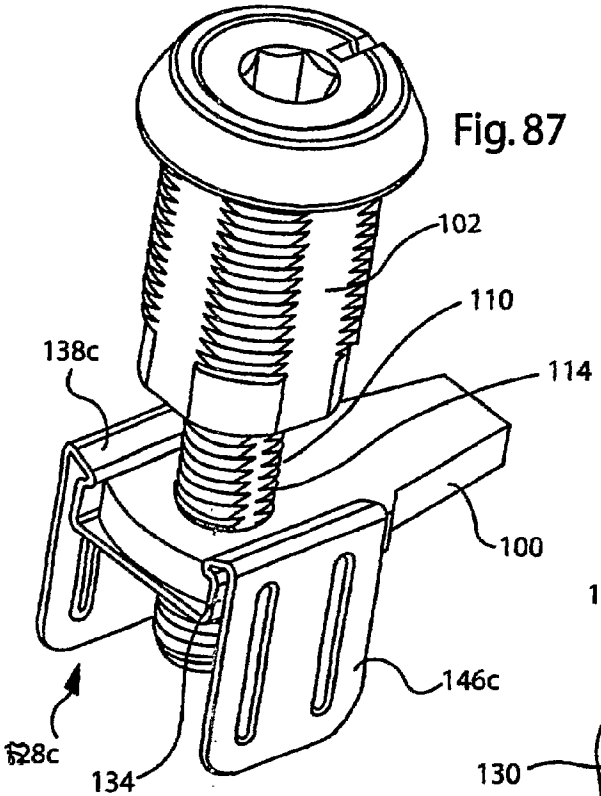
Figure 92:
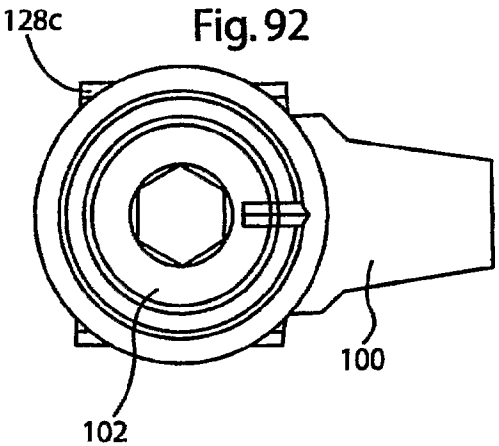
Figure 91:
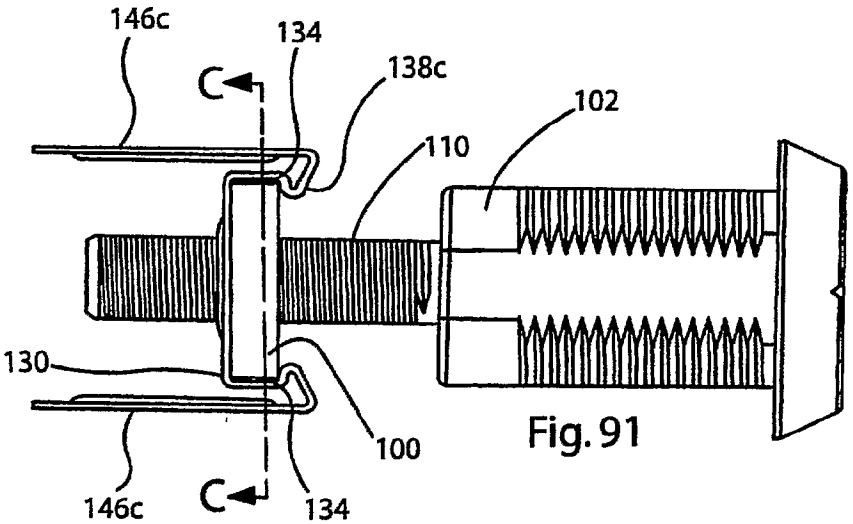
Figure 90:
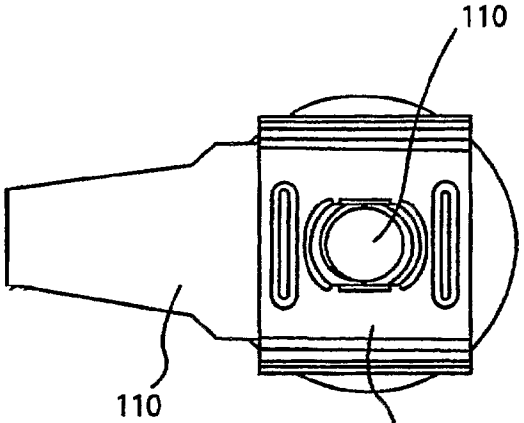
Figure 93:
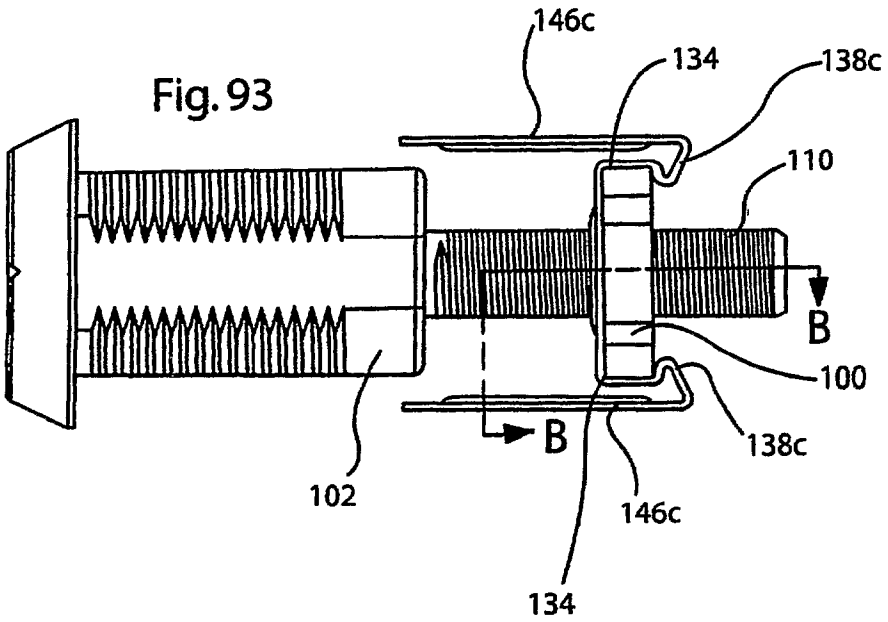
Figure 94:
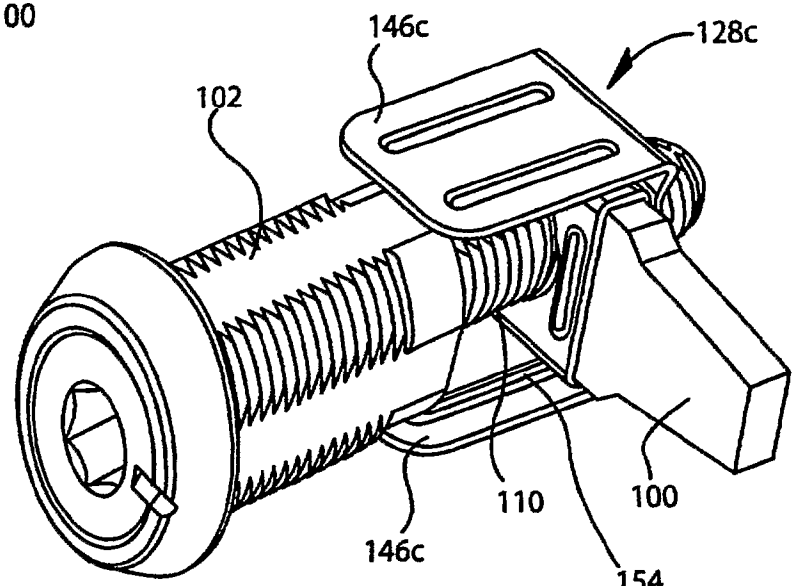
Figure 97:
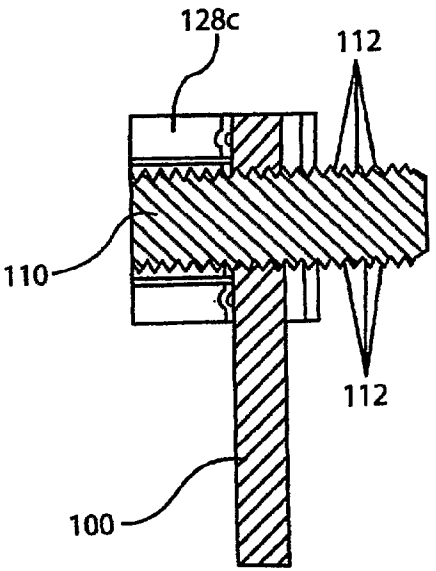
Figure 96:
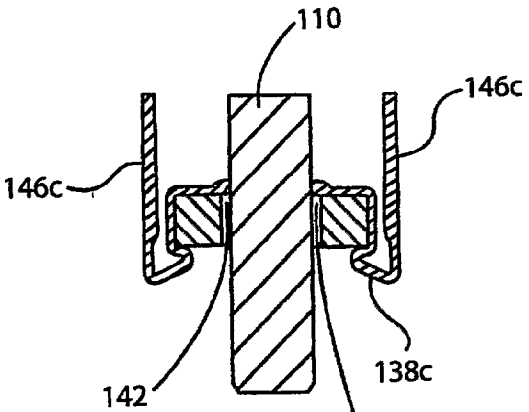
Figure 95:
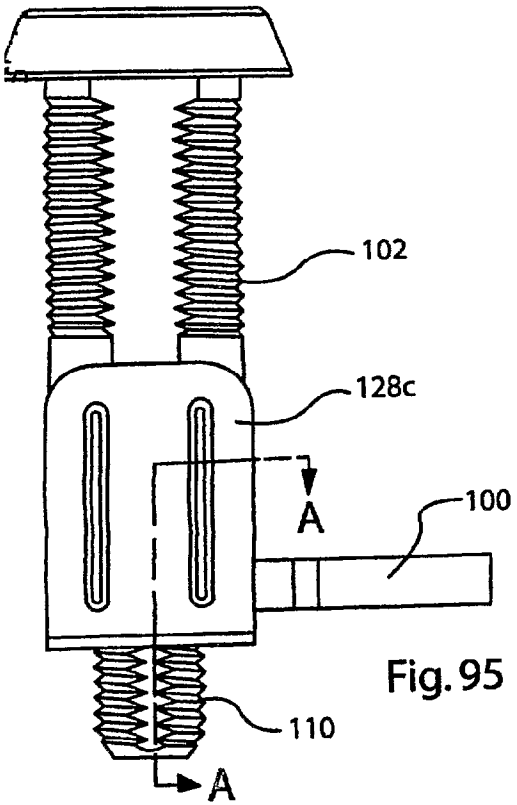
Figure 100:
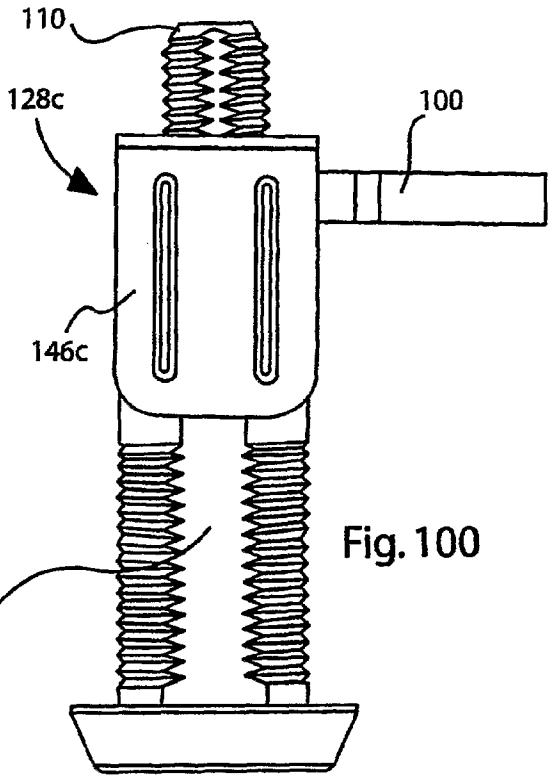
Figure 99:
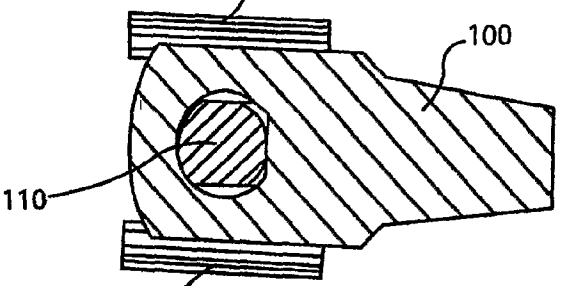
Figure 98:
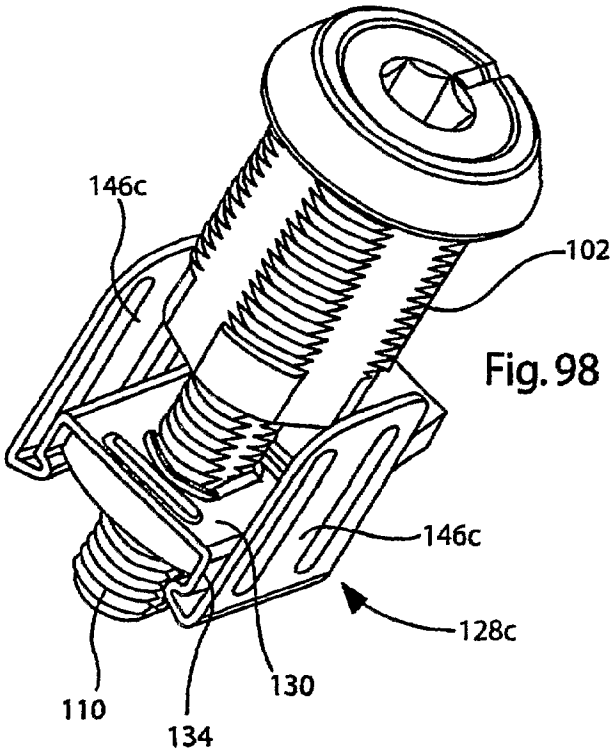
Figure 102:
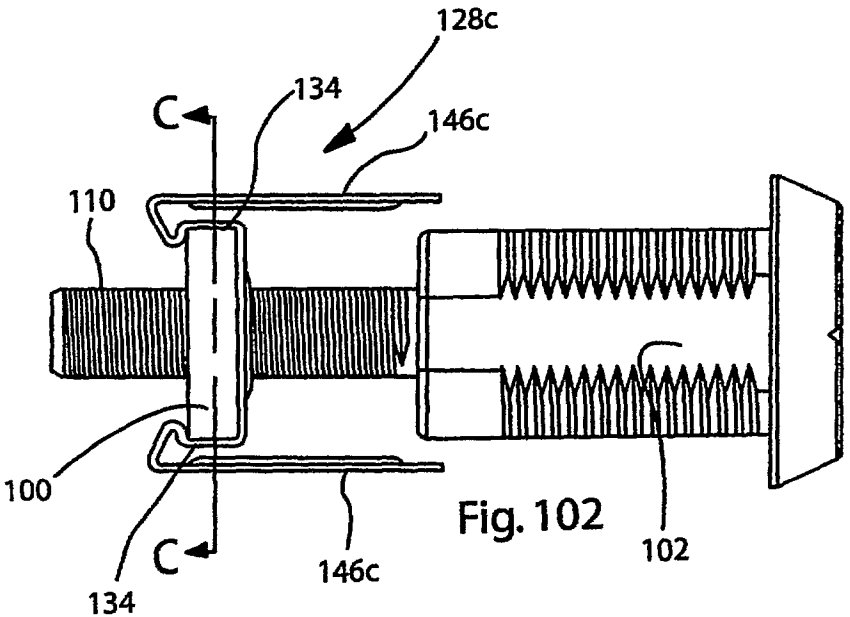
Figure 101:
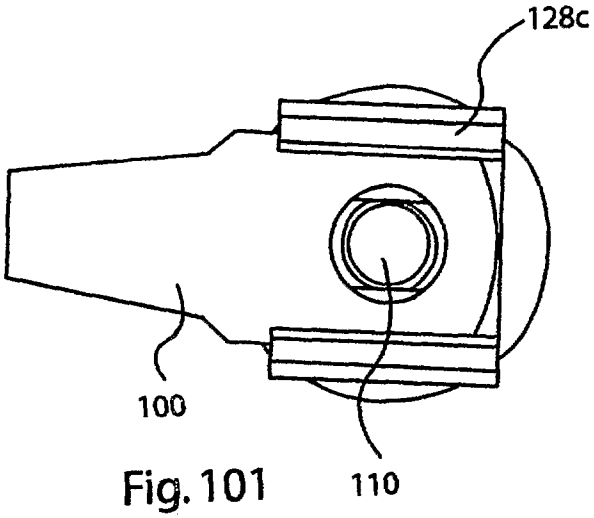
Figure 103:
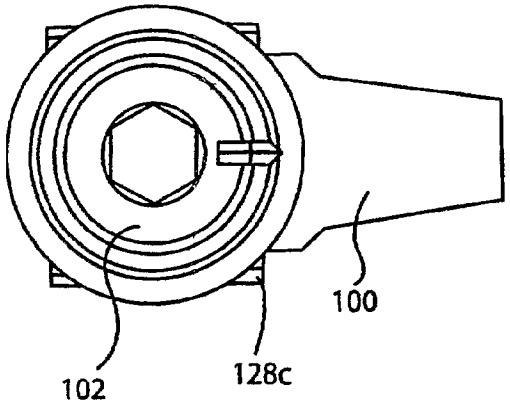
Figure 104:
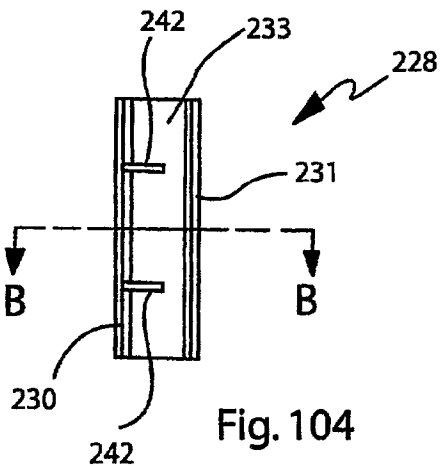
FIGS. 104-125 are views of a fifth embodiment of the present invention.
Figure 105:
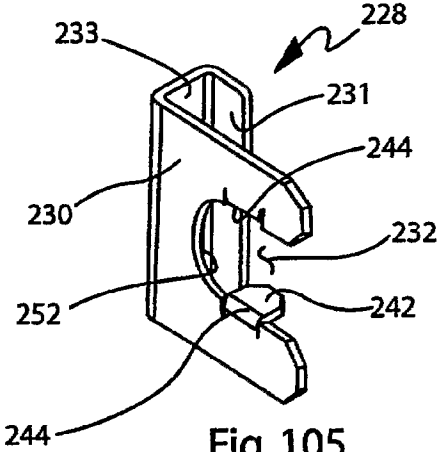
Figure 106:
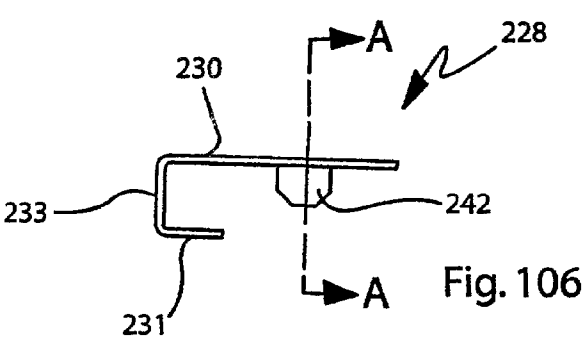
Figure 107:
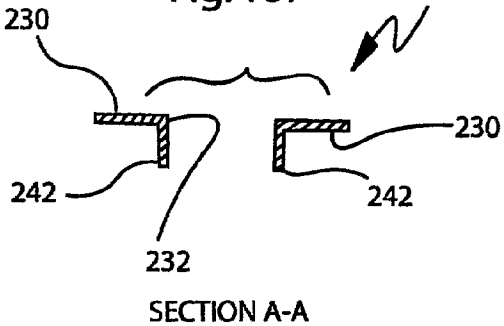
Figure 108:
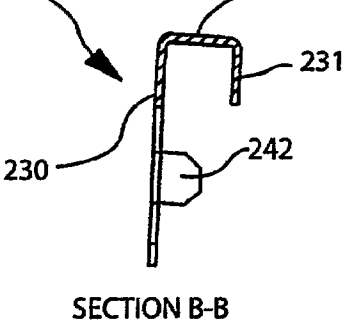
Figure 109:
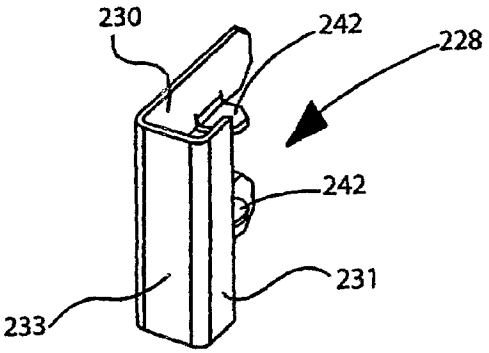
Figure 110:
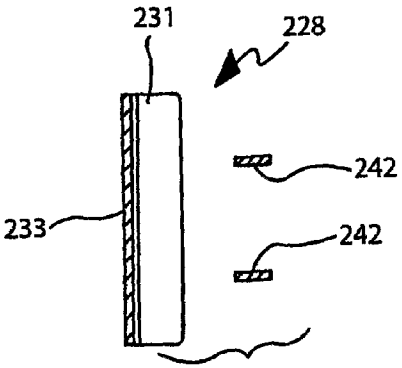
Figure 111:
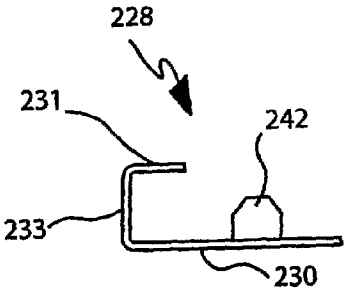
Figure 112:
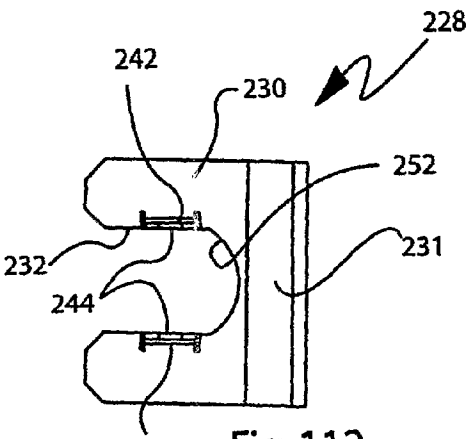
Figure 113:
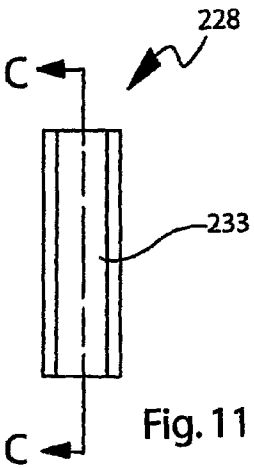
Figure 114:
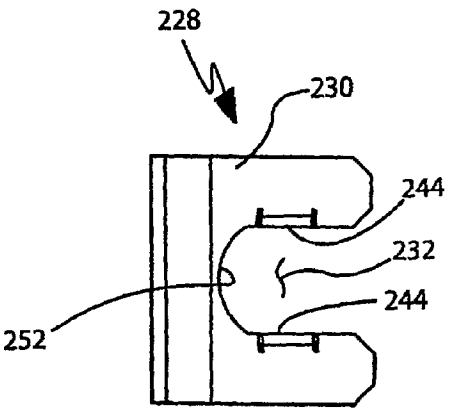
Figure 115:
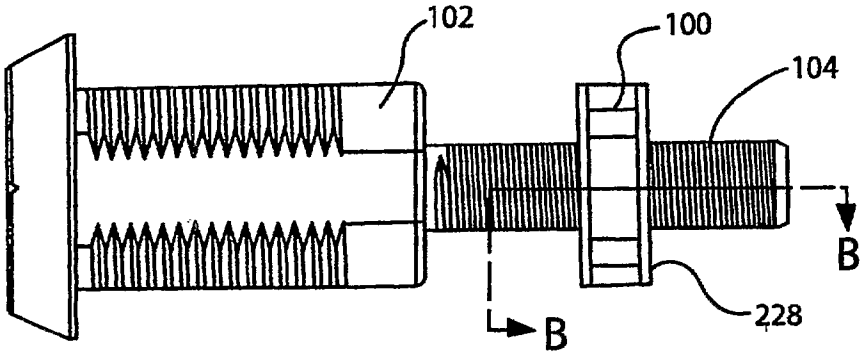
Figure 116:
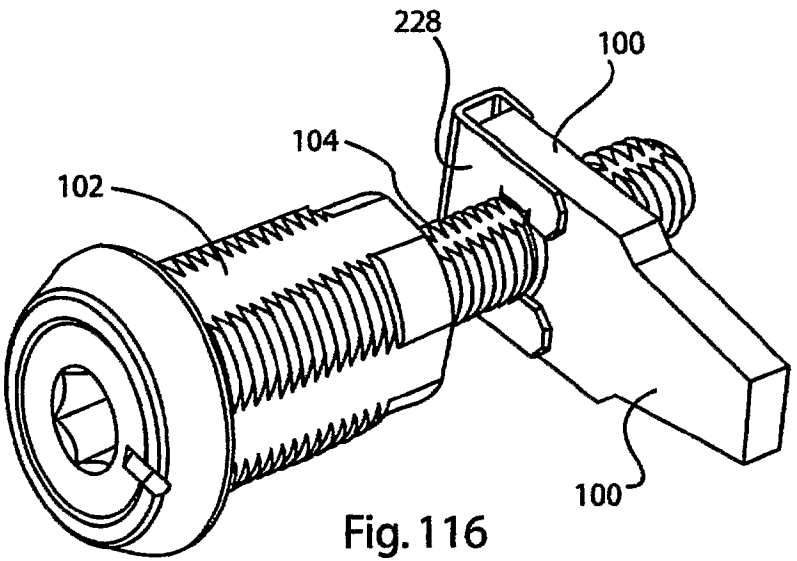
Figure 119:
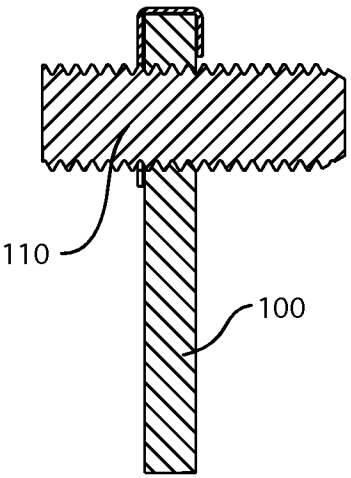
Figure 118:
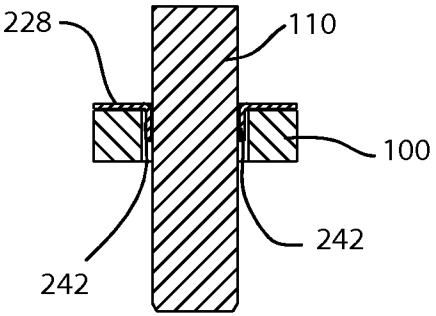
Figure 117:
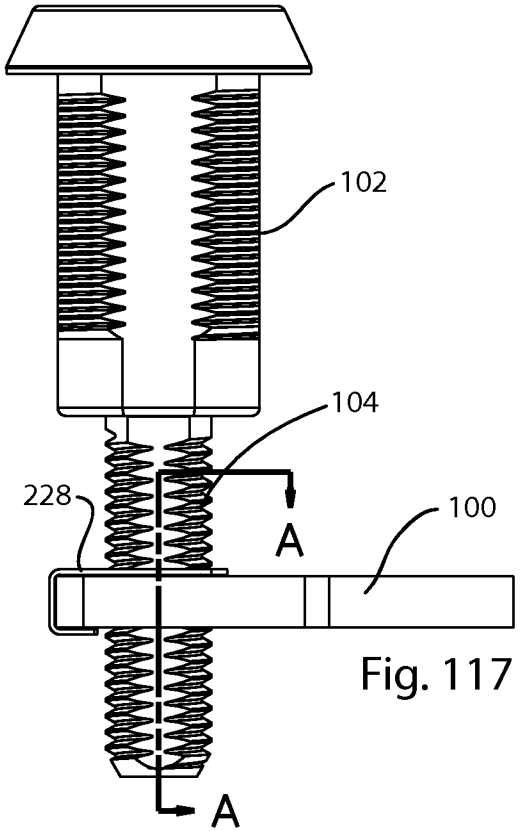
Figure 122:
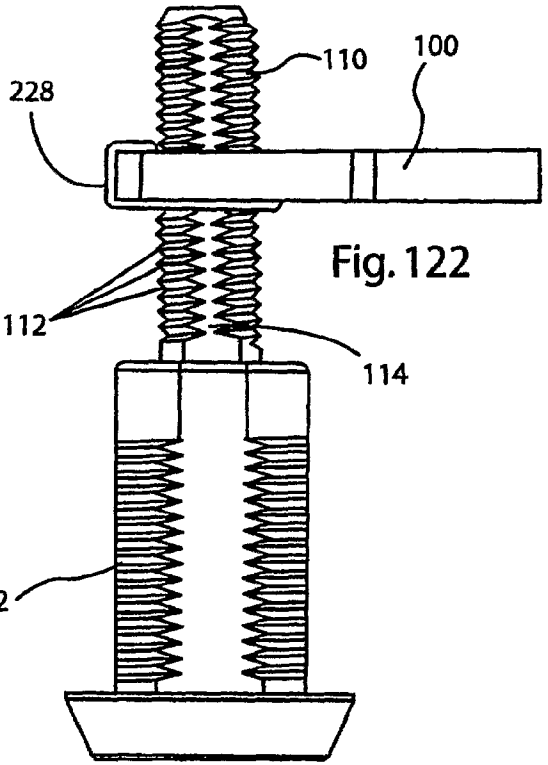
Figure 121:
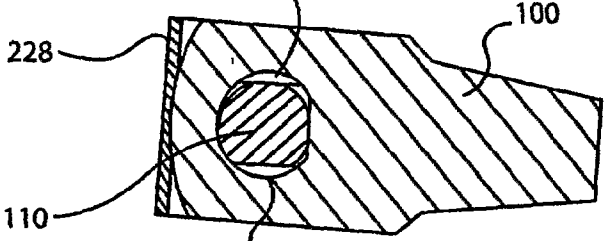
Figure 120:
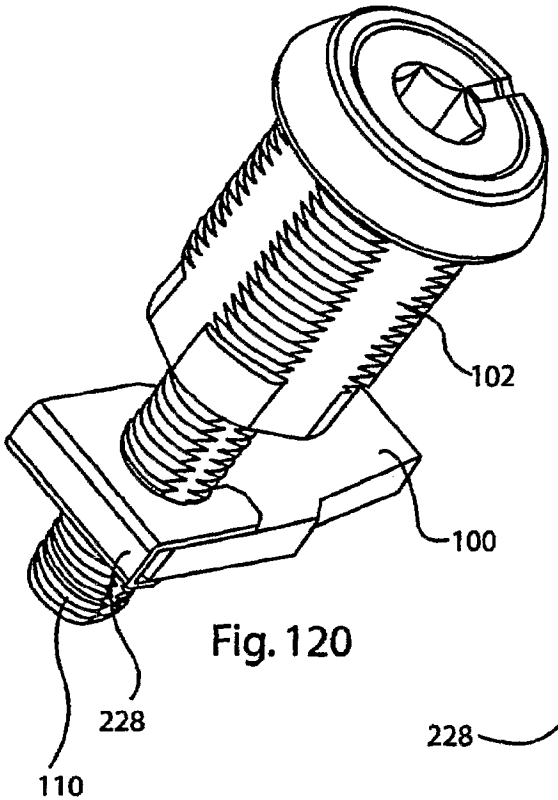
Figure 125:
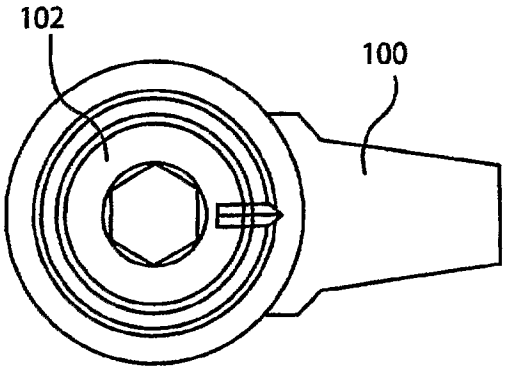
Figure 124:
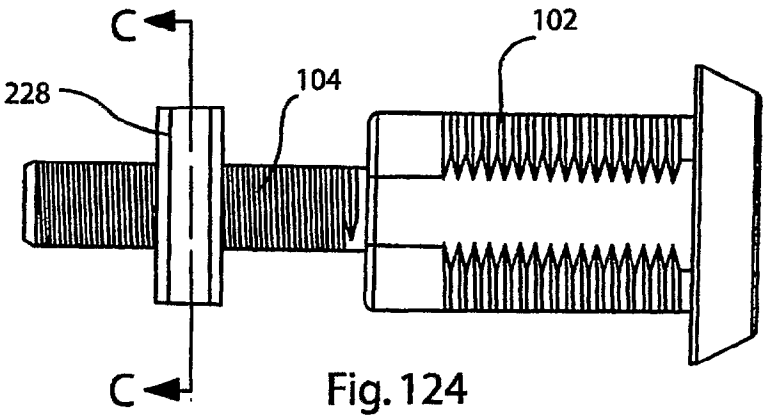
Figure 123:
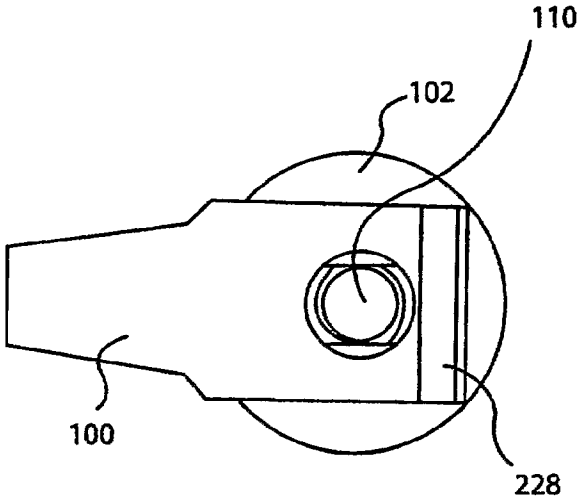
Figure 127:
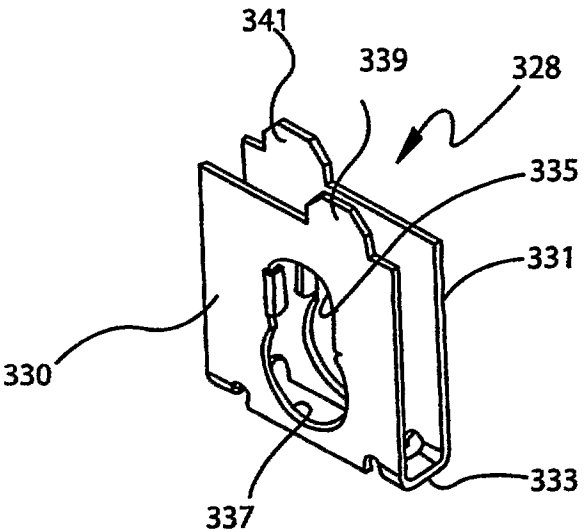
FIGS. 126-147 are views of a sixth embodiment of the present invention.
Figure 126:
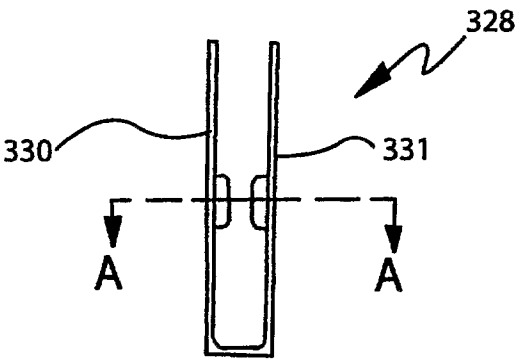
Figure 130:
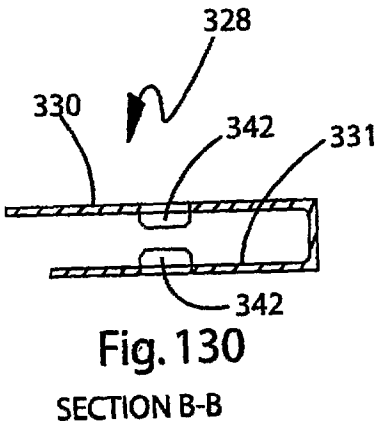
Figure 129:
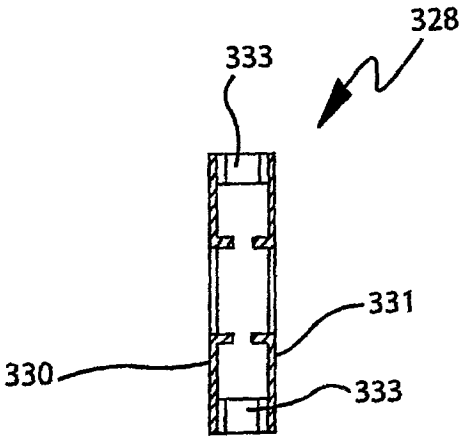
Figure 128:
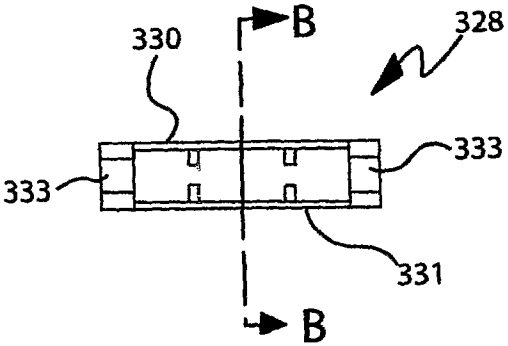
Figure 133:
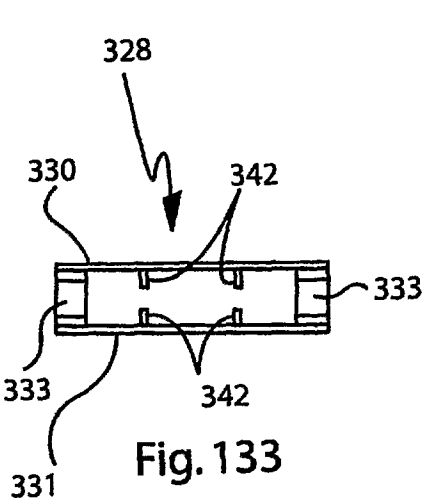
Figure 132:
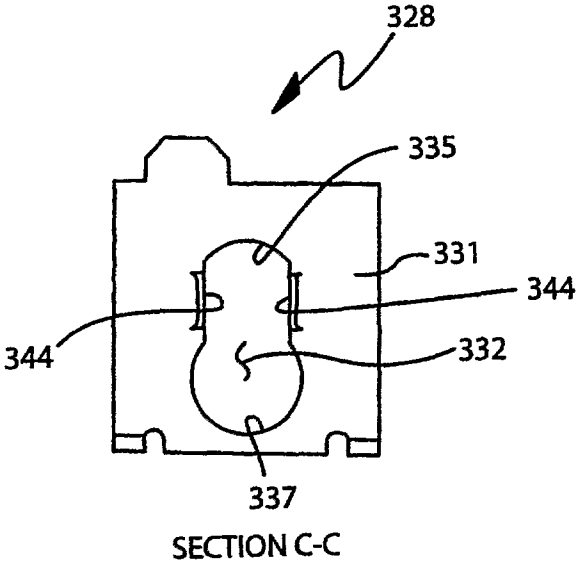
Figure 131:
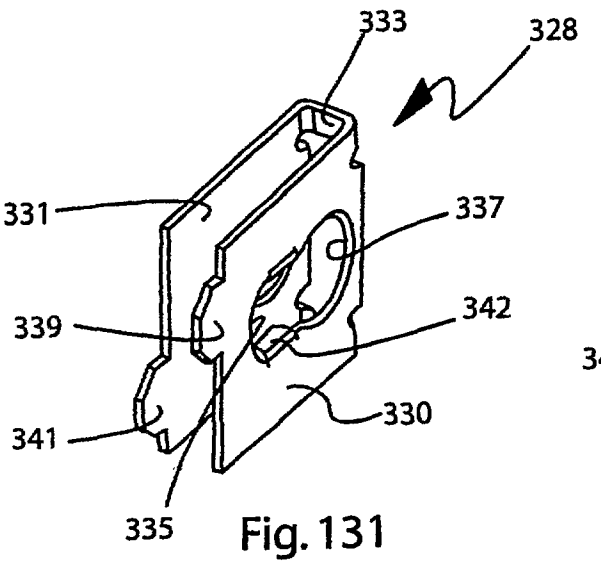
Figure 136:
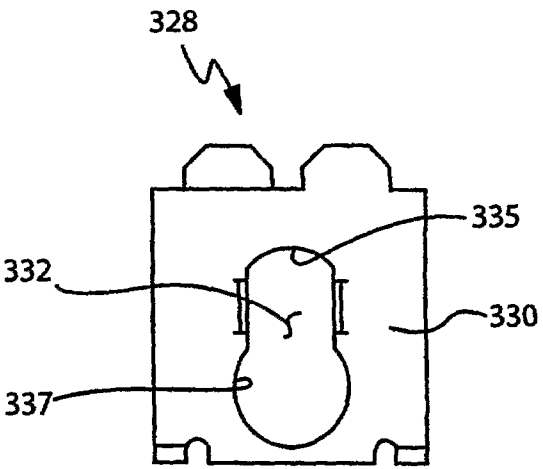
Figure 135:
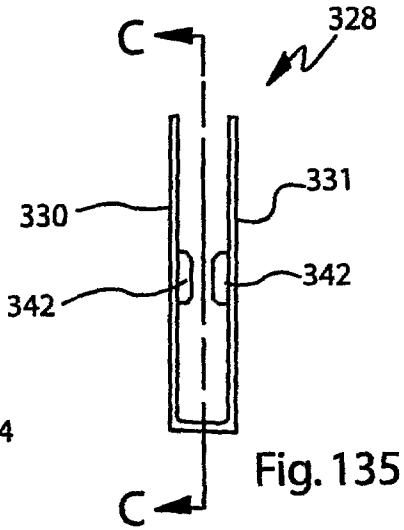
Figure 134:
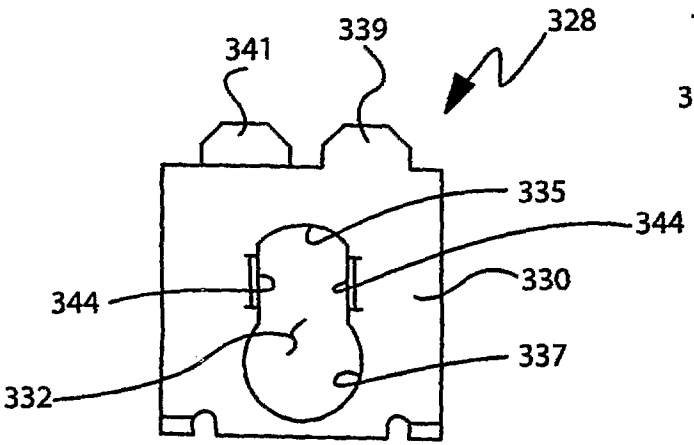
Figure 138:
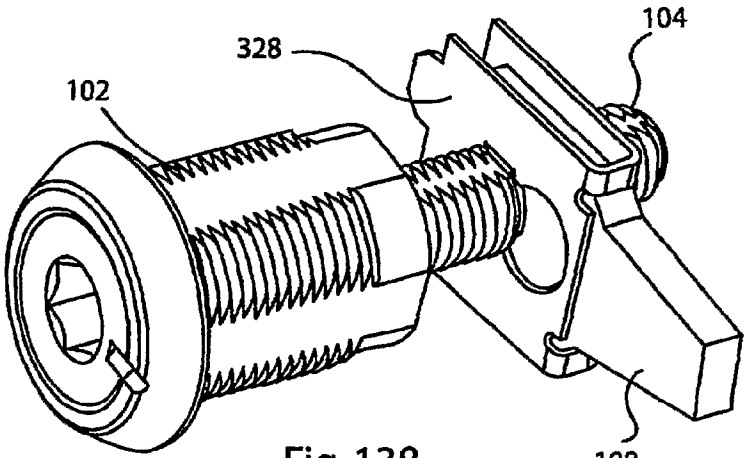
Figure 137:
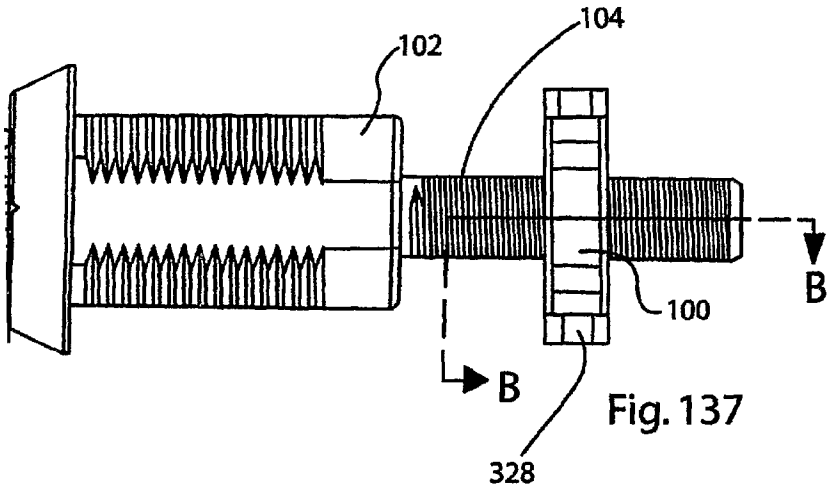
Figure 141:
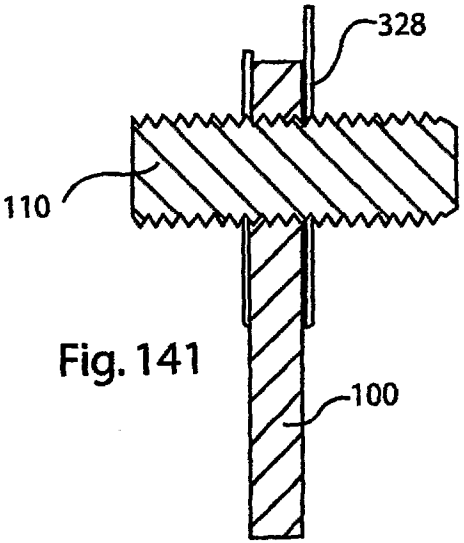
Figure 140:
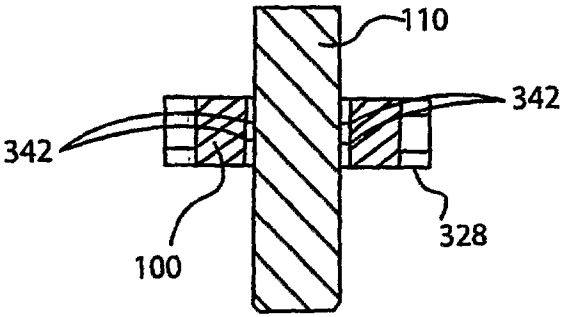
Figure 139:
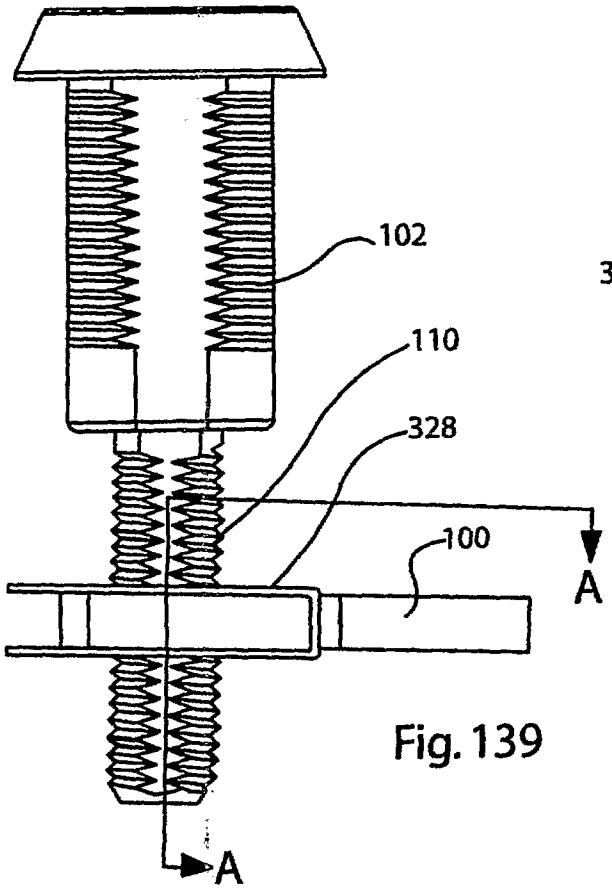
Figure 143:
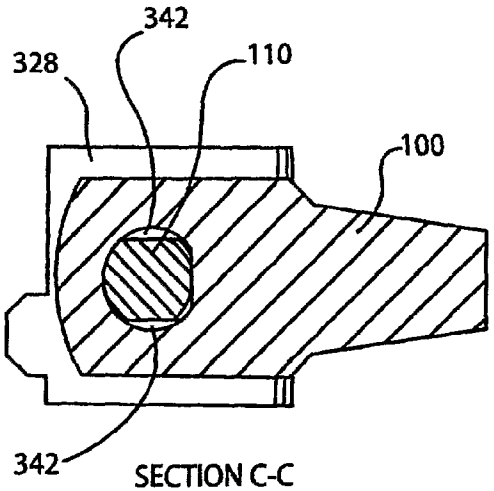
Figure 144:
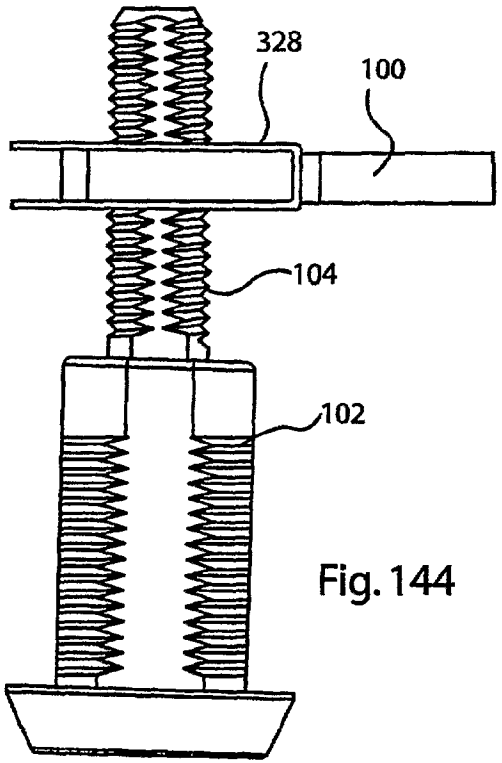
Figure 142:
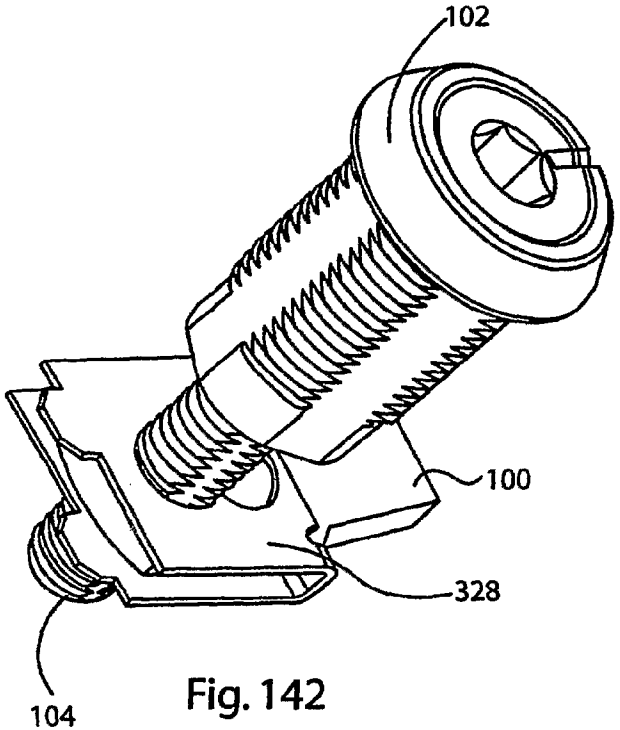
Figure 147:
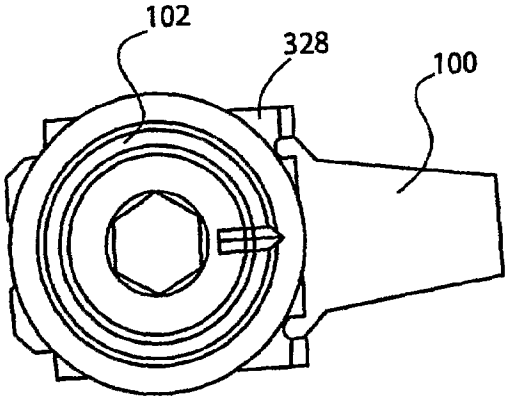
Figure 146:
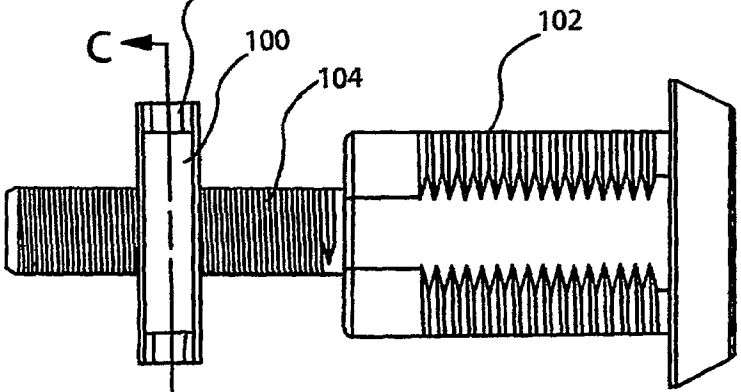
Figure 145:
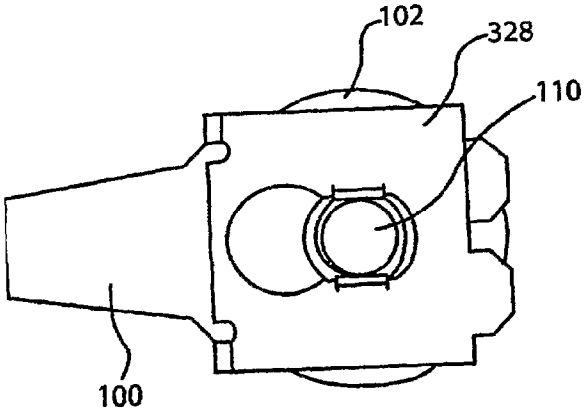
Figure 149:
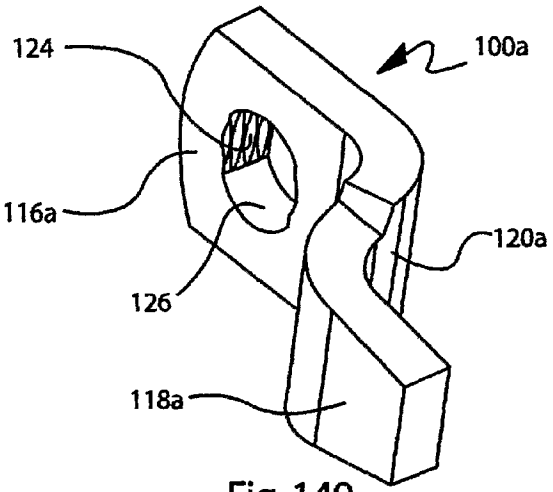
FIGS. 148-169 are views of alternative pawls that can be used as part of the pawl assembly of the present invention.
Figure 148:
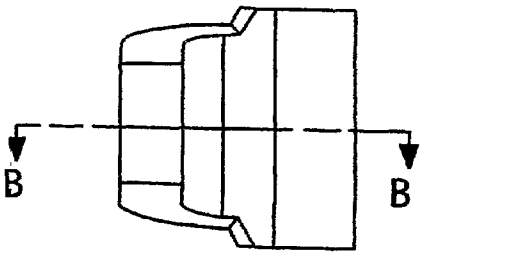
Figure 150:
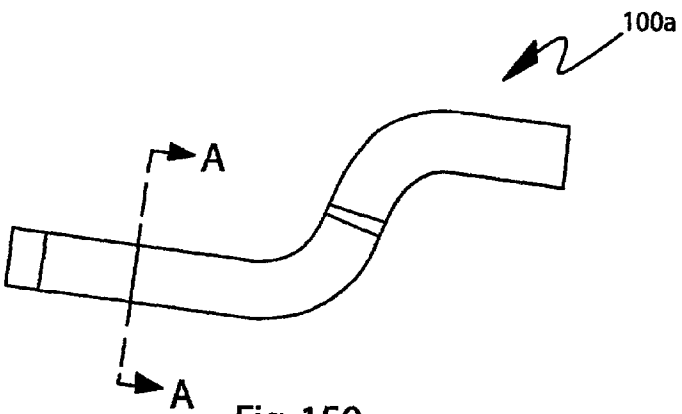
Figure 152:
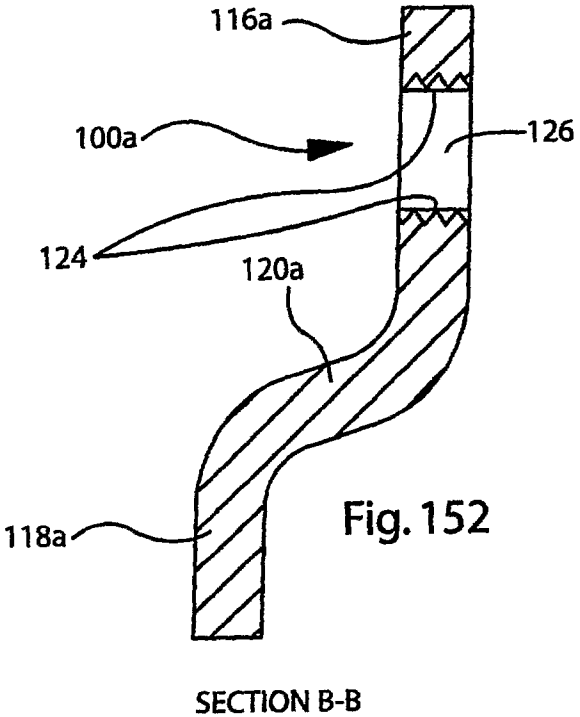
Figure 151:
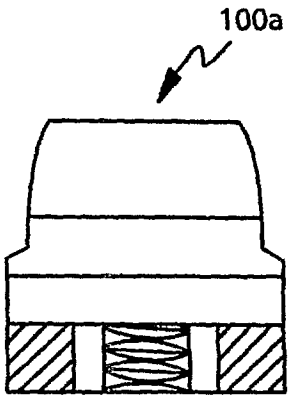
Figure 155:
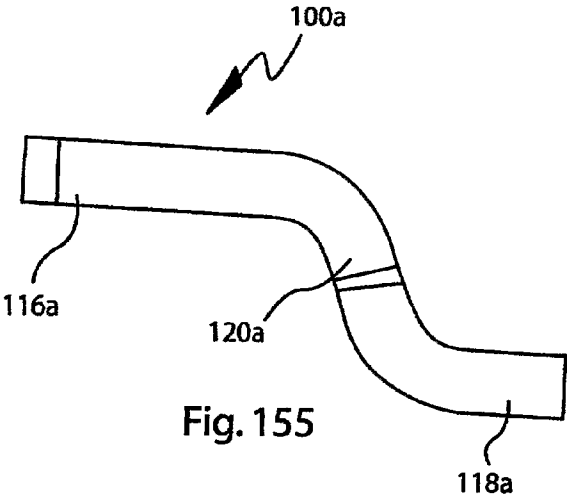
Figure 153:
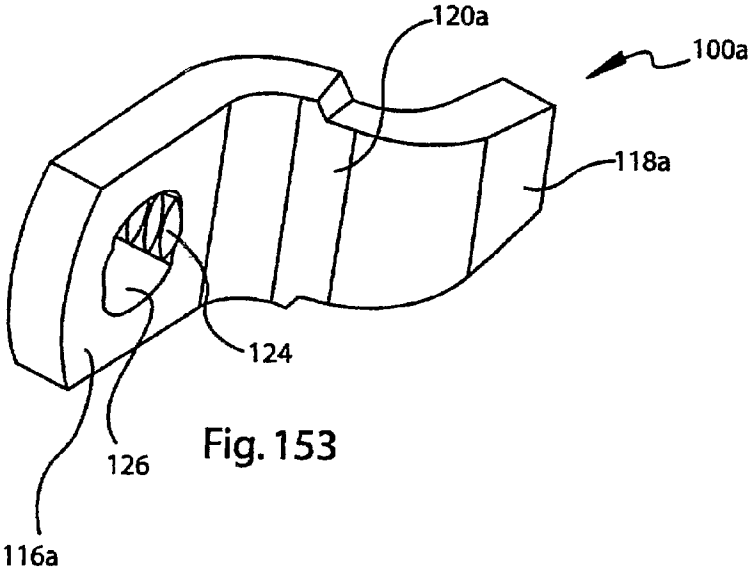
Figure 154:
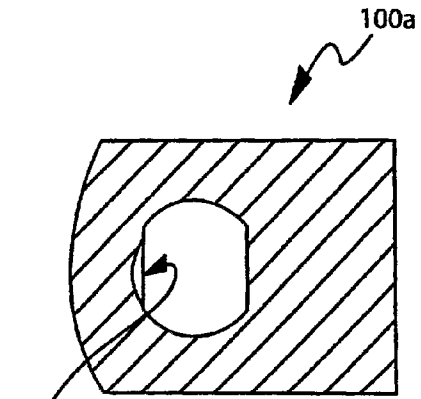
Figure 158:
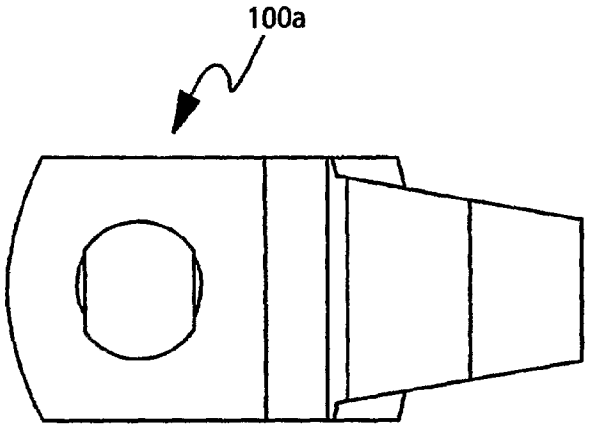
Figure 157:
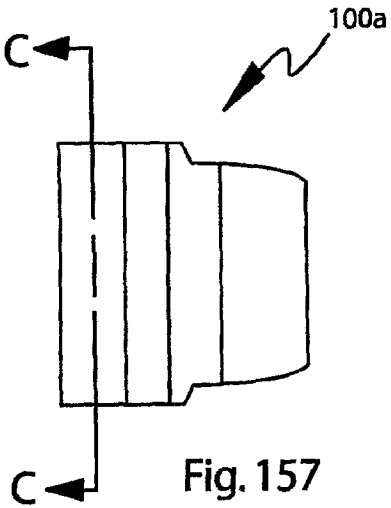
Figure 156:
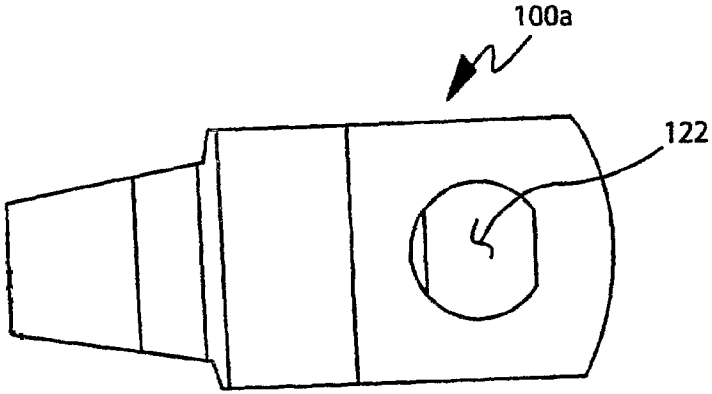
Figure 160:
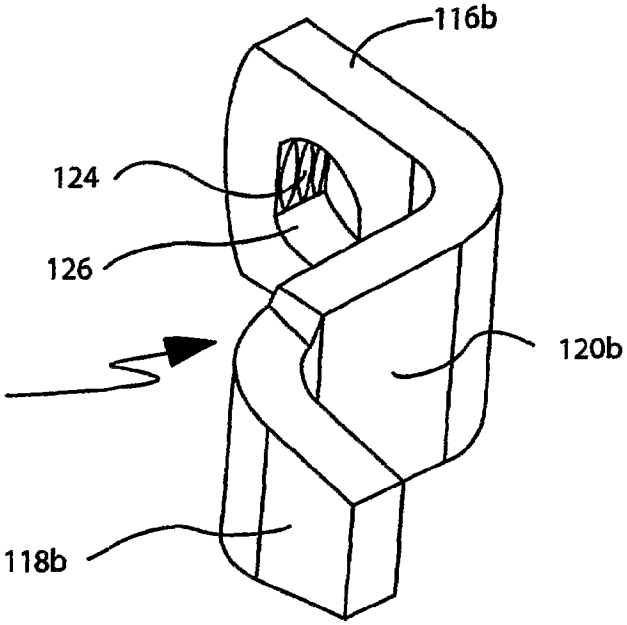
Figure 159:
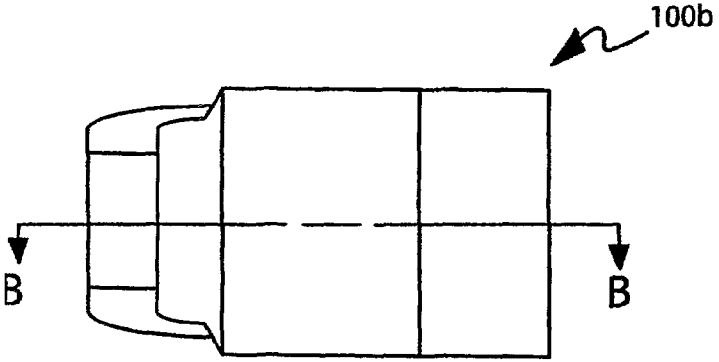
Figure 161:
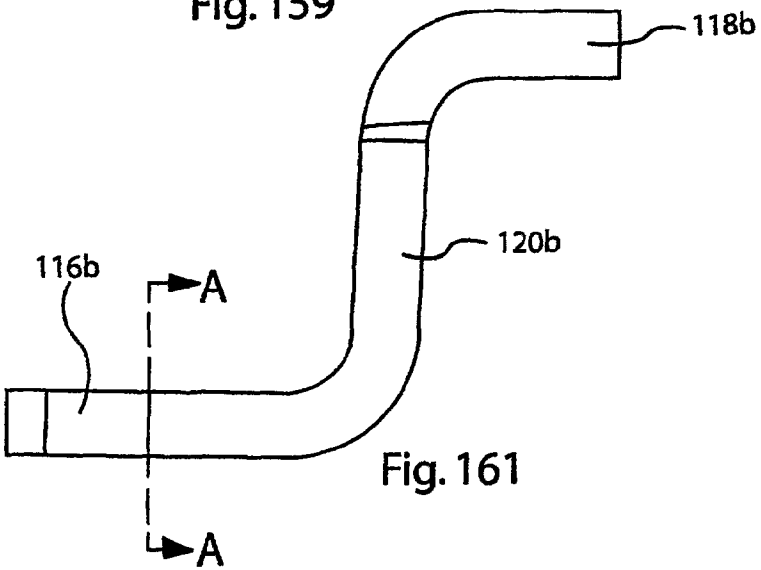
Figure 163:
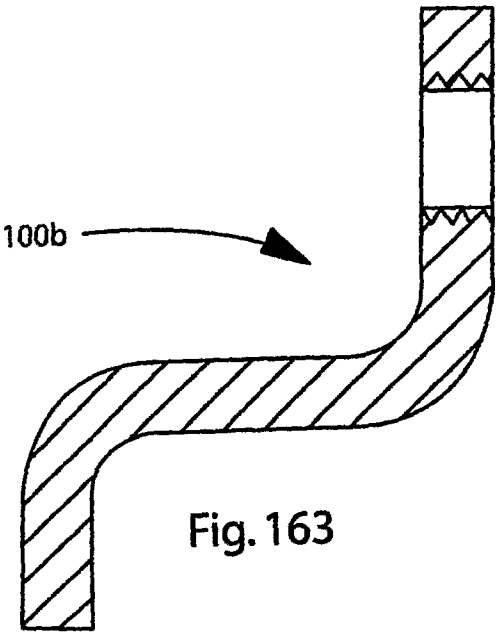
Figure 162:
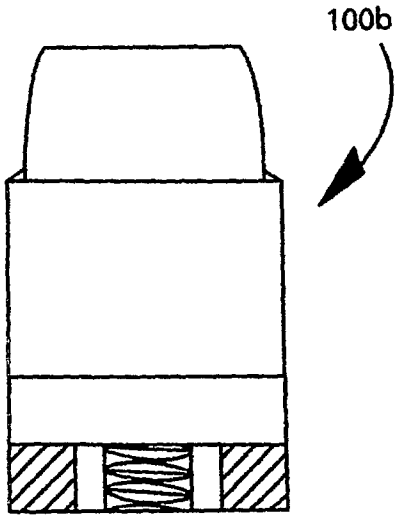
Figure 166:
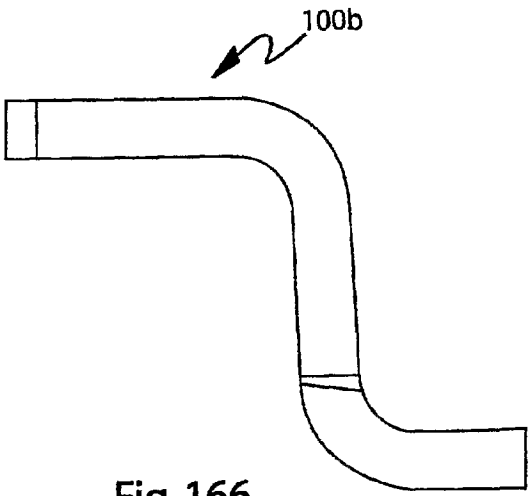
Figure 165:
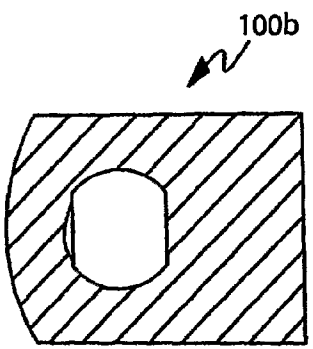
Figure 164:
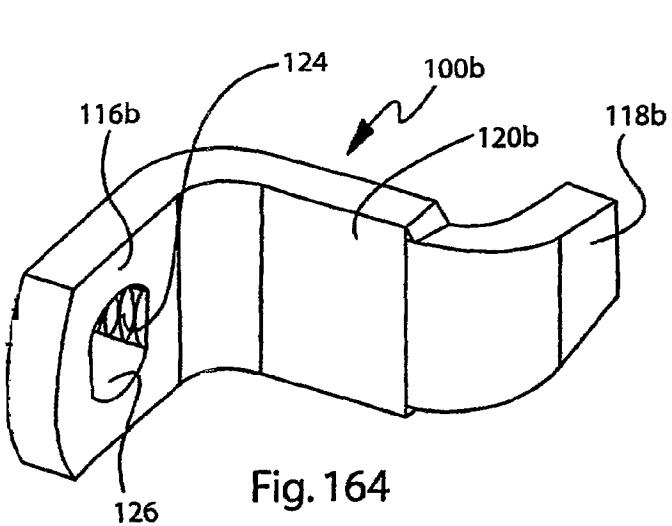
Figure 169:
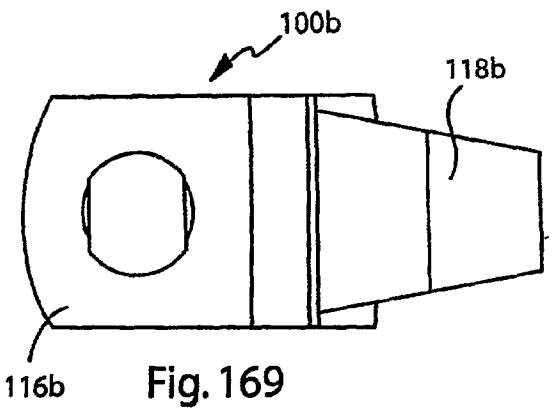
Figure 168:
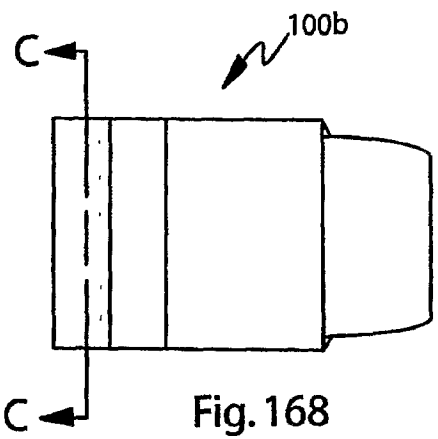
Figure 167:
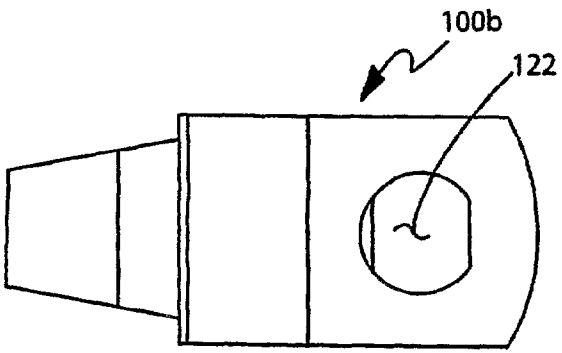
Figure 170:
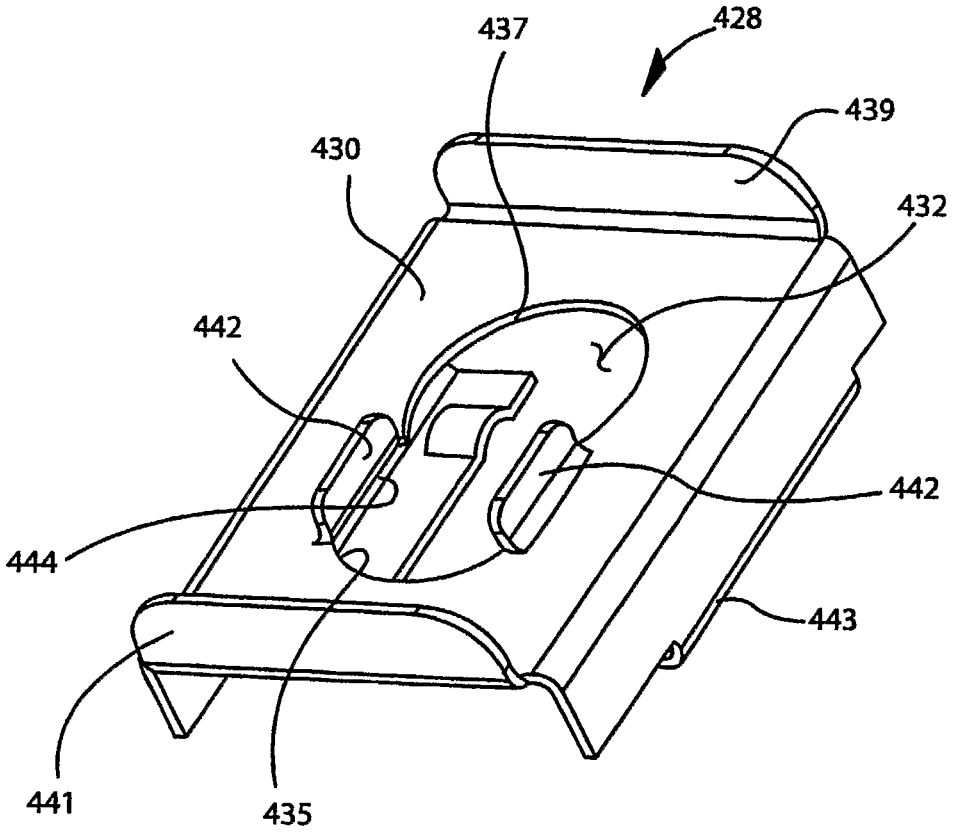
FIGS. 170-182B are views of a seventh embodiment of the present invention.
Figure 171:
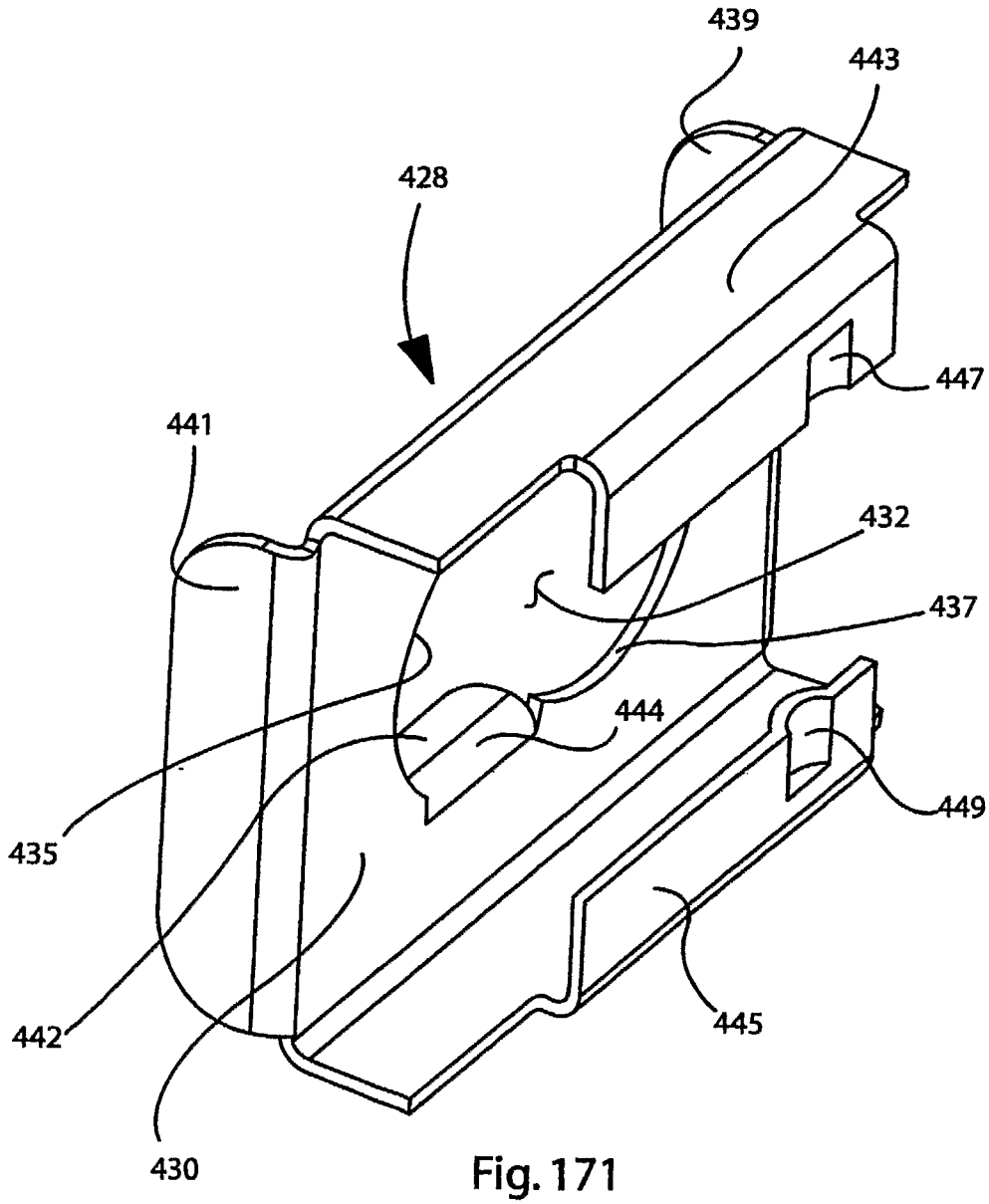
Figure 172:
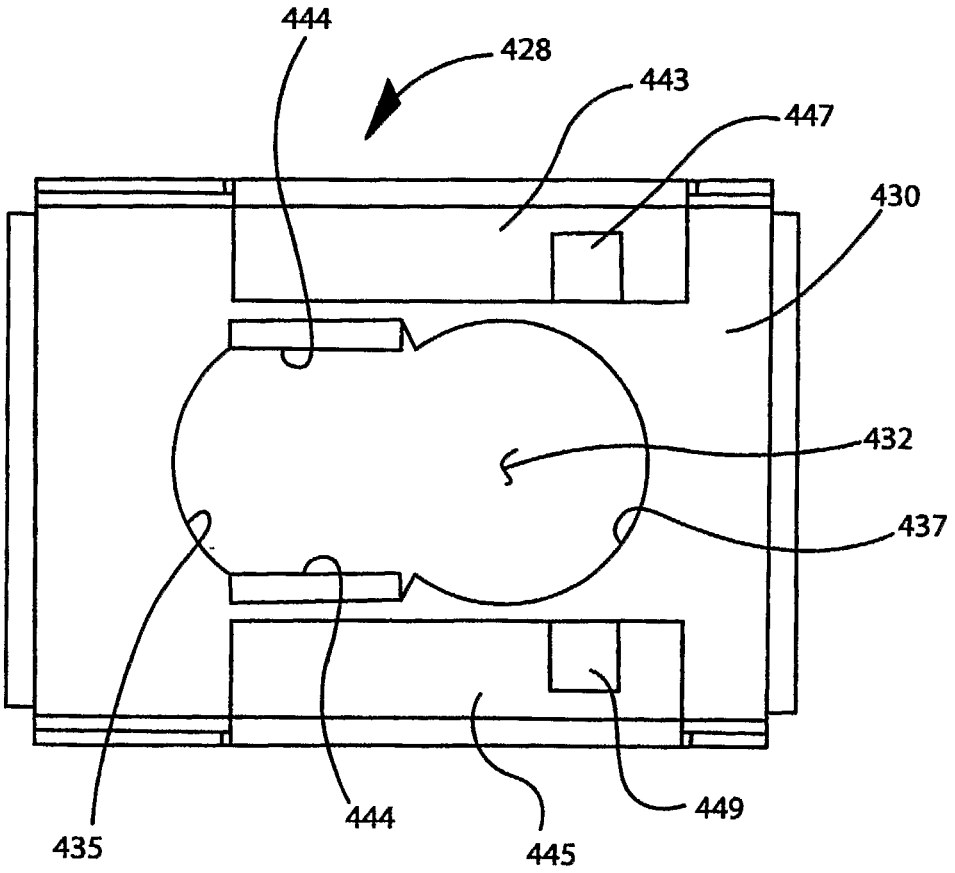
Figure 173:
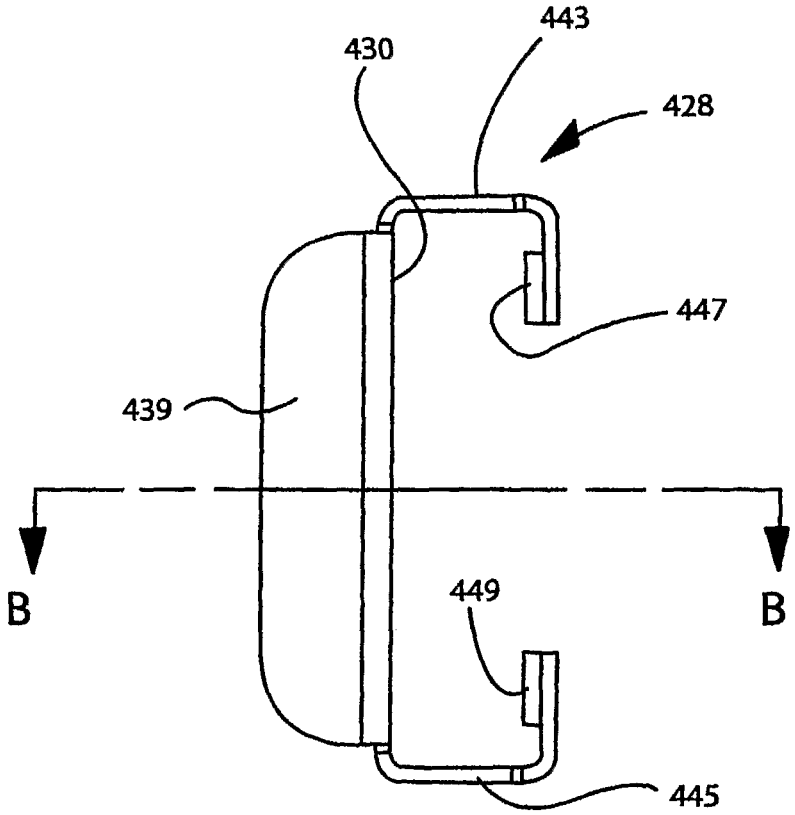
Figure 174:
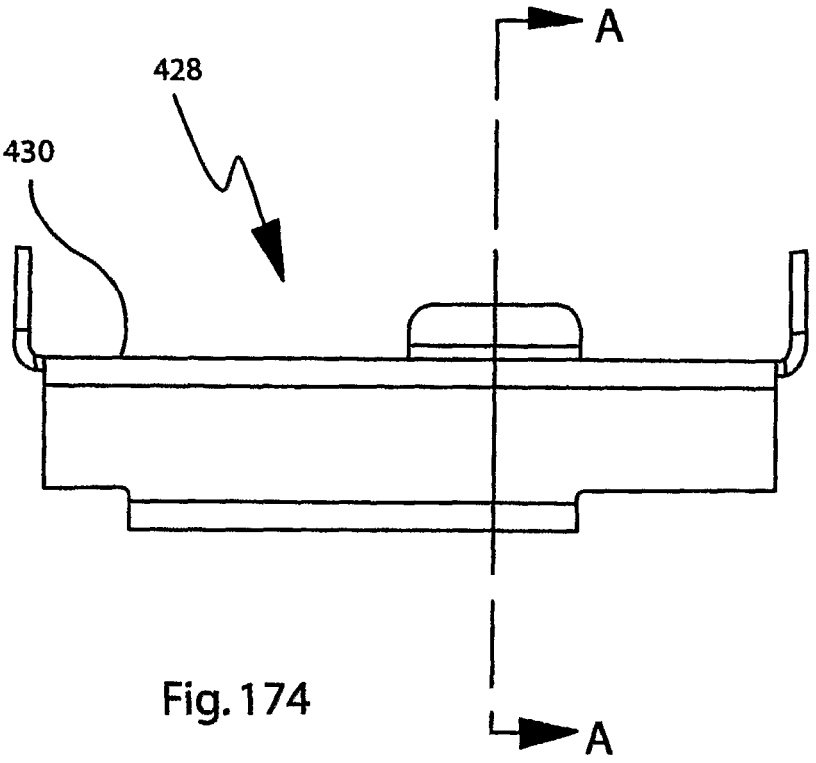

The reference numerals indicate the corresponding features consistently throughout the attached drawings.

DETAILED DESCRIPTION OF THE INVENTION

Referring to FIGS. 1-48, the first embodiment 100 of a pawl assembly designed for attachment to a latch mechanism 102 having an output shaft 104 for supporting a pawl can be seen. The latch mechanism 102 is of a type wherein the output shaft moves rotationally at least in part as the pawl is moved between latched and unlatched positions. Examples of such latch mechanisms can be seen in U.S. Pat. No. 3,402,958 issued to J. K. Barry on Sep. 24, 1968, U.S. Pat. No. 4,556,244 issued to Robert H. Bisbing on Dec. 3, 1985, U.S. Pat. No. 4,583,775 issued to Robert H. Bisbing on Apr. 22, 1986, and U.S. Pat. No. 4,763,935 issued to Robert H. Bisbing on Aug. 16, 1988, the entire disclosure of each of which is incorporated herein by reference. The latch mechanisms contemplated for use with the pawls of the present invention, including the examples described in the patents cited above and latch mechanism 102, generally operate by moving an output shaft, such as the shaft 104, between a latched position and an unlatched position. The movement imparted to the shaft 104 includes at least in part a rotational motion about the longitudinal axis of the shaft 104. For example, when the latch mechanism is installed to a door 106, the rotational component of the motion of the shaft 104 moves the pawl, such as pawl 100, that is carried by the shaft 104 between a position where a portion of the pawl overlaps the doorframe 108 surrounding the door in the closed position and a position where the pawl does not overlap the doorframe 108 such that the pawl can clear the doorframe and the door can be opened. The pawl 100 is contemplated for use with latch mechanisms that can impart a pure rotation to the shaft 104 about the longitudinal axis of the shaft 104 or a combination of rotation about the longitudinal axis of the shaft and rectilinear motion in the direction of the longitudinal axis of the shaft 104. The rotational and rectilinear motions may be sequential or concurrent or any combination of these.

The shaft 104 has a threaded portion 110 that has male or external threads 112 that are interrupted by two flat sides 114 running along the length of the threaded portion 110 of the shaft 104. Thus, when the shaft 104 is viewed with the threaded portion 110 pointed toward the observer and with the observer's line of sight coincident with the longitudinal axis of the shaft 104, the threaded portion 110 has an outline formed by a circle truncated by two parallel chords that are equidistant from the center of the circle. The outline of the threaded portion 110 of the shaft 104 as just described is sometimes referred to as a "double-D" configuration because it resembles two capital letter Ds placed back to back. In the prior art pawls intended for use with the shaft 104 had a hole that had the same outline in plan view as the threaded portion 110 of the shaft, i.e. the hole had the same outline formed by a circle truncated by two parallel chords as described for the threaded portion 110 of the shaft. The hole was smooth, i.e. had no female threads. When the threaded portion 110 of the shaft was placed through the hole in the pawl, the non-circular configuration of the hole and of the threaded portion 110 of the shaft prevented relative rotation between the pawl and the shaft 104, but the pawl could be moved along the threaded portion 110 of the shaft in order to position the pawl at any desired location along the threaded portion 110 of the shaft. The desired location for the pawl along the threaded portion 110 of the shaft would depend on the thickness of the door or doorframe to be accommodated. The pawl could be fixed to the shaft 104 at the desired location along the threaded portion 110 of the shaft by tightening in opposite directions a pair of nuts provided with associated lock washers on the threaded portion 110 of the shaft 104, with each nut and associated lock washer being provided on one side of the pawl. Accordingly, the prior art pawls required the use of common hand tools for installation and adjustment.

The pawl 100 of the present invention has a shaft-engaging portion 116, a latching portion 118 provided for engagement with, for example, a doorframe, and a connecting portion 120 extending between the shaft-engaging portion 116 and the latching portion 118. The shaft-engaging portion 116 has a hole 122 that allows the threaded portion 110 of the shaft 104 to pass through the shaft-engaging portion 116 of the pawl 100. The hole 122 has interrupted female threads 124 that are engageable with the interrupted male threads 112 of the threaded portion 110 of the shaft 104 when the pawl 100 is in a first angular position about the shaft 104 as illustrated in FIGS. 1-4. The ridge or point diameter of the female threads 124 corresponds to the root diameter of the male threads 112 of the shaft 104. The female or internal threads 124 are interrupted by smooth arcuate surfaces 126 that have a radius of curvature approximately the same as one half the ridge or point diameter of the male threads 112. The radius of curvature of the smooth surfaces 126 should at least be slightly larger than one half of the ridge or point diameter of the male threads 112 so that the pawl 100 can be moved along the threaded portion 110 of the shaft in order to position the pawl 100 at any desired location along the threaded portion 110 of the shaft 104 when the threaded portion 110 of the shaft is placed through the hole 122 in the pawl 100 and the pawl 100 is in a second angular position about the shaft 104 where the smooth surfaces 126 register with the external threads 112 and the internal threads 124 do not engage the interrupted external threads 112.

The pawl assembly of the present invention also includes a clip 128 that is used to fix the pawl 100 to the shaft 104 at the desired location along the threaded portion 110 of the shaft, such that the pawl 100 and the shaft 104 move as one unit when the shaft 104 is driven or caused to move by the latch mechanism 102. This design enables the pawl 100 to be slipped onto the shaft 104 and securely fastened to the shaft without the aid of hand tools. The clip 128 has a center plate portion 130 that has a central hole 132 that has the same outline in plan view as the threaded portion 110 of the shaft 104, i.e. the hole 132 has the same outline formed by a circle truncated by two parallel chords as described for the threaded portion 110 of the shaft 104. The hole 132 is sized to allow the threaded portion 110 of the shaft to be placed through the hole 132 in the clip 128, while the non-circular configuration of the hole 132 and the matching non-circular configuration of the threaded portion 110 of the shaft 104 prevent relative rotation between the clip 128 and the shaft 104, but the clip 128 can be moved along the threaded portion 110 of the shaft in order to position the clip 128 at any desired location along the threaded portion 110 of the shaft 104. The clip 128 also has spring clip arms 134 that extend from opposite sides of the plate portion 130 of the clip 128 in a direction approximately perpendicular to the plate portion 130. The spring clip arms 134 wrap around the lateral edges 136 of the shaft-engaging portion 116 of the pawl 100 on the side of the shaft-engaging portion 116 opposite the side of the shaft-engaging portion 116 that is in contact with the plate portion 130, in order to securely hold the clip 128 in position on the pawl 100.

The spring clip arms 134 are resilient such that they can be spread apart to allow the spring clip arms 134 to be placed around the shaft-engaging portion 116 in order to fasten the clip 128 to the pawl 100, while the threaded portion 110 of the shaft 104 extends through both the hole 132 in the clip 128 and the hole 122 in the pawl 100. During installation of the clip 128 to the pawl 100 the spring clip arms 134 snap into place around the shaft-engaging portion 116 after they are initially spread apart to get around the shaft-engaging portion 116 in order to fasten the clip 128 to the pawl 100.

Each of the spring clip arms 134 is provided with a ramp 138 that is attached to the end of the respective spring clip arm 134 that is distal from the plate portion 130 of the clip 128. The ramps 138 form diverging sloping surfaces that spread wider than the width w of the shaft-engaging portion 116 such that the ramps 138 engage the edges 140 as the clip 128 is first brought into contact with the shaft-engaging portion 116 of the pawl 100 and automatically spread apart the spring clip arms 134 so that the spring clip arms 134 can automatically snap into place around the shaft-engaging portion 116 of the pawl as the plate portion 130 of the clip 128 is forced home into position where it lies flat against the shaft-engaging portion 116 in order to fasten the clip 128 to the pawl 100.

The clip 128 also has two cantilever tabs 142 that project approximately perpendicularly from the plate portion 130 on either side of the hole 132. Each of the tabs 142 is attached to the plate portion 130 of the clip 128 along a respective one of the parallel chords that form the flat sides 144 of the hole 132. Once the clip 128 is fastened to the pawl 100 with the internal threads 124 of the hole 122 engaged to the interrupted external threads 112 of the shaft 104, the cantilever tabs 142 extend into and substantially occupy the space between the flat sides 114 of the threaded portion of the shaft and the arcuate surfaces 126 of the hole 122 in the pawl 100 such that the pawl 100 cannot be rotated relative to the shaft 104 about the longitudinal axis of the shaft 104. Rotation of the pawl 100 relative to the shaft 104 can under most circumstances be prevented by the flat sides 144 of the hole 132 in the clip 128 that interfere with the interrupted external threads 112 of the shaft 104 if an attempt is made to rotate of the pawl 100 relative to the shaft 104. However, providing for the cantilever tabs 142 to extend into and substantially occupy the space between the flat sides 114 of the threaded portion of the shaft and the arcuate surfaces 126 of the hole 122 in the pawl also prevents the rotation of the pawl 100 relative to the shaft 104, because the tabs 142 occupy the space that the external threads 112 of the shaft would have to move into if the pawl 100 were to be rotationally moved relative to the shaft 104 and therefore the tabs 142 physically block the rotational movement of the pawl 100 relative to the shaft 104. Accordingly, providing the clip 128 with the tabs 142 results in a much stronger resistance to the rotational movement of the pawl 100 relative to the shaft 104, once the clip 128 is fastened to the shaft-engaging portion 116 of the pawl 100. Furthermore, because the internal threads 124 of the hole 122 are engaged to the interrupted external threads 112 of the shaft 104, rectilinear motion of the pawl 100 in the direction of the longitudinal axis of the shaft 104 and along the threaded portion 110 of the shaft is also prevented, and thus the pawl 100 is securely fastened to the shaft 104 such that the pawl 100 and the shaft 104 move together as one unit.

The pawl 100 is installed to the shaft 104 by first aligning the hole 122 in the pawl 100 with the shaft 104 such that the smooth arcuate surfaces 126 of the hole 122 are aligned with the external threads 112 of the shaft 104, and then sliding the pawl 100 onto the threaded portion 110 of the shaft 104. The pawl 100 is then moved to the desired location along the threaded portion 110 of the shaft 104 by rectilinear motion of the pawl 100 in the direction of the longitudinal axis of the shaft 104. Once at the desired axial location along the threaded portion 110 of the shaft 104, the pawl 100 is rotated approximately 90° relative to the shaft 104 to bring the external threads 112 on shaft 104 into engagement with the internal threads 124 of the pawl 100. With the internal threads 124 of the hole 122 engaged to the interrupted external threads 112 of the shaft 104, rectilinear motion of the pawl 100 in the direction of the longitudinal axis of the shaft 104 and along the threaded portion 110 of the shaft is no longer possible and the pawl 100 will be maintained at the chosen location even under axial load.

Next, the hole 132 of the clip 128 is aligned with the threaded portion 110 of the shaft 104 such that the flat sides 144 of the hole 132 are aligned with the flat sides 114 of the threaded portion 110 of the shaft 104. Then, the clip 128 is placed onto the threaded portion 110 of the shaft 104 such that the threaded portion 110 of the shaft 104 extends through the hole 132 of the clip 128. Sliding the clip 128 axially along the threaded portion 110 of the shaft 104 brings the ramps 138 into contact with the pawl 100. Forcing home the plate portion 130 of the clip 128 into position where it lies flat against the shaft-engaging portion 116 of the pawl 100 automatically spreads apart the spring clip arms 134 until the spring clip arms 134 automatically snap into place around the shaft-engaging portion 116 of the pawl 100. Simultaneously, the cantilever tabs 142 fill at least a substantial portion of the space between the flat sides 114 of the threaded portion of the shaft and the arcuate surfaces 126 of the hole 122 in the pawl 100. By a substantial portion it is meant that the tabs 142 fill enough of the space between the flat sides 114 of the threaded portion of the shaft and the arcuate surfaces 126 of the hole 122 in the pawl such that the pawl 100 cannot be moved rotationally relative to the shaft 104 an amount sufficient to disengage the internal threads 124 of the hole 122 from the interrupted external threads 112 of the shaft 104 without crushing some of the material of the tabs 142. The clip 128 is now fastened to the pawl 100, and the pawl 100 and the shaft 104 are fastened together such that the pawl and the shaft move together as one unit. To remove the pawl 100 from the shaft 104, the sequence of steps for installing the pawl 100 to the shaft 104 is reversed.

The tips 146 of the ramps 138 are curled or rolled back to afford a rounded and more comfortable surface for a user to press against with his or her fingers when spreading the spring clip arms 134 apart in order to remove the clip 128 from the pawl 100 to permit removing or adjusting the position of the pawl 100. The spring clip arms 134 also have rectangular windows 148 cut in them to give them greater flexibility and thus decrease the force required to fasten the clip 128 to the pawl 100 or to remove the clip 128 from the pawl 100. The plate portion 130 has embossed ribs 150 that increase the stiffness and resistance to warping of the plate portion 130 without presenting any sharp edges that could be injurious to the user. The ramps 138 are tapered toward the tips 146. Curved walls 152 project approximately perpendicularly from the plate portion 130 and wrap around the external threads 112 of the shaft 104 when the clip 128 is position on the shaft 104 with the threaded portion 110 of the shaft extending through the hole 132. The height of the walls 152 is greater than the distance between adjacent peaks of the external thread 112 of the shaft 104. The walls 152 prevent the edges of the hole 132 from catching on the threads 112 as the clip 128 is axially moved along the length of the threaded portion 110 of the shaft 104.

Referring to FIGS. 49-59, an alternative clip **128*a* for use with the pawl 100 can be seen. The clip 128*a* is an earlier step in the evolutionary development of the clip 128 and lacks certain refinements such as the clip arm tips 146, the walls 152, and the rectangular windows 148. The clip 128*a* has a pair of lateral walls 150*a* projecting approximately perpendicularly from the plate portion 130*a* on either side of the plate portion 130*a*, in place of the embossed ribs 150, that increase the stiffness and resistance to warping of the plate portion 130*a*. However, the walls 150*a* have sharp edges that could be injurious to the user. Otherwise the clip 128*a* is fully functional and functions in exactly the same way as the clip 128**.

Referring to FIGS. 60-70, an alternative clip **128*b* for use with the pawl 100 can be seen. The clip 128*b* is an earlier step in the evolutionary development of the clip 128 and lacks certain refinements such as the clip arm tips 146, the walls 152, and the rectangular windows 148. The clip 128*b* has the embossed ribs 150 that increase the stiffness and resistance to warping of the plate portion 130. Otherwise, the clip 128*b* is fully functional and functions in exactly the same way as the clip 128**.

Referring to FIGS. 71-103, an alternative clip **128*c* for use with the pawl 100 can be seen. The clip 128*c* is a further development of the clip 128 and is identical to the clip 128 except for the differences noted below. In place of the ramp tips 146 the clip 128*c* has a pair of lever arms 146*c*. Each of the lever arms 146*c* extends in cantilever fashion from the tip of a respective one of the ramps 138*c*. The ramps 138*c* of the clip 128*c* are of uniform width. The ends of the lever arms 146*c* that are distal from the ramps 138*c* can be pinched together by a user to spread the spring clip arms 134 apart. Each lever arm 146*c* has a pair of embossed ribs 154 that contact the bend 156 where the spring clip arms 134 join the plate portion 130 of the clip 128*c* as the lever arms 146*c* are pinched together. The bend 156 forms the fulcrum point for the lever arms 146*c* as the distal ends of the lever arms are pinched together. Pinching or squeezing the distal ends of the lever arms 146*c* together opens the return bends 158 wider than the width of the pawl 100. This feature makes it easier to fasten the clip 128*c* to the pawl 100 or to remove the clip 128*c* from the pawl 100. Otherwise, the clip 128*c* is identical to the clip 128**.

Referring to FIGS. 104-125, yet another embodiment of the pawl assembly of the present invention may be seen. The embodiment of FIGS. 104-125, includes the pawl 100 and a clip 228.

The clip 228 is used to fix the pawl 100 to the shaft 104 at the desired location along the threaded portion 110 of the shaft, such that the pawl 100 and the shaft 104 move as one unit when the shaft 104 is driven or caused to move by the latch mechanism 102. This design enables the pawl 100 to be slipped onto the shaft 104 and securely fastened to the shaft without the aid of hand tools. The clip 228 has an upper plate 230, lower plate 231, and a connecting plate 233 that are connected together in a U-shaped profile. The upper and lower plates are parallel. The clip 228 is resilient such that if the upper plate 230 and the lower plate 231 are spread apart they tend to go back to their original relative positions. The upper plate 230 has a slot 232 that has two flat sides 244 and an arcuate side 252 joining the two flat sides at the closed end of the slot 232. The slot 232 is sized to allow the threaded portion 110 of the shaft to be placed between the parallel flat sides 244 of the slot 232 with the flat sides 114 of the threaded portion 110 of the shaft 104 being parallel to the flat sides of the slot 232.

The clip 228 also has two cantilever tabs 242 that project approximately perpendicularly from the upper plate 230 on either side of the slot 232. Each of the tabs 242 is attached to the upper plate 230 of the clip 228 along a respective one of the flat sides 244 of the hole 232. The pawl 100 is positioned on the shaft in a same manner as previously described. The pawl 100 is first positioned at the desired location along the threaded portion 110 of the shaft 104. The pawl 100 is then rotated approximately 90° relative to the shaft 104 to bring the internal threads 124 of the hole 122 into engagement with the interrupted external threads 112 of the shaft 104. With the pawl 100 in this position, the clip 228 is placed around the shaft-engaging portion 116 of the pawl 100 with the flat, straight sides 244 of the slot 232 aligned with the flat sides 114 of the threaded portion of the shaft 104 and with the open end of the slot 232 facing the shaft 104. To accomplish the placement of the clip 228 around the shaft-engaging portion 116 of the pawl 100, the upper plate 230 and the lower plate 231 have to be spread apart such that the lower plate 231 is in contact with one side of the shaft-engaging portion 116 of the pawl 100 and the cantilever tabs 242 are touching the other side of the shaft-engaging portion 116 of the pawl 100. As the clip 228 is moved to its final position, the threaded portion 110 of the shaft 104 comes to be positioned through the slot 232 by being received into the slot 232 via the open end of the slot 232. Simultaneously, the cantilever tabs 242 move into registry with the void between the flat sides 114 of the threaded portion of the shaft and the arcuate surfaces 126 of the hole 122 in the pawl. Then the cantilever tabs 242 snap into the void between the flat sides 114 of the threaded portion of the shaft and the arcuate surfaces 126 of the hole 122 in the pawl under the bias provided by the clip 228 itself. Once the cantilever tabs 242 extend into and substantially occupy the space between the flat sides 114 of the threaded portion of the shaft and the arcuate surfaces 126 of the hole 122 in the pawl 100, the pawl 100 can no longer be rotated relative to the shaft 104 about the longitudinal axis of the shaft 104 because the tabs 242 occupy the space that the external threads 112 of the shaft would have to move into if the pawl 100 were to be rotationally moved relative to the shaft 104. Therefore, the tabs 242 physically block the rotational movement of the pawl 100 relative to the shaft 104. Furthermore, because the internal threads 124 of the hole 122 are engaged to the interrupted external threads 112 of the shaft 104, rectilinear motion of the pawl 100 in the direction of the longitudinal axis of the shaft 104 and along the threaded portion 110 of the shaft is also prevented, and thus the pawl 100 is securely fastened to the shaft 104 such that the pawl 100 and the shaft 104 move together as one unit.

To remove the pawl 100 from the shaft 104, the sequence of steps for installing the pawl 100 to the shaft 104 is reversed.

Referring to FIGS. 126-147, yet another embodiment of the pawl assembly of the present invention may be seen. The embodiment of FIGS. 126-147, includes the pawl 100 and a clip 328.

The clip 328 is used to fix the pawl 100 to the shaft 104 at the desired location along the threaded portion 110 of the shaft, such that the pawl 100 and the shaft 104 move as one unit when the shaft 104 is driven or caused to move by the latch mechanism 102. This design enables the pawl 100 to be slipped onto the shaft 104 and securely fastened to the shaft without the aid of hand tools. The clip 328 has an upper plate 330, lower plate 331, and connecting strips 333 that are connected together in a U-shaped profile. The upper and lower plates are parallel. The clip 328 is resilient such that if the upper plate 330 and the lower plate 331 are spread apart they tend to go back to their original relative positions. The upper plate 330 and the lower plate 331 each have a key-hole shaped closed slot 332 that has a narrower portion 335 and a wide portion 337. The slot 332 also has two flat sides 344 on either side of the narrow slot portion 335. The narrow portion 335 of the slot 332 is sized to allow the threaded portion 110 of the shaft to be placed between the parallel flat sides 344 of the slot portion 335 with the flat sides 114 of the threaded portion 110 of the shaft 104 being parallel to the flat sides 344 of the narrow slot portion 335. The threaded portion 110 of the shaft 104 can only fit through the narrow slot portion 335 when the flat sides 114 of the threaded portion 110 of the shaft 104 are parallel to the flat sides 344 of the narrow slot portion 335. The threaded portion 110 of the shaft 104 can fit through the wider slot portion 337 in any angular orientation about its longitudinal axis, even when the upper plate 330 and the lower plate 331 are canted at an angle relative to the longitudinal axis of the shaft 104. The key-hole shaped slots 332 in the upper and lower plates are in superimposed relationship.

The clip 328 also has two cantilever tabs 342 that project approximately perpendicularly from the upper plate 330 on either side of the narrow slot portion 335. Similarly, two cantilever tabs 342 project approximately perpendicularly from the lower plate 331 on either side of the narrow slot portion 335 of the lower plate. Each of the tabs 342 is attached to the upper plate 330 or to the lower plate 331 of the clip 328 along a respective one of the flat sides 344 of the narrow slot portions 335. Off-set tabs 339 and 341 are provided on the edges of the upper and lower plates 330, 331, respectively, to facilitate spreading the upper and lower plates apart. The upper and lower plates 330, 331 are spread apart and the tabs 342 of the upper plate are placed in contact with one side of the shaft-engaging portion 116 of the pawl 100, and the tabs 342 of the lower plate are placed in contact with the other side of the shaft-engaging portion 116 of the pawl 100. The wider slot portions 337 of the upper and lower plates are placed in registry with the hole 122 of the pawl. The connecting portion 120 of the pawl 100 passes between the connecting strips 333. The pawl 100 is positioned on the shaft in a same manner as previously described. The pawl 100 is first positioned at the desired location along the threaded portion 110 of the shaft 104, with the threaded portion 110 of the shaft also passing through the wider slot portions 337. The pawl 100 is then rotated approximately 90° relative to the shaft 104, along with the clip 328, to bring the internal threads 124 of the hole 122 into engagement with the interrupted external threads 112 of the shaft 104. With the pawl 100 in this position, the clip 328 is moved to its final position where the threaded portion 110 of the shaft 104 comes to be positioned through the narrow slot portions 335 and where the cantilever tabs 342 snap into the void between the flat sides 114 of the threaded portion of the shaft and the arcuate surfaces 126 of the hole 122 in the pawl under the bias provided by the clip 328 itself. Once the cantilever tabs 342 extend into and substantially occupy the space between the flat sides 114 of the threaded portion of the shaft and the arcuate surfaces 126 of the hole 122 in the pawl 100, the pawl 100 can no longer be rotated relative to the shaft 104 about the longitudinal axis of the shaft 104 because the tabs 342 occupy the space that the external threads 112 of the shaft would have to move into if the pawl 100 were to be rotationally moved relative to the shaft 104. Therefore, the tabs 342 physically block the rotational movement of the pawl 100 relative to the shaft 104. Furthermore, because the internal threads 124 of the hole 122 are engaged to the interrupted external threads 112 of the shaft 104, rectilinear motion of the pawl 100 in the direction of the longitudinal axis of the shaft 104 and along the threaded portion 110 of the shaft is also prevented, and thus the pawl 100 is securely fastened to the shaft 104 such that the pawl 100 and the shaft 104 move together as one unit.

To remove the pawl 100 from the shaft 104, the sequence of steps for installing the pawl 100 to the shaft 104 is reversed.

Referring to FIGS. 148-158, the pawl 100*a* of the present invention has a shaft-engaging portion 116*a* that is off set relative to the latching portion 118*a* in order to accommodate a different range of door and doorframe thickness as compared to the pawl 100. The pawl 100*a* also has a connecting portion 120*a* that extends between the shaft-engaging portion 116*a* and the latching portion 118*a*. Otherwise the pawls 100 and 100*a* are identical.

Referring to FIGS. 159-169, the pawl 100*b* of the present invention has a shaft-engaging portion 116*b* that is off set relative to the latching portion 118*b* to a greater extent as compared to pawl 100*a* in order to accommodate yet another range of door and doorframe thickness as compared to the pawls 100 and 100*a*. The pawl 100*b* also has a connecting portion 120*b* that extends between the shaft-engaging portion 116*b* and the latching portion 118*b*. Otherwise the pawls 100, 100*a*, and 100*b* are identical. The pawls 100, 100*a*, and 100*b* can be used with any of the embodiments described above.

Referring to FIGS. 170-182B, the first embodiment of a pawl assembly designed for attachment to a latch mechanism having an output shaft 104 for supporting a pawl can be seen. The latch mechanism is of a type wherein the output shaft moves rotationally at least in part as the pawl is moved between latched and unlatched positions. Examples of such latch mechanisms can be seen in U.S. Pat. No. 3,402,958 issued to J. K. Barry on Sep. 24, 1968, U.S. Pat. No. 4,556,244 issued to Robert H. Bisbing on Dec. 3, 1985, U.S. Pat. No. 4,583,775 issued to Robert H. Bisbing on Apr. 22, 1986, and U.S. Pat. No. 4,763,935 issued to Robert H. Bisbing on Aug. 16, 1988, the entire disclosure of each of which is incorporated herein by reference. The latch mechanisms contemplated for use with the pawls of the present invention, including the examples described in the patents cited above, are latch mechanisms that generally operate by moving an output shaft, such as the shaft 104, between a latched position and an unlatched position. The movement imparted to the shaft 104 includes at least in part a rotational motion about the longitudinal axis of the shaft 104. For example, when the latch mechanism is installed to a door, the rotational component of the motion of the shaft 104 moves the pawl that is carried by the shaft 104 between a position where a portion of the pawl overlaps the doorframe surrounding the door in the closed position and a position where the pawl does not overlap the doorframe such that the pawl can clear the doorframe and the door can be opened. The pawl assembly of FIGS. 170-182B includes a pawl 400 and the clip 428. The pawl 400 is contemplated for use with latch mechanisms that can impart a pure rotation to the shaft 104 about the longitudinal axis of the shaft 104 or a combination of rotation about the longitudinal axis of the shaft and rectilinear motion in the direction of the longitudinal axis of the shaft 104. The rotational and rectilinear motions may be sequential or concurrent or any combination of these.

The shaft 104 has a threaded portion 110 that has male or external threads 112 that are interrupted by two flat sides 114 running along the length of the threaded portion 110 of the shaft 104. Thus, when the shaft 104 is viewed with the threaded portion 110 pointed toward the observer and with the observer's line of sight coincident with the longitudinal axis of the shaft 104, the threaded portion 110 has an outline formed by a circle truncated by two parallel chords that are equidistant from the center of the circle. The outline of the threaded portion 110 of the shaft 104 as just described is sometimes referred to as a "double-D" configuration because it resembles two capital letter Ds placed back to back. In the prior art pawls intended for use with the shaft 104 had a hole that had the same outline in plan view as the threaded portion 110 of the shaft, i.e. the hole had the same outline formed by a circle truncated by two parallel chords as described for the threaded portion 110 of the shaft. The hole was smooth, i.e. had no female threads. When the threaded portion 110 of the shaft was placed through the hole in the pawl, the non-circular configuration of the hole and of the threaded portion 110 of the shaft prevented relative rotation between the pawl and the shaft 104, but the pawl could be moved along the threaded portion 110 of the shaft in order to position the pawl at any desired location along the threaded portion 110 of the shaft. The desired location for the pawl along the threaded portion 110 of the shaft would depend on the thickness of the door or doorframe to be accommodated. The pawl could be fixed to the shaft 104 at the desired location along the threaded portion 110 of the shaft by tightening in opposite directions a pair of nuts provided with associated lock washers on the threaded portion 110 of the shaft 104, with a first nut and associated lock washer being provided on one side of the pawl and the second nut and associated lock washer being provided on the other side of the pawl. Accordingly, the prior art pawls required the use of common hand tools for installation and adjustment.

Figure 175:
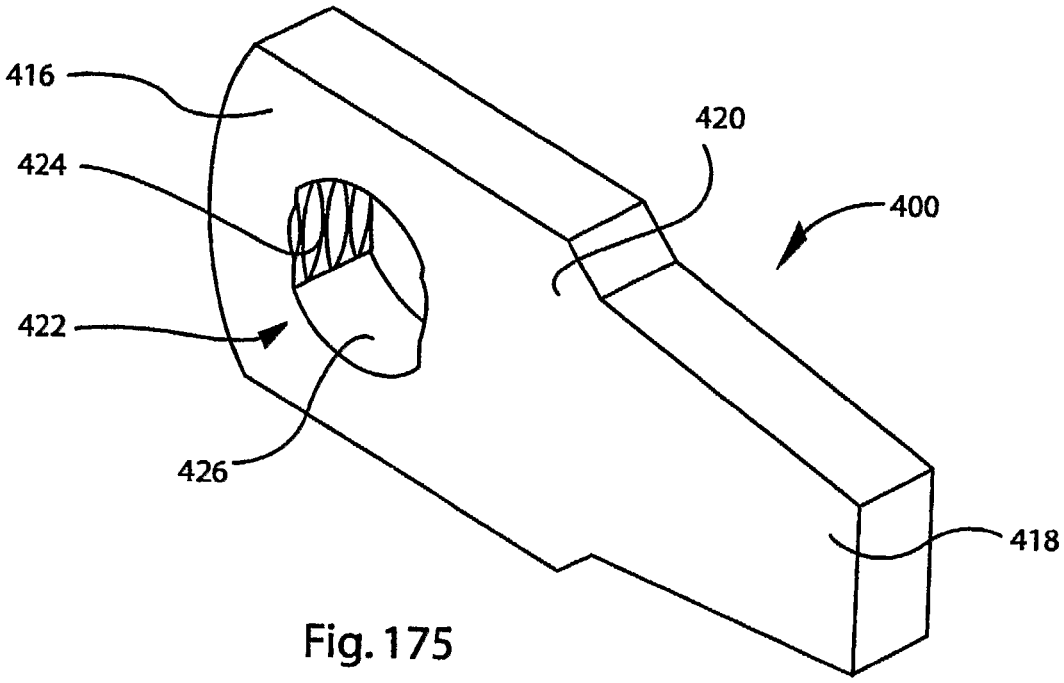
Figure 176:
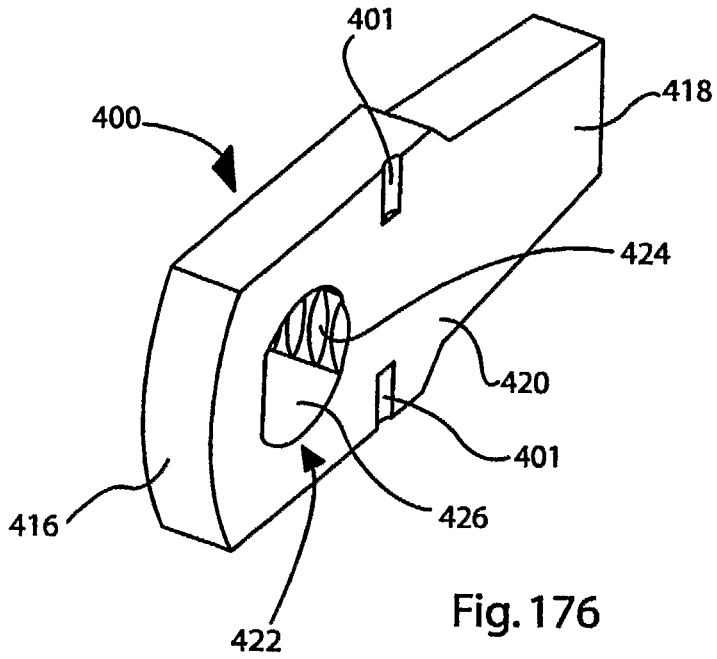
Figure 177:
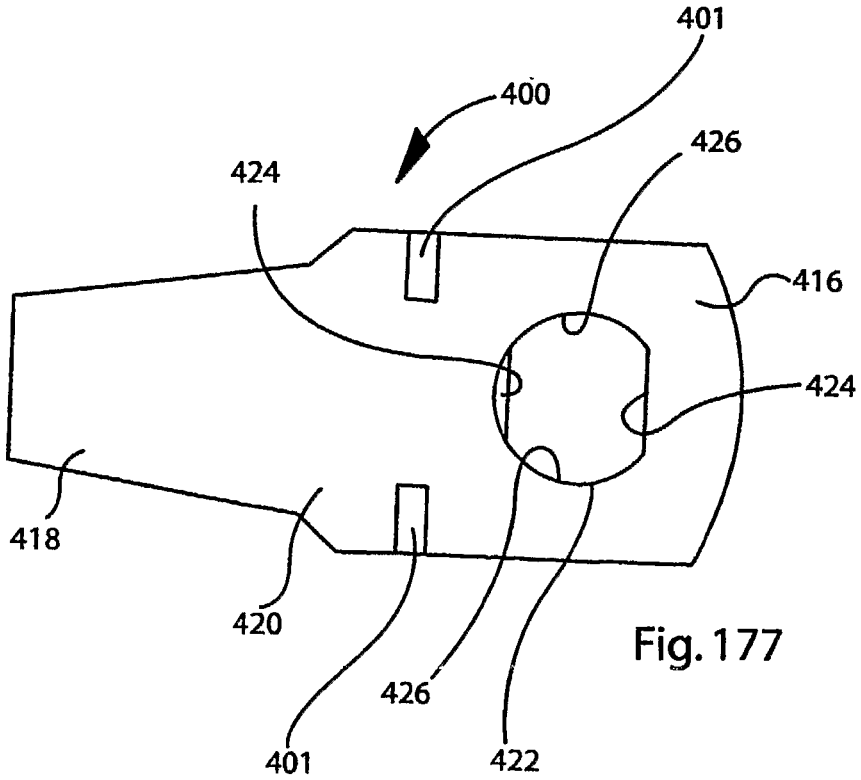
Figure 178:
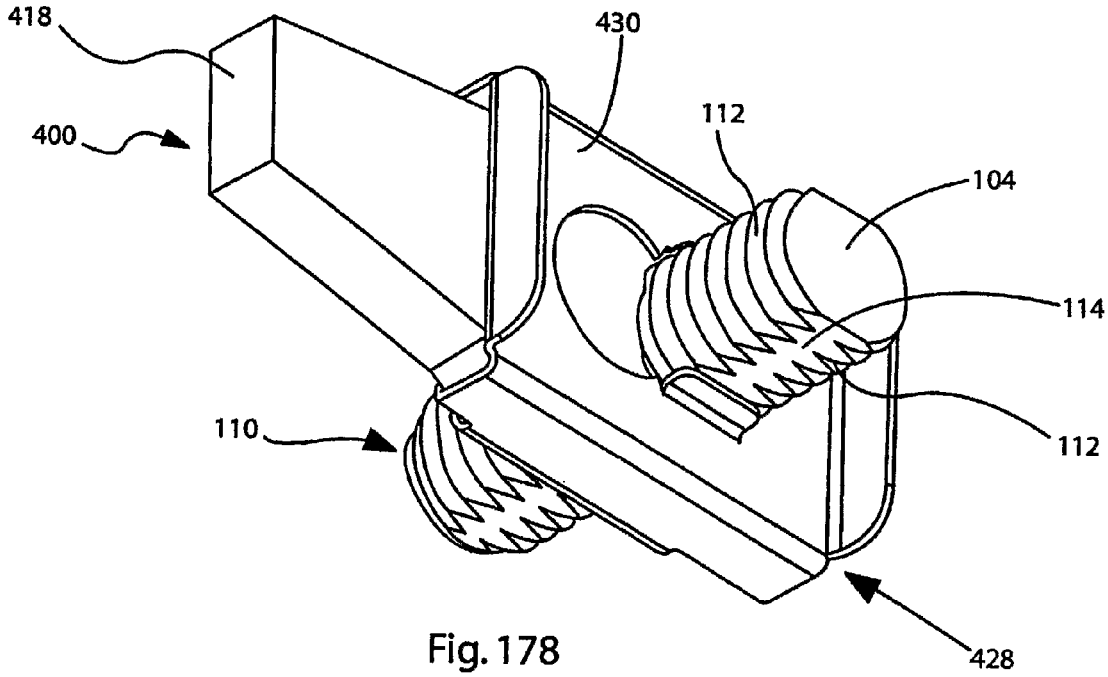
Figure 182A:
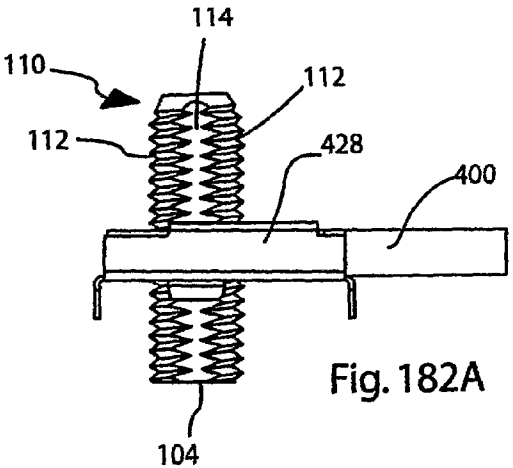
Figure 182B:
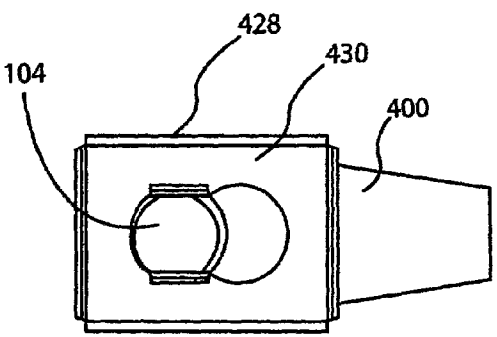
Figure 181A:
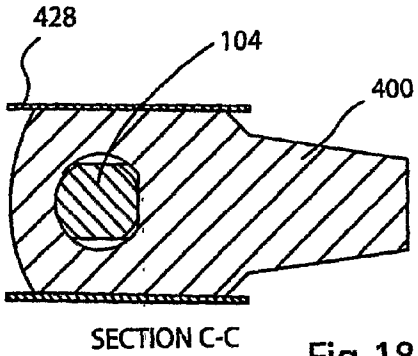
Figure 181B:
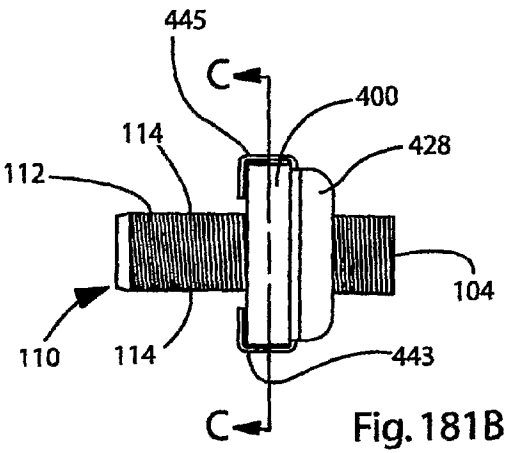
Figure 179:
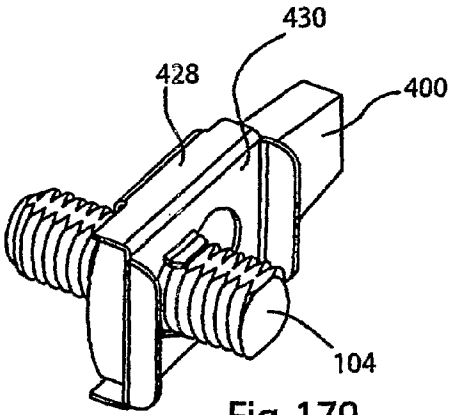
Figure 180:
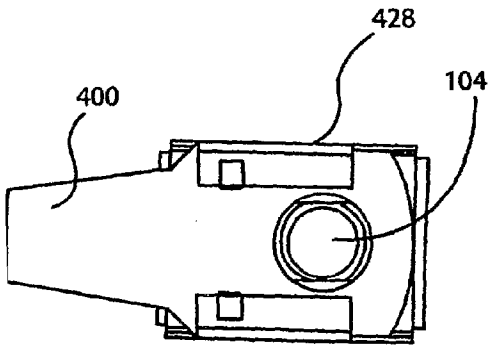

The pawl 400 of the embodiment of FIGS. 170-182B has a shaft-engaging portion 416, a latching portion 418 provided for engagement with, for example, a doorframe, and a connecting portion 420 extending between the shaft-engaging portion 416 and the latching portion 418. The shaft-engaging portion 416 has a hole 422 that allows the threaded portion 110 of the shaft 104 to pass through the shaft-engaging portion 416 of the pawl 400. The hole 422 has interrupted female threads 424 that are engageable with the interrupted male threads 112 of the threaded portion 110 of the shaft 104 when the pawl 400 is in a first angular position about the shaft 104 as illustrated in FIGS. 175, 181, and 182. The ridge or point diameter of the female threads 424 corresponds to the root diameter of the male threads 112 of the shaft 104. The female or internal threads 424 are interrupted by smooth arcuate surfaces 426 that have a radius of curvature approximately the same as one half the ridge or point diameter of the male threads 112. The radius of curvature of the smooth surfaces 426 should at least be slightly larger than one half of the ridge or point diameter of the male threads 112 so that the pawl 400 can be moved along the threaded portion 110 of the shaft in order to position the pawl 400 at any desired location along the threaded portion 110 of the shaft 104 when the threaded portion 110 of the shaft is placed through the hole 422 in the pawl 400 and the pawl 400 is in a second angular position about the shaft 104 where the smooth surfaces 426 register with the external threads 112 and the internal threads 424 do not engage the interrupted external threads 112. The pawl 400 has a pair of depressions 401 the function of which is explained later herein.

The pawl assembly of the present invention also includes a clip 428 that is used to fix the pawl 400 to the shaft 104 at the desired location along the threaded portion 110 of the shaft, such that the pawl 400 and the shaft 104 move as one unit when the shaft 104 is driven or caused to move by the latch mechanism 102. This design enables the pawl 400 to be slipped onto the shaft 104 and securely fastened to the shaft without the aid of hand tools. The clip 428 has a main plate portion 430 that has a central hole 432. The hole 432 is key-hole shaped and has a wide portion 437 and a narrow slot portion 435. The key-hole shape of the slot 432 is formed by the intersection of a circular hole and a "double-D" configured hole. The circular hole forming the wide portion 437 of the hole 432 and the "double-D" configured hole forming the narrow portion 435 of the hole 432. The circular hole is of a slightly larger diameter that the thread ridge to thread ridge diameter, i.e. the ridge or point diameter, of the threaded portion 110 of the shaft 104. The slot 432 also has two flat sides 444 on either side of the narrow slot portion 435. The narrow portion 435 of the slot 432 is sized to allow the threaded portion 110 of the shaft to be placed between the parallel flat sides 444 of the slot portion 435 with the flat sides 114 of the threaded portion 110 of the shaft 104 being parallel to the flat sides 444 of the narrow slot portion 435. The threaded portion 110 of the shaft 104 can only fit through the narrow slot portion 435 when the flat sides 114 of the threaded portion 110 of the shaft 104 are parallel to the flat sides 444 of the narrow slot portion 435. The threaded portion 110 of the shaft 104 can fit through the wider slot portion 437 in any angular orientation about its longitudinal axis.

The clip 428 also has two cantilever tabs 442 that project approximately perpendicularly from the main plate 430 on either side of the narrow slot portion 435. Each of the tabs 442 is attached to the main plate 430 of the clip 428 along a respective one of the flat sides 444 of the narrow slot portions 435. The clip 428 further includes a pair of L-shaped brackets 443 and 445. Each of the L-shaped brackets 443 and 445 is attached to the main plate 430 of the clip 428 along a respective one of the lateral edges of the main plate 430. The L-shaped brackets 443 and 445 wrap around at least a portion of the shaft-engaging portion or the connecting portion of the pawl 400 to guide the pawl 400 in the rectilinear sliding movement of the clip 428 relative to the pawl 400. Tabs 439 and 441 are provided at the ends of the main plate 430 to make it easier for a user to rectilinearly slide the clip 428 relative to the pawl 400 in the direction of the longitudinal axis of the main plate 430. The clip 428 further includes a pair of detent projections 447 and 449 that engage the depressions 401 to maintain the clip 428 in a locked position under normal operating conditions. In the illustrated embodiment, the detent projections 447 and 449 are embossed or punched-out projections formed in the L-shaped brackets 443 and 445. The L-shaped brackets 443 and 445 are resilient enough such that by applying enough force a user can move the clip from the locked position to the unlocked position in order to adjust the position of or remove the pawl 400.

During installation of the pawl assembly, the main plate 430 is placed in contact with the shaft-engaging portion of the pawl 400 with the L-shaped brackets 443 and 445 wrapping around lateral portions of the pawl 400. The wider slot portion 437 of the main plate is placed in registry with the hole 422 of the pawl. The pawl 400 is positioned on the shaft in a same manner as previously described. The pawl 400 is first positioned at the desired location along the threaded portion 110 of the shaft 104, with the threaded portion 110 of the shaft passing through the wider slot portion 437. The clip 428 is now in the unlocked position. The pawl 400 is then rotated approximately 90° relative to the shaft 104, along with the clip 428, to bring the internal threads 424 of the hole 422 into engagement with the interrupted external threads 112 of the shaft 104. Simultaneously, the flat sides 114 of the threaded portion 110 of the shaft 104 are oriented parallel to the flat sides 444 of the narrow slot portion 435. With the pawl 400 in this position, the clip 428 is moved rectilinearly to its locked position where the flat sides 114 of the threaded portion 110 of the shaft 104 are received between the flat sides 444 of the narrow slot portion 435. Furthermore, the detent projections 447, 449 engage respective recesses 401 to maintain the clip 428 in the locked position. Because the threaded portion 110 of the shaft 104 only fits in the narrow slot portion 435 when the flat sides 114 of the threaded portion 110 of the shaft 104 are oriented parallel to the flat sides 444 of the narrow slot portion 435, the shaft 104 cannot be rotated relative to the pawl 400 when the clip 428 is in the locked position. Furthermore, the tabs 442 impart greater resistance to deformation to the flat sides 444 of the narrow slot portion 435, and in turn give greater resistance to torsion between the pawl 400 and the shaft 104.

Therefore, the flat sides 444 of the narrow slot portion 435 and the tabs 442 effectively block the rotational movement of the pawl 400 relative to the shaft 104. Furthermore, because the internal threads 424 of the hole 422 are engaged to the interrupted external threads 112 of the shaft 104, rectilinear motion of the pawl 400 in the direction of the longitudinal axis of the shaft 104 and along the threaded portion 110 of the shaft is also prevented, and thus the pawl 400 is securely fastened to the shaft 104 such that the pawl 400 and the shaft 104 move together as one unit.

To remove the pawl 400 from the shaft 104, the sequence of steps for installing the pawl 400 to the shaft 104 is reversed.

Referring to FIGS. 183A-187F, yet another embodiment of the pawl assembly of the present invention may be seen. The embodiment of FIGS. 183A-187F, includes the pawl 500 and a clip 528.

The pawl 500 of the present invention has a shaft-engaging portion 516, a latching portion 518 provided for engagement with, for example, a doorframe, and a connecting portion 520 extending between the shaft-engaging portion 516 and the latching portion 518. The shaft-engaging portion 516 has a shaft slot 522 that allows the threaded portion 110 of the shaft 104 to pass through the shaft-engaging portion 516 of the pawl 500. The shaft slot 522 is a slot with two flat sides 526 and is closed at both ends. The distance between the flat sides 526 of the slot 522 is slightly larger than the distance between the flat sides 114 of the threaded portion 110 of the shaft 104 such that the threaded portion 110 of the shaft 104 can pass through the slot only when the flat sides 114 of the threaded portion 110 of the shaft 104 are essentially parallel with the flat sides 526 of the slot 522. Accordingly, once the threaded portion 110 of the shaft 104 is inserted through the slot 522 of the pawl 500, the rotation of the shaft 104 relative to the pawl 500 is effectively prevented through the interaction of the flat sides 114 of the threaded portion 110 of the shaft 104 and the flat sides 526 of the pawl slot 522.

The end of the slot 522 that is closest to the latching portion 518 is provided with interrupted female threads or ridges 524 that are engageable with the interrupted male threads 112 of the threaded portion 110 of the shaft 104 when the pawl 500 is in the locked position. The end of the slot 522 that is farthest from the latching portion 518 of the pawl has a smooth surface with no structure that can interfere with the sliding movement of the threaded portion 110 of the shaft 104 through the slot 522. The slot 522 is long enough such that with the threaded portion 110 of the shaft 104 positioned nearest the end of the slot 522 that is farthest from the latching portion 518 of the pawl, the threads or ridges 524 cannot engage or interfere with the threads 112 of the threaded portion 110 of the shaft 104. When the threaded portion 110 of the shaft 104 is nearest the end of the slot 522 that is farthest from the latching portion 518 of the pawl, the pawl 500 is in the unlocked position and the threaded portion 110 of the shaft 104 can slide freely through the slot 522. The pawl 500 has a clip attachment slot 501 positioned intermediate the shaft slot 522 and the latching portion 518 of the pawl 500.

The clip 528 is used to fix the pawl 500 to the shaft 104 at the desired location along the threaded portion 110 of the shaft, such that the pawl 500 and the shaft 104 move as one unit when the shaft 104 is driven or caused to move by a latch mechanism. This design enables the pawl 500 to be slipped onto the shaft 104 and securely fastened to the shaft without the aid of hand tools. The clip 528 has an upper plate 530, lower plate 531, and a connecting plate 533 that are connected together in an approximately J-shaped profile. The upper and lower plates are parallel. The clip 528 is resilient such that if the upper plate 530 and the lower plate 531 are spread apart they tend to go back to their original relative positions. The upper plate 530 has a hole 532 that has an edge 544 designed to engage the threads 112 on the side of the threaded portion 110 of shaft 104 that is opposite the side of the threads 112 of the threaded portion 110 that face the ridges 524 of the slot 522 of the pawl. Depending from the upper plate 530 is a snap leg 552. The snap leg 552 is attached to the edge of the upper plate 530 that is distal from the connecting plate 533. The hole 532 is sized to allow the threaded portion 110 of the shaft to pass through the hole 532 at least in the angular orientation of the threaded portion 110 relative to the pawl 500 as dictated by the straight parallel sides 526 of the slot 522.

Figure 183A:
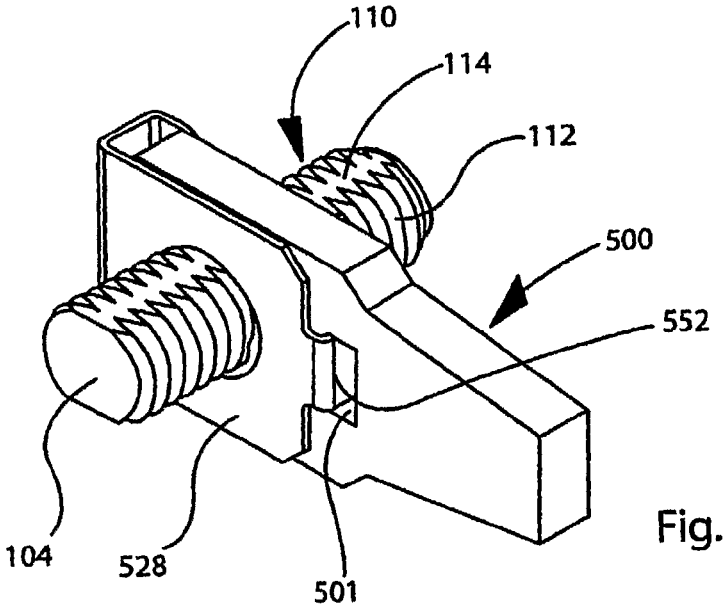
FIGS. 183A-187F are views of an eighth embodiment of the present invention.
Figure 183B:
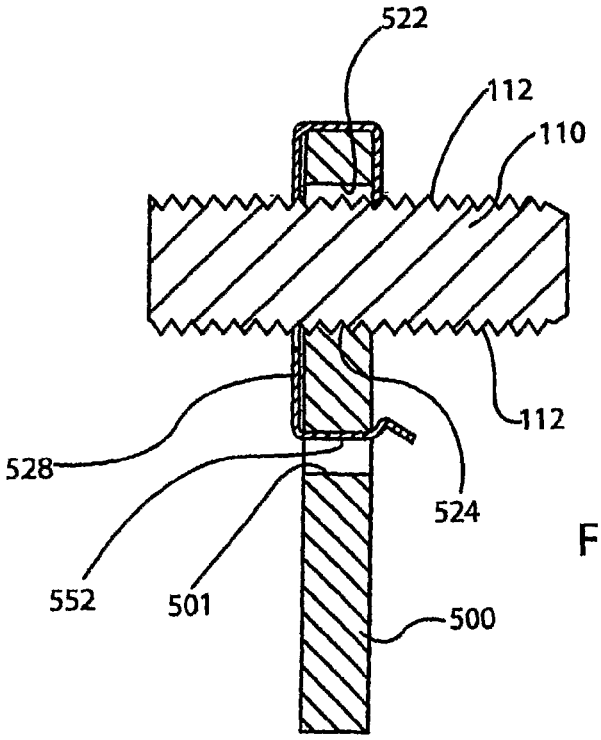
Figure 184A:
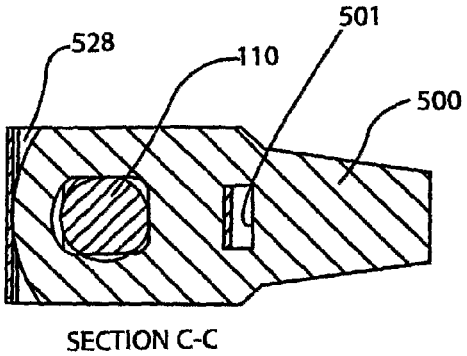
Figure 184B:
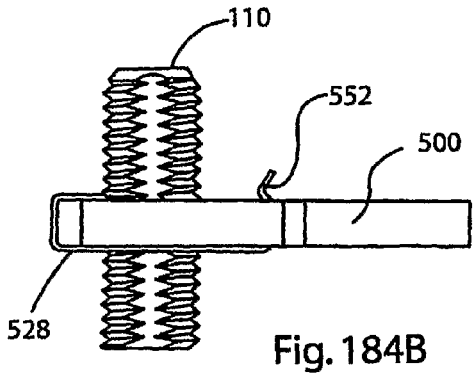
Figure 184C:
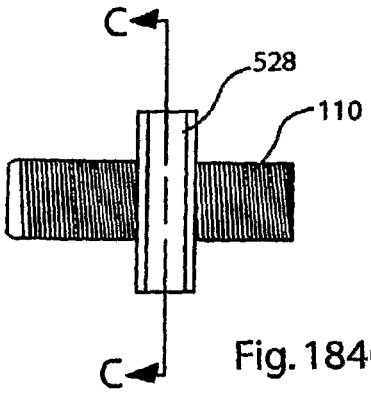
Figure 184D:
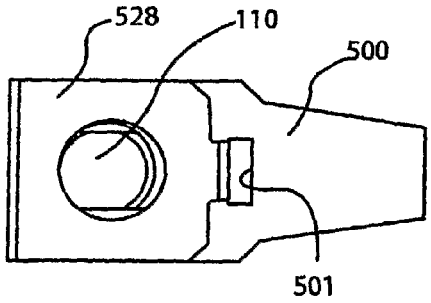
Figure 185A:
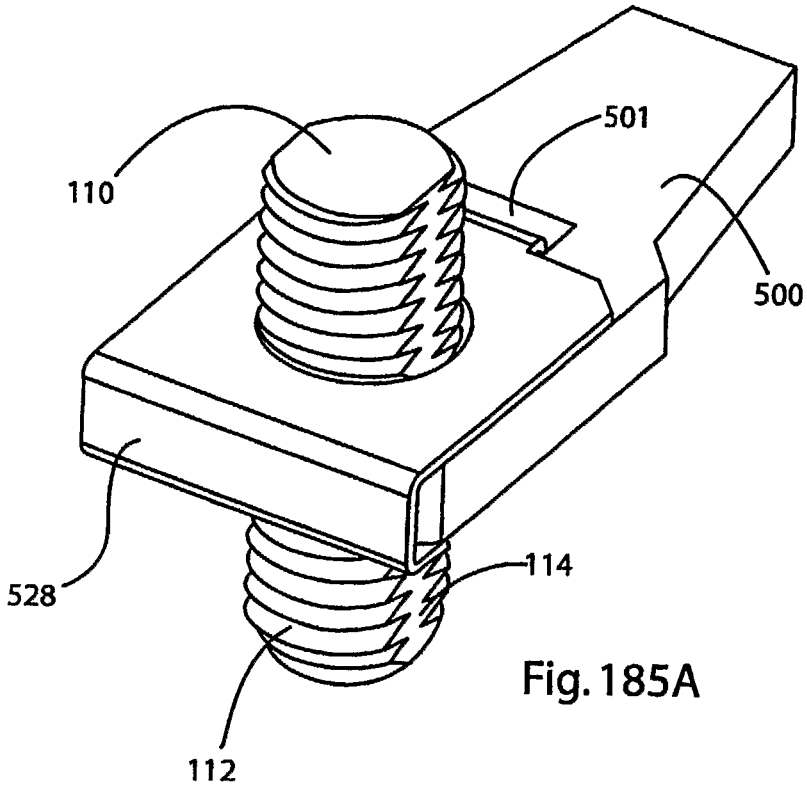
Figure 185B:
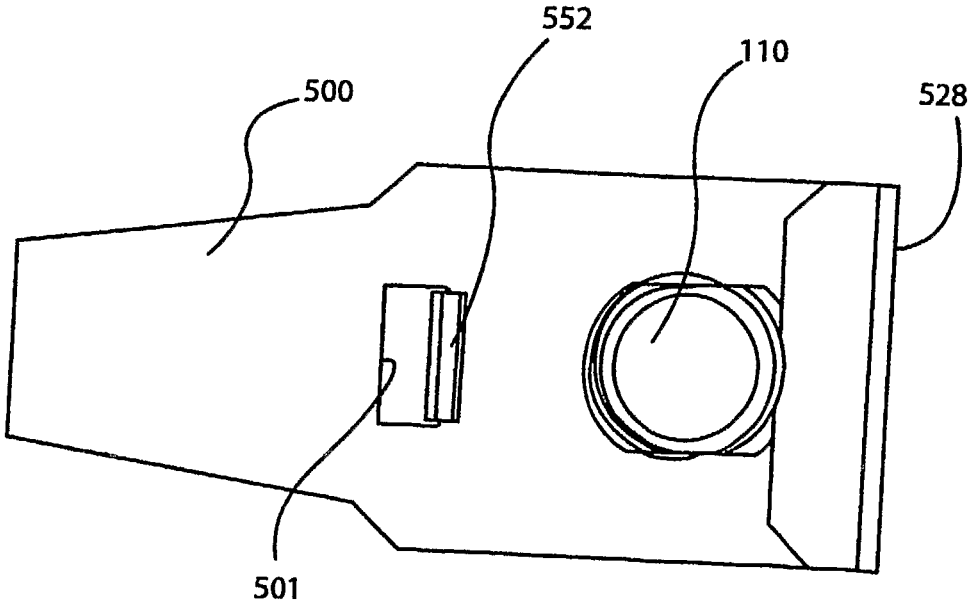
Figure 186A:
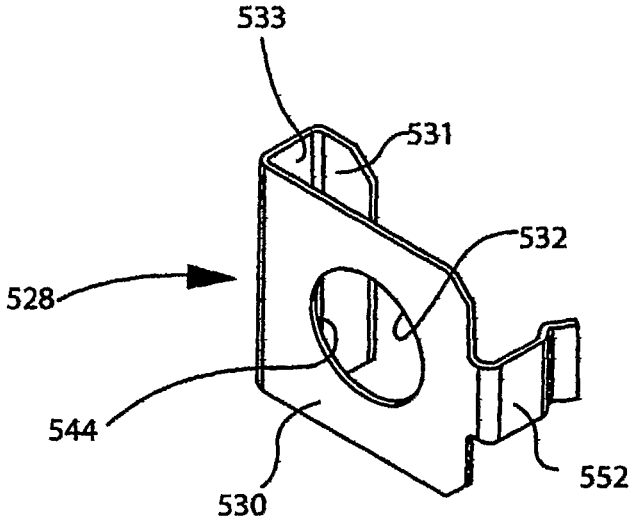
Figure 186B:
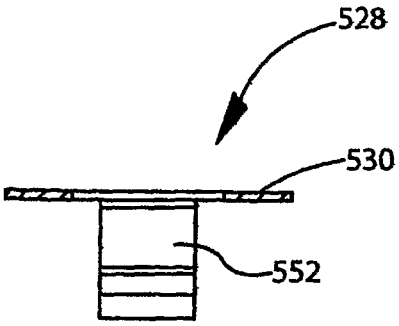
Figure 186C:
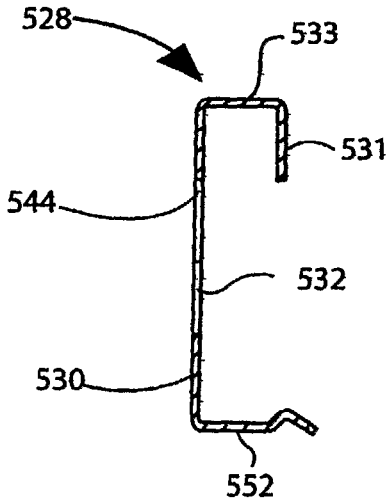
Figure 186D:
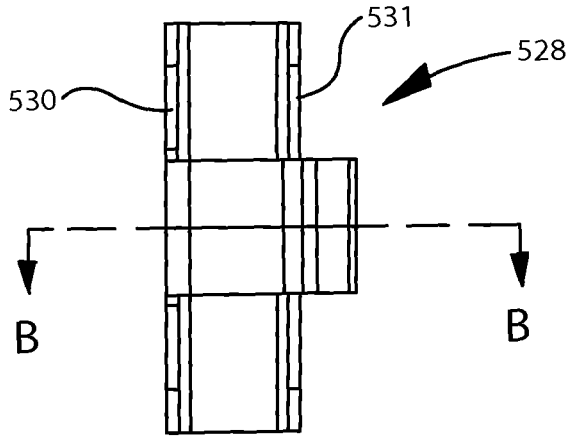
Figure 186E:
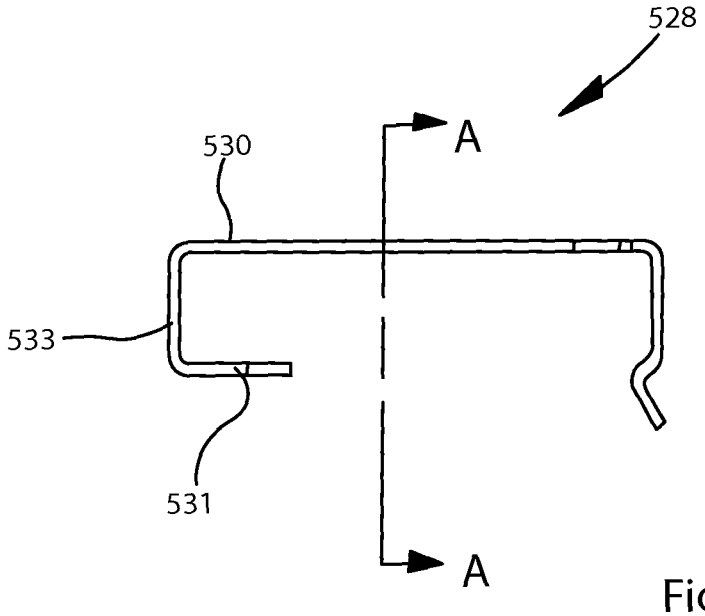
Figure 187A:
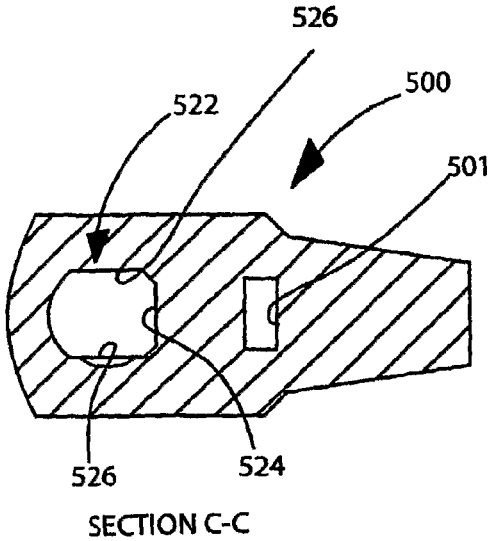
Figure 187B:
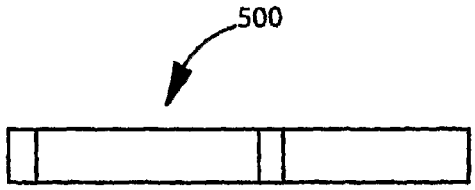
Figure 187C:
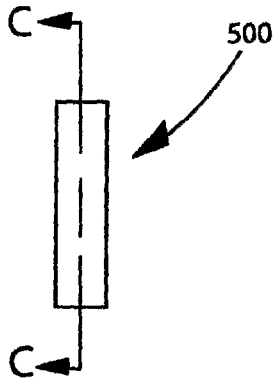
Figure 187D:
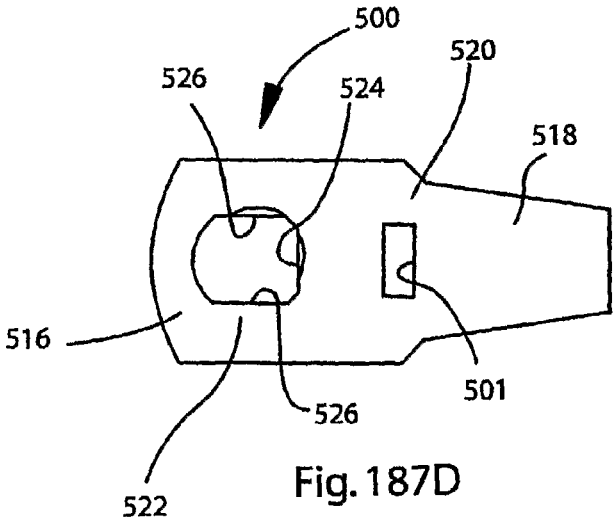
Figure 187E:
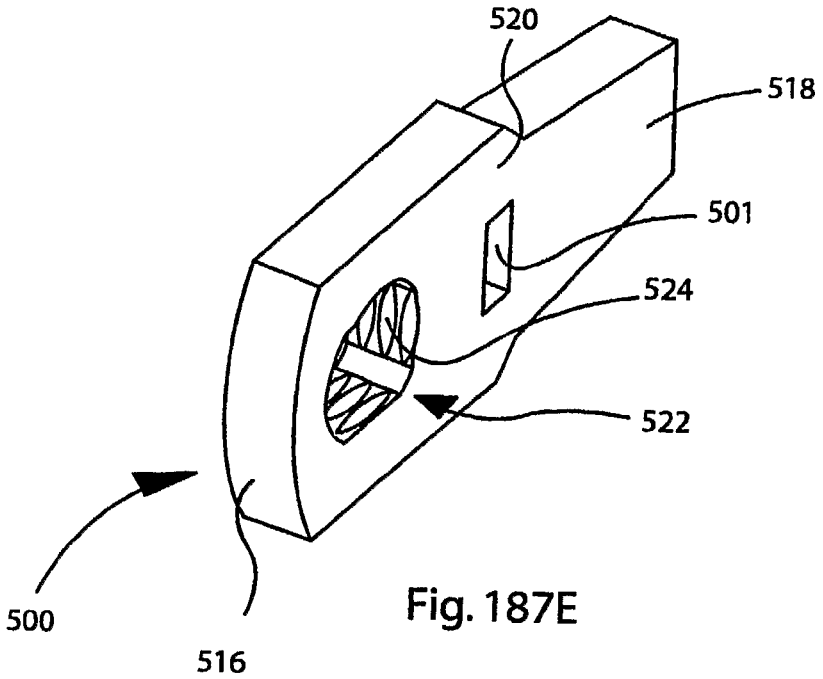
Figure 187F:
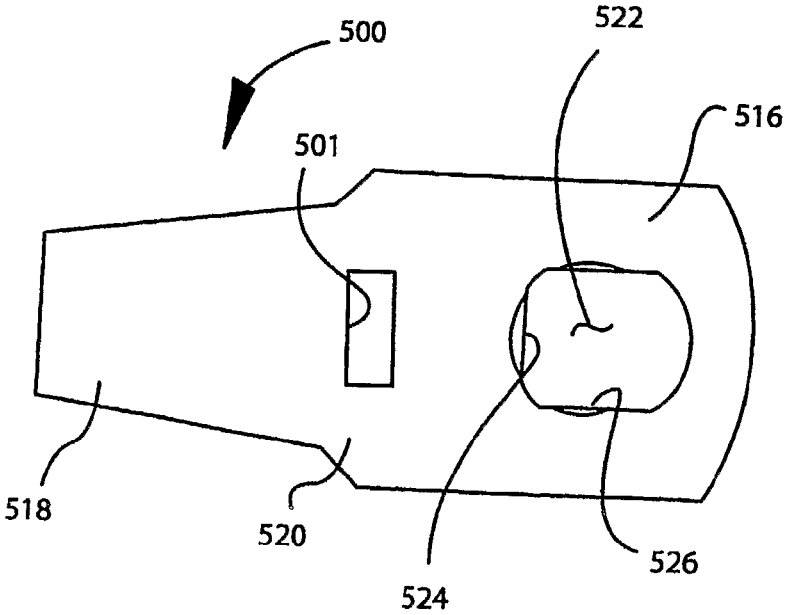

To install the pawl assembly the clip 528 is placed around the shaft-engaging portion 516 of the pawl 500 with the hole 532 in registry with the slot 522 of the pawl 500. To accomplish the placement of the clip 528 around the shaft-engaging portion 516 of the pawl 500, the upper plate 530 and the lower plate 531 have to be spread apart such that the lower plate 531 is in contact with one side of the shaft-engaging portion 516 of the pawl 500 and the snap leg 552 is touching the other side of the shaft-engaging portion 516 of the pawl 500. The threaded portion 110 of the shaft 104 is then placed through the hole 532 and the slot 522, and the pawl 500 is positioned at the desired location along the threaded portion 110 of the shaft 104. The clip 528 is then pushed toward the latching portion 518 of the pawl 500 as far as possible and the upper plate 530 is pressed flat against the respective side of the shaft-engaging portion 516 of the pawl 500. At this point the snap leg 552 will snap into the slot 501 to maintain the clip 528 in the locked position as shown in FIG. 183B. This step can equivalently be thought of as moving the pawl 500 toward the connecting plate 533 of the clip 528.

As the clip 528 is moved to its final locked position, the edge 444 of the hole 532 engages the threaded portion 110 of the shaft 104 and presses the interrupted threads on one side of the threaded portion 110 of the shaft 104 into engagement with the ridges 524 of the slot 522. Once the interrupted threads 112 on one side of the threaded portion 110 of the shaft engage the ridges 524, the axial movement of the pawl 500 relative to the shaft 104 is prevented. Furthermore, relative rotation between the pawl 500 and the shaft 104 is prevented by the interaction of the flat sides 114 of the threaded portion 110 of the shaft 104 and the flat sides 526 of the pawl slot 522. Thus the pawl 500 is securely fastened to the shaft 104 such that the pawl 500 and the shaft 104 move together as one unit.

To remove the pawl 500 from the shaft 104, the snap leg 552 is pushed back out of the slot 501 and the clip 528 is pushed back away from the latching portion 518 of the pawl 500. Then the sequence of steps for installing the pawl 500 to the shaft 104 is reversed to remove the pawl from the shaft or to adjust the position of the pawl 500 on the shaft 104. The clip 528 is preferably made from spring steel sheet metal with coined edge to engage in the thread 112, the selection of the sheet metal thickness being dependent on rigidity or flex desired.

Figure 188:
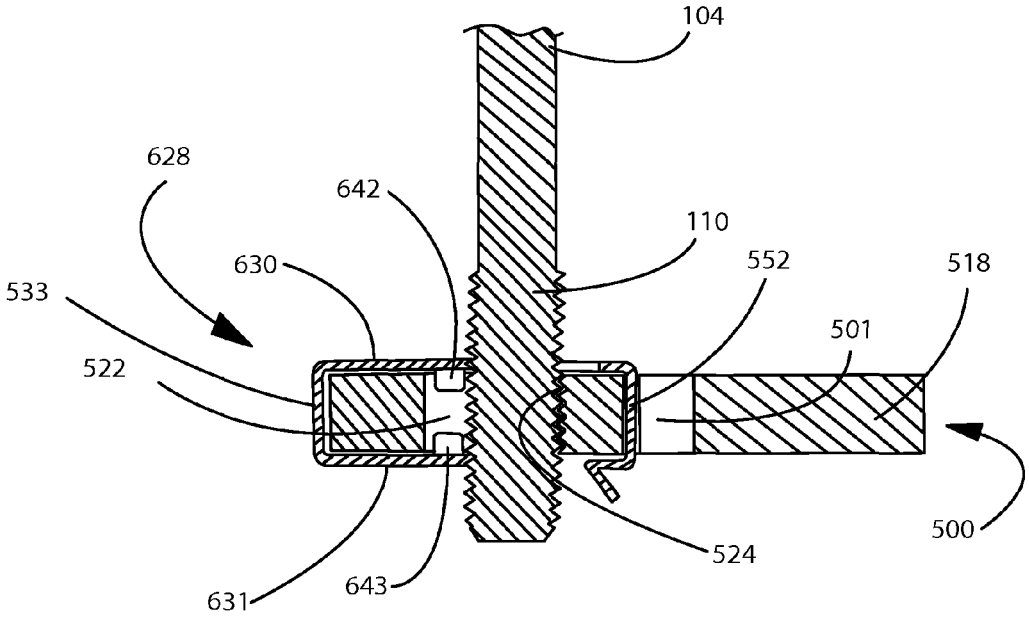
FIGS. 188-189 are views of a ninth embodiment of the present invention.
Figure 189:
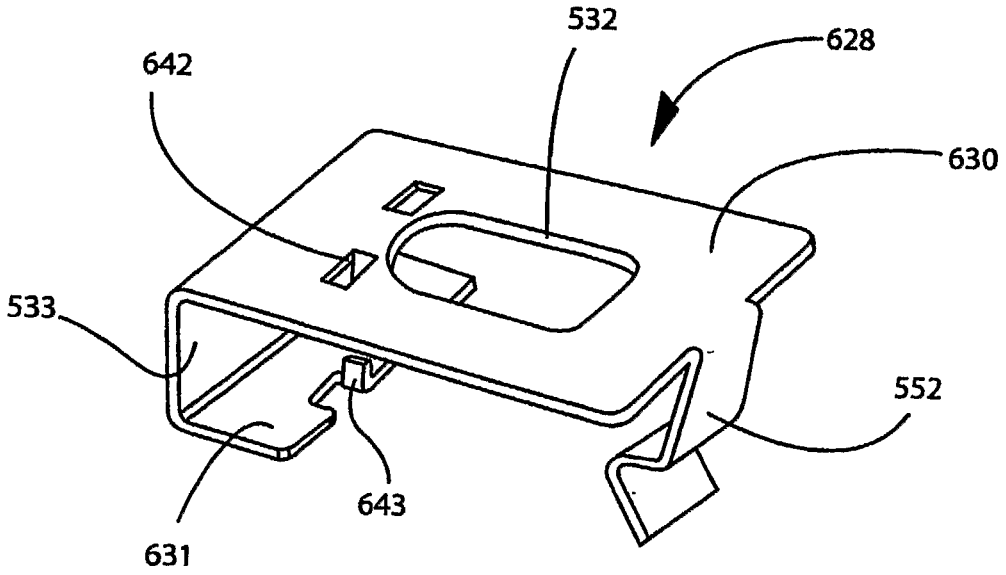
Figure 190:
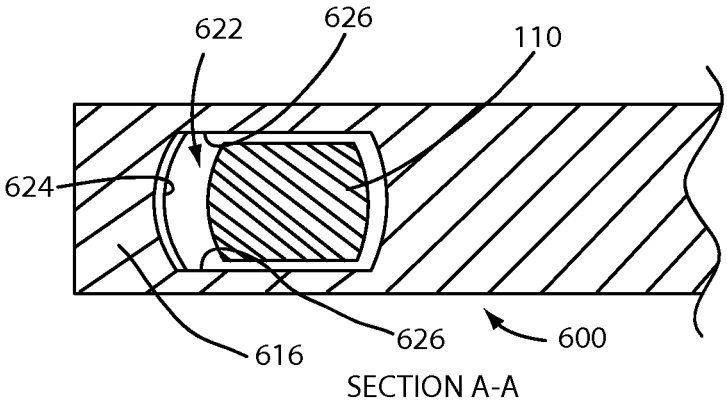
FIGS. 190-193 are views of a tenth embodiment of the present invention.
Figure 191:
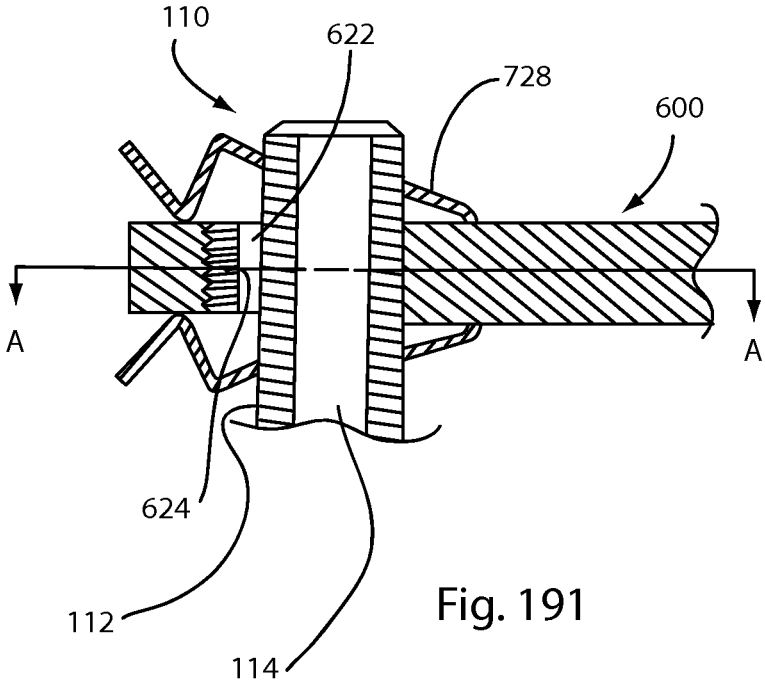
Figure 192A:
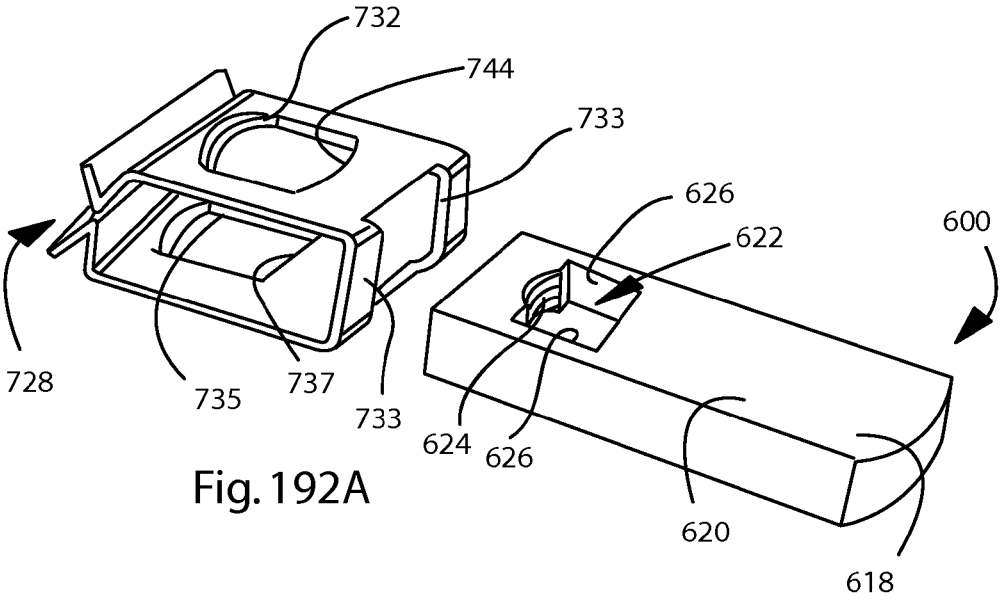
Figure 192B:
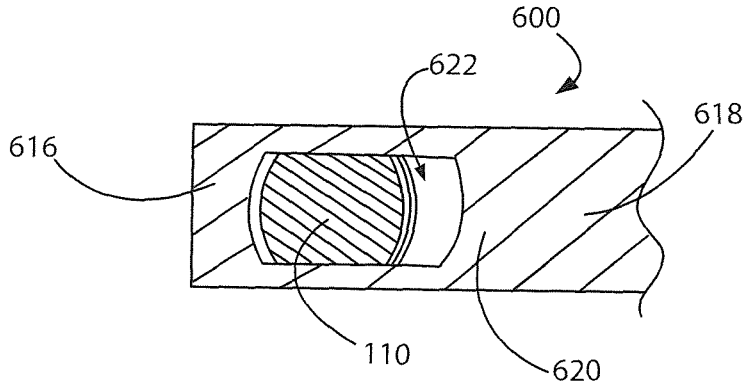

Referring to FIGS. 188-189, an alternative clip design 628 can be seen. The clip 628 is essentially identical to the clip 528 except that the clip 628 incorporates tabs 642 and 643 that are attached to the upper plate 630 and the lower plate 631, respectively, to fill the space between the threaded portion 110 of the shaft 104 and the smooth end of the slot 522 in the pawl 500, i.e. the end of the slot 522 that is opposite to the end that is provided with the ridges 524, when the clip 628 is in the locked position illustrated in FIG. 188. By filling the void between the threaded portion 110 of the shaft 104 and the smooth end of the slot 522, the clip 628 has greater strength in maintaining the shaft threads 112 in engagement with the ridges 524 in order to increase the axial loading that can be imparted to the shaft 104 by the pawl 500. The bottom plate 631 may also be extended as illustrated such that the bottom plate 631 also engages the threaded portion 110 of the shaft 104 to further enhance the retention strength of this clip design. The tabs 642, 643 are of sufficient length to support the shaft and improve the retention strength of the clip 628, but short enough to enable the removal of the clip 628.

It is also possible to provide the clip 628 with only the tabs 642 and/or to replace the tabs 642, 632 with other suitable structures such as solid wedges and tabs that extend laterally toward either side of the upper and lower plates.

Referring to FIGS. 190-193, yet another embodiment of the pawl assembly of the present invention may be seen. The embodiment of FIGS. 190-193, includes the pawl 600 and a clip 728.

The pawl 600 of the present invention has a shaft-engaging portion 616, a latching portion 618 provided for engagement with, for example, a doorframe, and a connecting portion 620 extending between the shaft-engaging portion 616 and the latching portion 618. The shaft-engaging portion 616 has a shaft slot 622 that allows the threaded portion 110 of the shaft 104 to pass through the shaft-engaging portion 616 of the pawl 600. The shaft slot 622 is a slot with two flat sides 626 and is closed at both ends. The distance between the flat sides 626 of the slot 622 is slightly larger than the distance between the flat sides 114 of the threaded portion 110 of the shaft 104 such that the threaded portion 110 of the shaft 104 can pass through the slot 622 only when the flat sides 114 of the threaded portion 110 of the shaft 104 are essentially parallel with the flat sides 626 of the slot 622. Accordingly, once the threaded portion 110 of the shaft 104 is inserted through the slot 622 of the pawl 600, the rotation of the shaft 104 relative to the pawl 600 is effectively prevented through the interaction of the flat sides 114 of the threaded portion 110 of the shaft 104 and the flat sides 626 of the pawl slot 622.

The end of the slot 622 that is farthest from the latching portion 618 is provided with interrupted female threads or ridges 624 that are capable of engagement with the interrupted male threads 112 of the threaded portion 110 of the shaft 104 when the pawl 600 is in the locked position relative to the shaft 104. The end of the slot 622 that is closest to the latching portion 618 of the pawl has a smooth surface with no structure that can interfere with the sliding movement of the threaded portion 110 of the shaft 104 through the slot 622. The slot 622 is long enough such that with the threaded portion 110 of the shaft 104 positioned nearest the end of the slot 622 that is closest to the latching portion 618 of the pawl, the threads or ridges 624 cannot engage or interfere with the threads 112 of the threaded portion 110 of the shaft 104. When the threaded portion 110 of the shaft 104 is nearest the end of the slot 622 that is closest to the latching portion 618 of the pawl, the pawl 600 is in the unlocked position and the threaded portion 110 of the shaft 104 can slide freely through the slot 622.

The clip 728 is used to fix the pawl 600 to the shaft 104 at the desired location along the threaded portion 110 of the shaft, such that the pawl 600 and the shaft 104 move as one unit when the shaft 104 is driven or caused to move by a latch mechanism. This design enables the pawl 600 to be slipped onto the shaft 104 and securely fastened to the shaft without the aid of hand tools. The clip 728 has an upper plate 730, lower plate 731, and connecting strips 733 that are connected together in a U-shaped profile. The upper and lower plates are parallel. The clip 728 is resilient such that if the upper plate 730 and the lower plate 731 are spread apart they tend to go back to their original relative positions. The upper plate 730 and the lower plate 731 each have a hole 732, 735, respectively, that has an edge 744, 737, respectively, designed to engage the threads 112 on the side of the threaded portion 110 of shaft 104 that is opposite the side of the threads 112 of the threaded portion 110 that face the ridges 624 of the slot 622 of the pawl. The holes 732, 735 are sized to allow the threaded portion 110 of the shaft to pass through the holes 732, 735 at least in the angular orientation of the threaded portion 110 relative to the pawl 600 as dictated by the straight parallel sides 626 of the slot 622. A catch plate 742, 743 is provided at the edge of each plate 730, 731 that is distal from the connecting strips 733. The catch plates 742, 743 wrap around the rear edges of the shaft-engaging portion 616 of the pawl 600 to maintain the clip 728 in the engaged position. The catch plates 742, 743 are provided with ramps 745, 746 that spread the plates 730 and 731 apart as the clip 728 is initially applied to the pawl 600.

Figure 193:
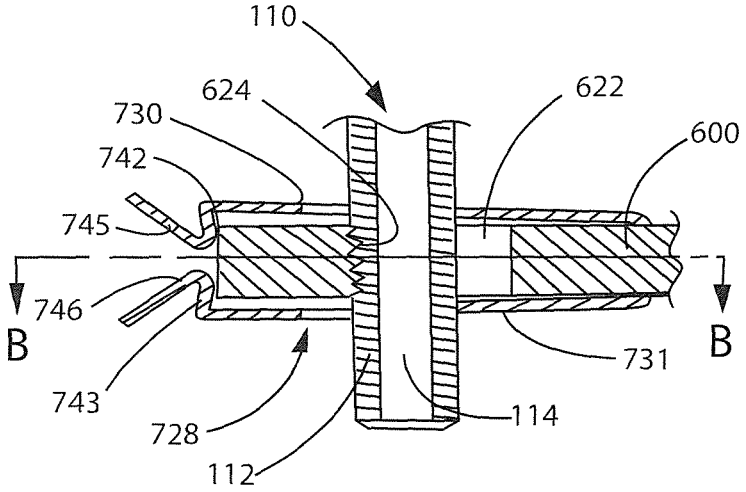

To install the pawl assembly the clip 728 is placed around the shaft-engaging portion 616 of the pawl 600 with the holes 732, 735 in registry with the slot 622 of the pawl 600. To accomplish the placement of the clip 728 around the shaft-engaging portion 616 of the pawl 600, the latching portion 618 of the pawl 600 is pressed against the ramps 745, 746 to spread apart the upper plate 730 and the lower plate 731, and the pawl 600 is pushed through between the catch plates 742, 743 until the connecting portion 620 of the pawl 600 is positioned in between the connecting strips 733 and the holes 732, 735 are placed in registry with the pawl slot 622. At this time the lower catch plate 743 is in contact with one side of the shaft-engaging portion 616 of the pawl 600 and the upper catch plate 742 is in contact with the other side of the shaft-engaging portion 616 of the pawl 600. The threaded portion 110 of the shaft 104 is then placed through the holes 732, 735 and the slot 622, and the pawl 600 is positioned at the desired location along the threaded portion 110 of the shaft 104. The clip 728 is then pushed away from the latching portion 618 of the pawl 600, or the pawl 600 is pulled further through the opening between the connecting strips 733, as far as possible and the upper plate 730 and the lower plate 731 are pressed flat against the respective sides of the shaft-engaging portion 616 of the pawl 600. At this point the catch plates 743, 742 snap around the rear edges of the shaft-engaging portion 616 of the pawl 600 to maintain the clip 728 in the engaged position as shown in FIG. 193.

As the clip 728 is moved to its final engaged position, the interrupted threads on one side of the threaded portion 110 of the shaft 104 are pressed into engagement with the ridges 624 of the slot 622. The edges 744, 737 of the holes 732, 735 engage the threaded portion 110 of the shaft 104 to keep the one side of the threaded portion 110 of the shaft 104 in engagement with the ridges 624 of the slot 622. Once the interrupted threads 112 on one side of the threaded portion 110 of the shaft engage the ridges 624, the axial movement of the pawl 600 relative to the shaft 104 is prevented. Furthermore, relative rotation between the pawl 600 and the shaft 104 is prevented by the interaction of the flat sides 114 of the threaded portion 110 of the shaft 104 and the flat sides 626 of the pawl slot 622. Thus the pawl 600 is securely fastened to the shaft 104 such that the pawl 600 and the shaft 104 move together as one unit.

To remove the pawl 600 from the shaft 104 the sequence of steps for installing the pawl 600 to the shaft 104 is reversed to remove the pawl from the shaft or to adjust the position of the pawl 600 on the shaft 104. The clip 728 is preferably made from spring steel sheet metal, the selection of the sheet metal thickness being dependent on rigidity or flex desired.

Referring to FIGS. 196-199, yet another embodiment of the pawl assembly of the present invention may be seen. The embodiment of FIGS. 196-199, includes the pawl 700 and a clip 828.

The pawl 700 of the present invention has a shaft-engaging portion 716, a latching portion 718 provided for engagement with, for example, a doorframe, and a connecting portion 720 extending between the shaft-engaging portion 716 and the latching portion 718. The shaft-engaging portion 716 has a shaft slot 722 that allows the threaded portion 110 of the shaft 104 to pass through the shaft-engaging portion 716 of the pawl 700. The shaft slot 722 has a lateral side 724 that mates with one of the flat sides 114 and portions of the interrupted threads 112 on either side of that flat side 114 of the threaded portion 110 of the shaft 104, such that when the threaded portion 110 of the shaft 104 is in engagement with the lateral side 724 rectilinear movement of the pawl 700 in the direction of the longitudinal axis of the shaft 104 along the threaded portion 110 of the shaft 104 is prevented. The lateral dimension of the slot 722, i.e. the dimension of the slot 722 in the direction perpendicular to the longitudinal axis of the pawl 700, is such that the threaded portion 110 of the shaft 104 can be disengaged from the lateral side 724 while the threaded portion 110 of the shaft 104 remains positioned through the slot 722 to thereby allow axial movement of the pawl 700 relative to the threaded portion 110 of the shaft 104. By axial movement it is meant the rectilinear movement of the pawl, e.g. pawl 700, in the direction of the longitudinal axis of the shaft 104 along the threaded portion 110 of the shaft 104.

The clip 828 is used to fix the pawl 700 to the shaft 104 at the desired location along the threaded portion 110 of the shaft, such that the pawl 700 and the shaft 104 move as one unit when the shaft 104 is driven or caused to move by a latch mechanism. This design enables the pawl 400 to be slipped onto the shaft 104 and securely fastened to the shaft without the aid of hand tools. The clip 828 has an upper plate 830, lower plate 831, and a connecting plate 833 that are connected together in a U-shaped profile. The upper and lower plates are parallel. The clip 828 is resilient such that if the upper plate 830 and the lower plate 831 are spread apart they tend to go back to their original relative positions. The upper plate 830 and the lower plate 831 each have a hole 832, 835, respectively, that has a straight edge 844, 837, respectively. The clip 828 also has cantilever tabs 854, 856 that lie against the flat side 114 of the threaded shaft portion 110 to increase the strength of the clip 828 in preventing rotational movement of the pawl 700 relative to the shaft 104. The cantilever tabs 854, 856 are attached to the respective plate 830, 831 along the straight edges 844, 837. The tabs 854, 856 are designed to engage a flat side 114 of the threaded portion 110 of shaft 104 on the side that is opposite the side of the threaded portion 110 that faces the lateral side 724 of the slot 722 of the pawl. The holes 832, 835 are sized to allow the threaded portion 110 of the shaft to pass through the holes 832, 835. A catch plate 842, 843 is provided at the edge of each plate 830, 831 that is distal from the connecting plate 833. The catch plates 842, 843 wrap around the edges of a lateral side 748 of the shaft-engaging portion 716 of the pawl 700 to maintain the clip 828 in the engaged position. The catch plates 842, 843 are provided with ramps 845, 846 that spread the plates 830 and 831 apart as the clip 828 is initially applied to the pawl 700.

Figure 199:
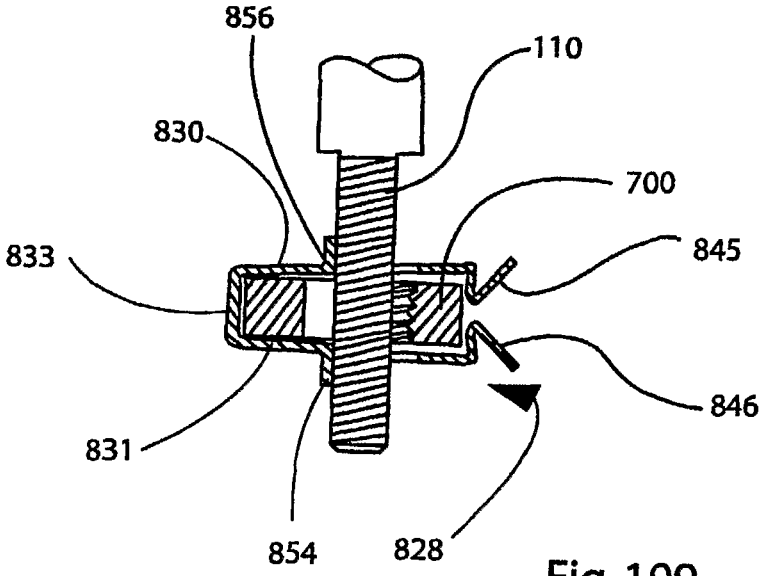
Figure 200B:
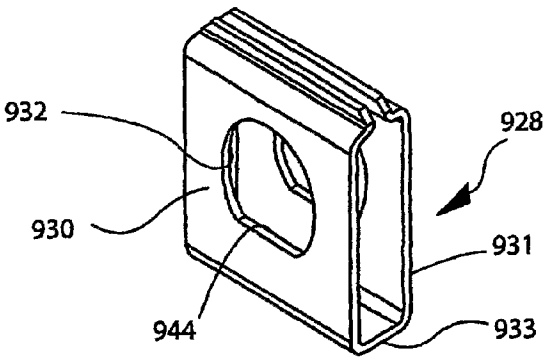
FIGS. 200A-203E are views of a thirteenth embodiment of the present invention.
Figure 200E:
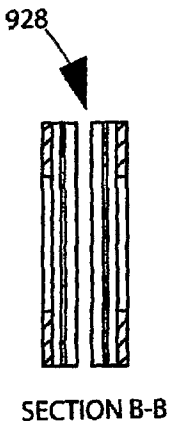
Figure 200D:
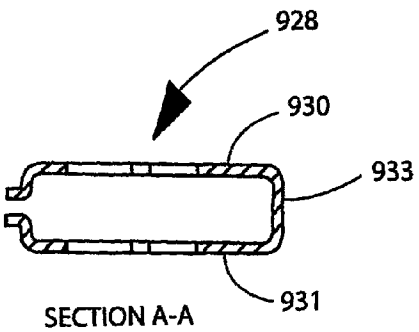
Figure 200A:
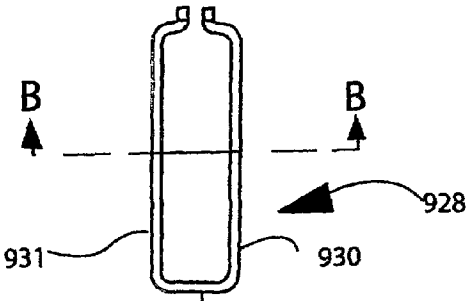
Figure 200C:
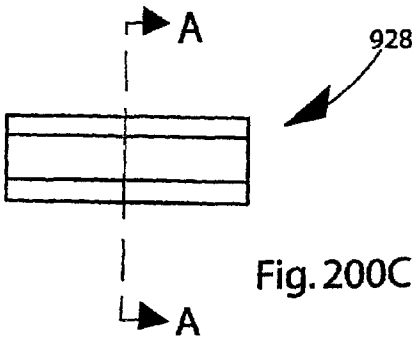
Figure 200H:
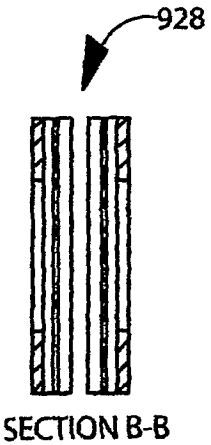
Figure 200G:
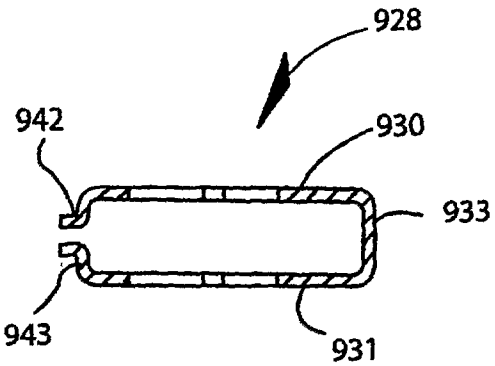
Figure 200F:
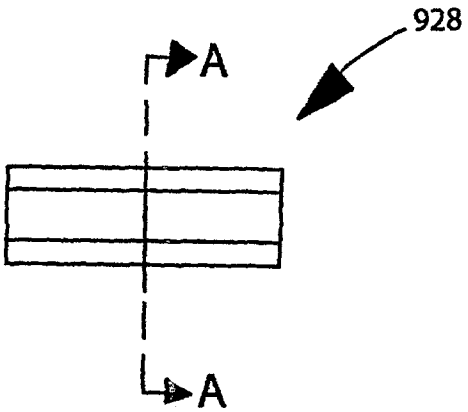
Figure 201B:
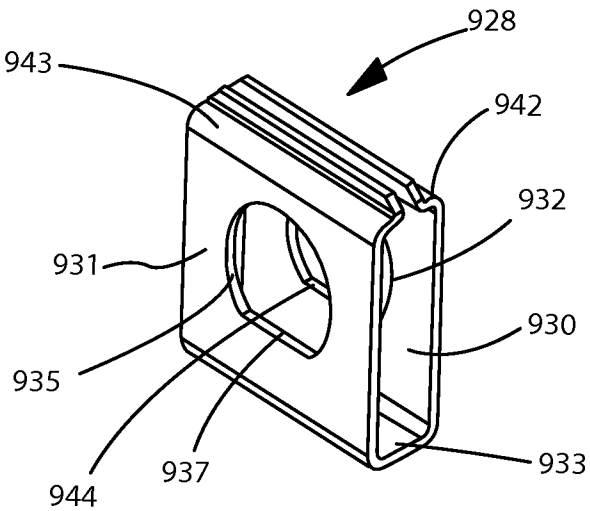
Figure 201A:
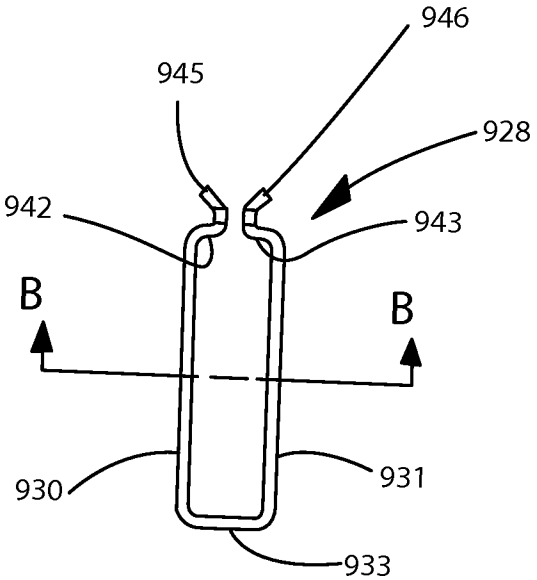
Figure 201E:
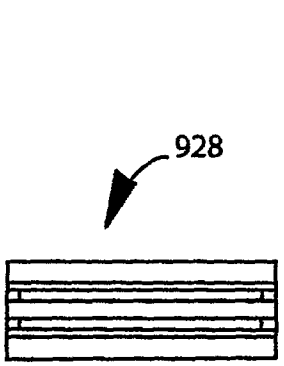
Figure 201D:
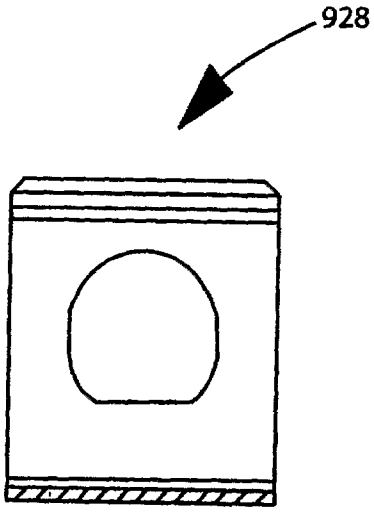
Figure 201C:
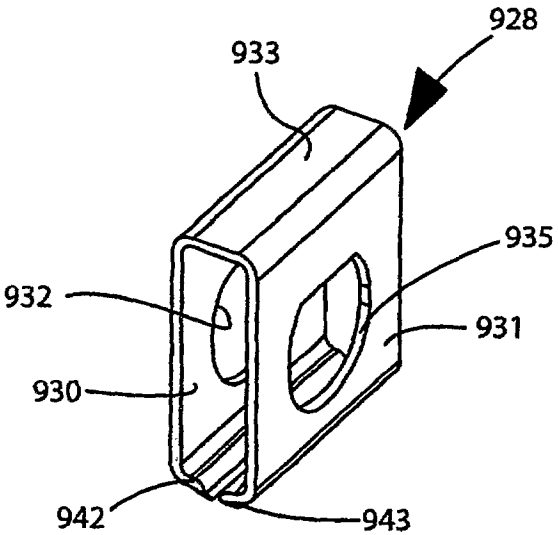
Figure 202C:
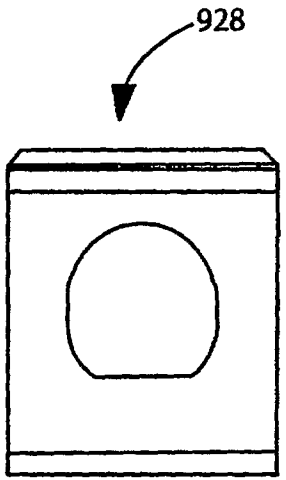
Figure 202B:
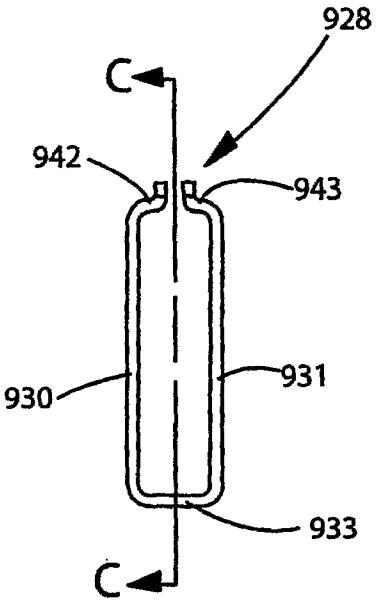
Figure 202A:
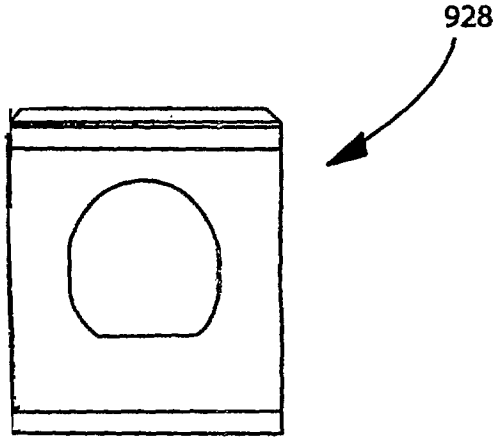
Figure 203A:
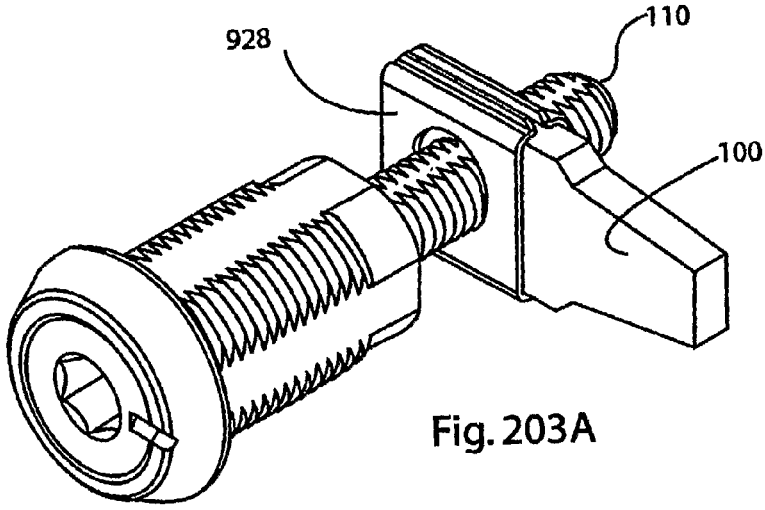
Figure 203B:
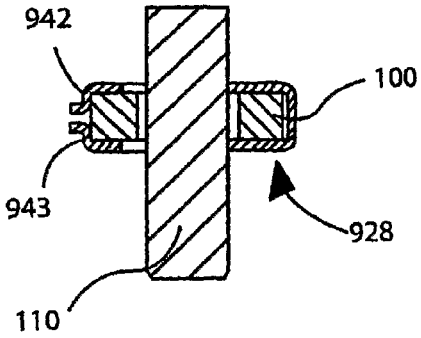
Figure 203C:
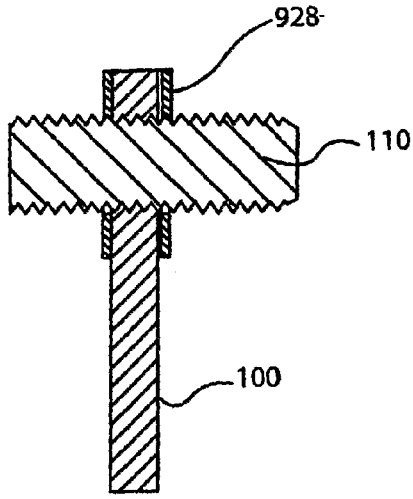
Figure 203D:
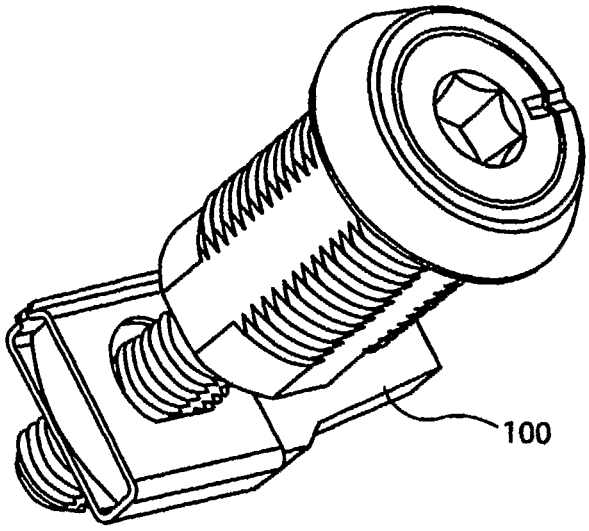
Figure 203E:
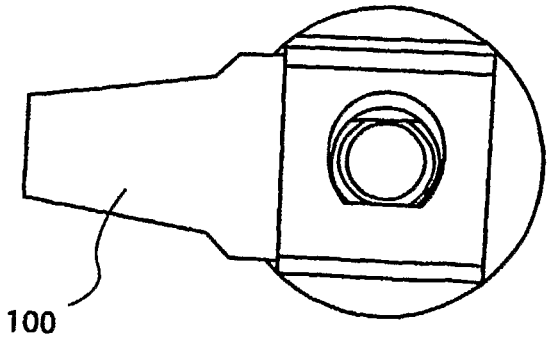
Figure 205:
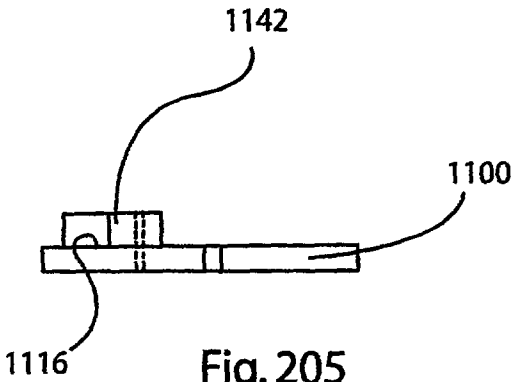
FIGS. 204-207 are views of a fourteenth embodiment of the present invention.

To install the pawl assembly the clip 828 is placed around the shaft-engaging portion 716 of the pawl 700 with the holes 832, 835 in registry with the slot 722 of the pawl 700. To accomplish the placement of the clip 828 around the shaft-engaging portion 716 of the pawl 700, the lateral side 750 of the shaft-engaging portion 716 of the pawl 700 is pressed against the ramps 845, 846 to spread apart the upper plate 830 and the lower plate 831, and the shaft-engaging portion 716 is pushed through between the catch plates 842, 843 until the holes 832, 835 are placed in registry with the pawl slot 722. At this time the lower catch plate 843 is in contact with one side of the shaft-engaging portion 716 of the pawl 700 and the upper catch plate 842 is in contact with the other side of the shaft-engaging portion 716 of the pawl 700. The threaded portion 110 of the shaft 104 is then placed through the holes 832, 835 and the slot 722, and the pawl 700 is positioned at the desired location along the threaded portion 110 of the shaft 104. The clip 828 is then pushed toward the shaft-engaging portion 716 of the pawl 700 as far as possible and the upper plate 830 and the lower plate 831 are pressed flat against the respective sides of the shaft-engaging portion 716 of the pawl 700. At this point the catch plates 843, 842 snap around the side edges of the side 748 of the shaft-engaging portion 716 of the pawl 700 to maintain the clip 828 in the engaged position as shown in FIG. 199.

As the clip 828 is moved to its final engaged position, one side of the threaded shaft portion 110 including one flat side 114 and portions of the threads 112 on either side of the flat surface 114 are brought into engagement with the lateral side 724. The tabs 854, 856 engage the threaded portion 110 of the shaft 104 to keep the one side of the threaded portion 110 of the shaft 104 in engagement with the lateral side 724 of the slot 722. Through the engagement of the threaded portion 110 of the shaft 104 with the lateral side 724 of the slot 722 and through the engagement of the tabs 854, 856 with a flat side 114 of the threaded shaft portion 110, the axial and rotational movement of the pawl 700 relative to the shaft 104 is prevented. Thus the pawl 700 is securely fastened to the shaft 104 such that the pawl 700 and the shaft 104 move together as one unit.

Figure 194:
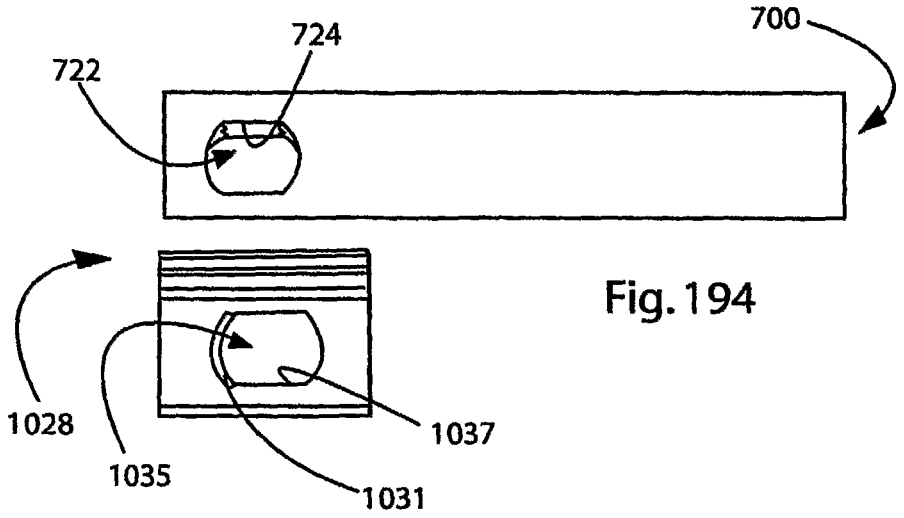
FIGS. 194-195 are views of an eleventh embodiment of the present invention.
Figure 195:
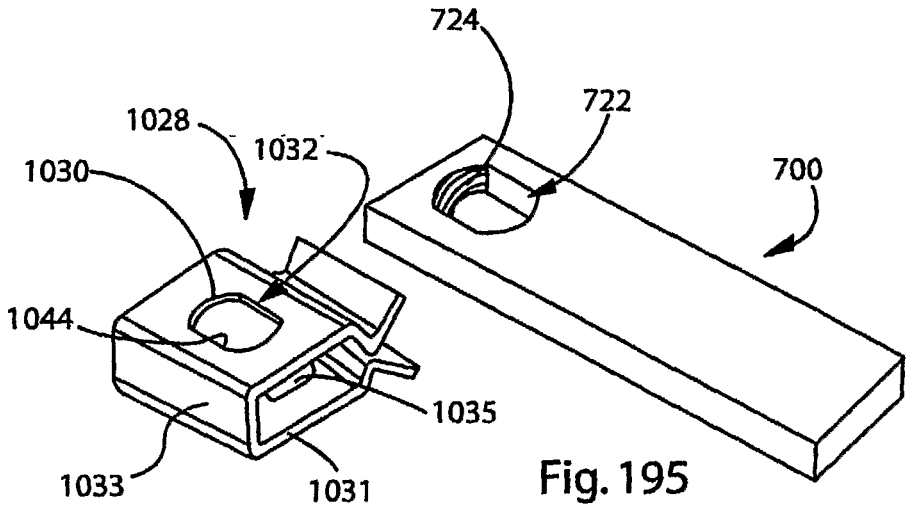
Figure 196:
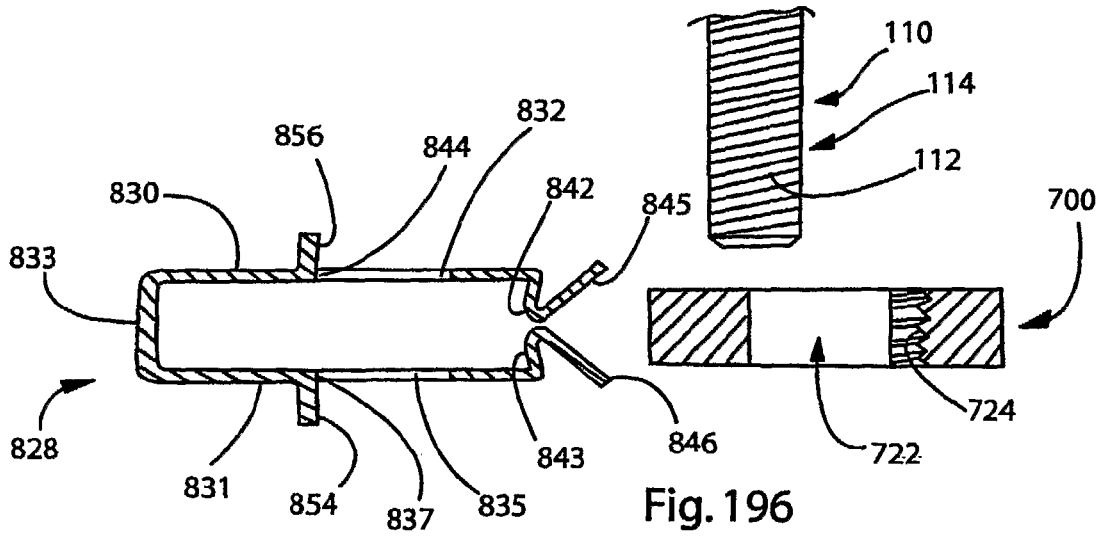
FIGS. 196-199 are views of a twelfth embodiment of the present invention.
Figure 197:
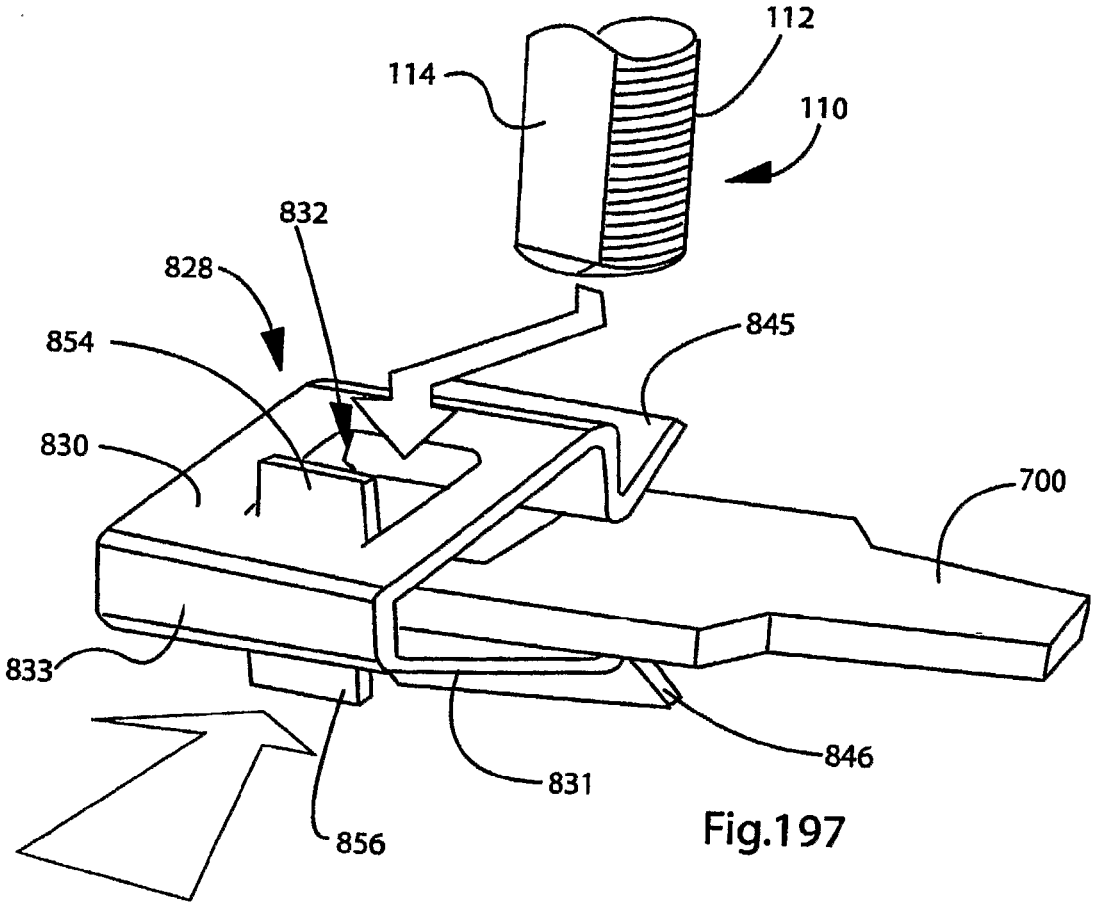
Figure 198:
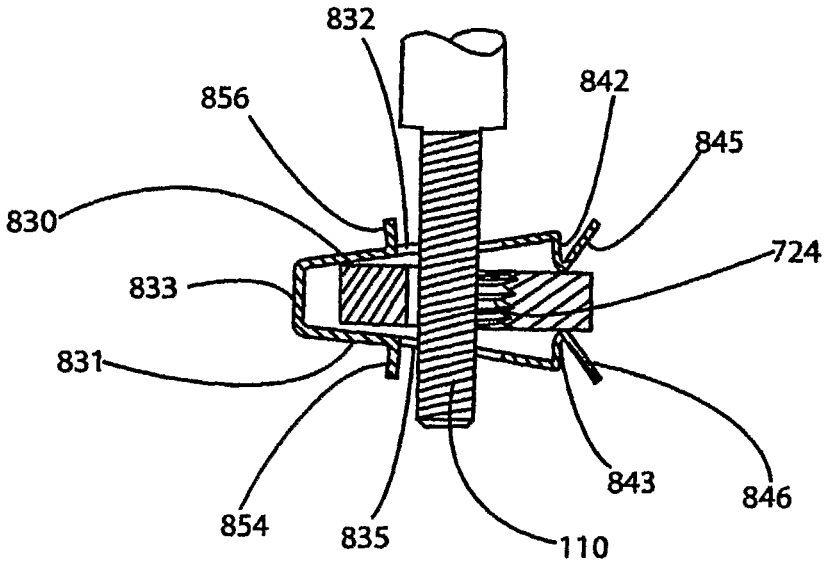

To remove the pawl 700 from the shaft 104 the sequence of steps for installing the pawl 700 to the shaft 104 is reversed. An alternative clip 1028 that lacks the cantilever tabs 554, 556 is shown in FIGS. 194-195. The clip 1028 has an upper plate 1030, lower plate 1031, and a connecting plate 1033 that are connected together in a U-shaped profile. The upper and lower plates are parallel. The clip 1028 is resilient such that if the upper plate 1030 and the lower plate 1031 are spread apart they tend to go back to their original relative positions. The upper plate 1030 and the lower plate 1031 each have a hole 1032, 1035, respectively, that has an edge 1044, 1037, respectively, designed to engage the threaded portion 110 of shaft 104 on the side that is opposite the side of the threaded portion 110 that faces the lateral side 724 of the slot 722 of the pawl. The edges 1044, 1037 need not be straight. The clip 1028 relies solely on the edges 1044, 1037 to maintain one side of the threaded portion 110 of the shaft 104, including one flat 114 and portions of the threads 112 on either side, in engagement with the lateral side 724 of the slot 722 in order to prevent the axial and rotational movement of the pawl 700 relative to the shaft 104.

Referring to FIGS. 200A-203E, yet another embodiment of the pawl assembly of the present invention may be seen. The embodiment of FIGS. 200A-203E, includes the pawl 100 and a clip 928.

The pawl 100 has already been described. The clip 928 is used to fix the pawl 100 to the shaft 104 at the desired location along the threaded portion 110 of the shaft, such that the pawl 100 and the shaft 104 move as one unit when the shaft 104 is driven or caused to move by a latch mechanism. This design enables the pawl 100 to be slipped onto the shaft 104 and securely fastened to the shaft without the aid of hand tools. The clip 928 has an upper plate 930, lower plate 931, and a connecting plate 933 that are connected together in a U-shaped profile. The upper and lower plates are parallel. The clip 928 is resilient such that if the upper plate 930 and the lower plate 931 are spread apart they tend to go back to their original relative positions. The upper plate 930 and the lower plate 931 each have a hole 932, 935, respectively, that has a straight edge 944, 937, respectively, designed to engage the flat side 114 of the threaded portion 110 of shaft 104. The holes 932, 935 are sized to allow the threaded portion 110 of the shaft to pass through the holes 932, 935. A catch plate 942, 943 is provided at the edge of each plate 930, 931 that is distal from the connecting plate 933. The catch plates 942, 943 wrap around the edges of a lateral side 148 of the shaft-engaging portion 116 of the pawl 100 to maintain the clip 928 in the engaged position. The catch plates 942, 943 may be provided with optional ramps 945, 946 that help spread the plates 930 and 931 apart as the clip 928 is initially applied to the pawl 100.

To install the pawl assembly the clip 928 is placed around the shaft-engaging portion 116 of the pawl 100 with the holes 932, 935 in registry with the slot 122 of the pawl 100. To accomplish the placement of the clip 928 around the shaft-engaging portion 116 of the pawl 100, the lateral side 150 of the shaft-engaging portion 116 of the pawl 100 is pressed against the ramps 945, 946 to spread apart the upper plate 930 and the lower plate 931, and the shaft-engaging portion 116 is pushed through between the catch plates 942, 943 until the holes 932, 935 are placed in registry with the pawl slot 122 in a manner similar to that described for clip 828. The threaded portion 110 of the shaft 104 is then placed through the holes 932, 935 and the slot 122, and the pawl 100 is positioned at the desired location along the threaded portion 110 of the shaft 104. The pawl 100 and clip 928 are then rotated 90° to engage the external threads 112 and the internal threads 124 to fix the position of the pawl 100 along the threaded portion 110 of the shaft 104. The clip 928 is then pushed toward the shaft-engaging portion 116 of the pawl 100 as far as possible and the upper plate 930 and the lower plate 931 are pressed flat against the respective sides of the shaft-engaging portion 116 of the pawl 100. At this point the catch plates 943, 942 snap around the side edges of the side 148 of the shaft-engaging portion 116 of the pawl 100 to maintain the clip 928 in the engaged position as shown in FIG. 203.

As the clip 928 is moved to its final engaged position, one flat side 114 of the threaded shaft portion 110 is brought into engagement with the straight edges 944, 937 of the holes 932, 935, which prevent rotational movement of the pawl 100 relative to the shaft 104. Thus the pawl 100 is securely fastened to the shaft 104 such that the pawl 100 and the shaft 104 move together as one unit.

To remove the pawl 100 from the shaft 104 the sequence of steps for installing the pawl 100 to the shaft 104 is reversed.

Referring to FIGS. 204-207, an alternative pawl 1100 can be seen. This design eliminates the need for a clip but requires tools for installation. The pawl 1100 incorporates a slip-on lock nut. The pawl 1100 has a U-shaped, open-ended slot 1122 in its shaft-engaging portion 1116. A slotted lock nut 1142 is rotationally supported above the slot 1122 by the shaft-engaging portion 1116 in a manner that is well known in the art of slip-on lock nuts. The slotted lock nut 1142 has an open-ended slot 1101. The slot 1122 is provided with partial threads 1124 over the surface of its closed end.

Figure 204:
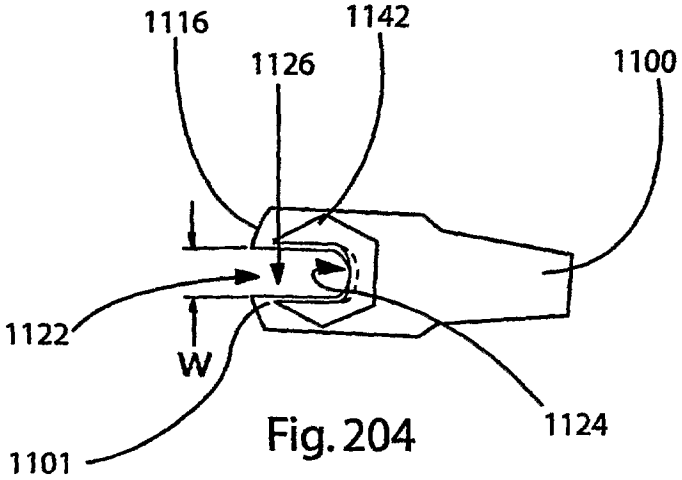
Figure 206:
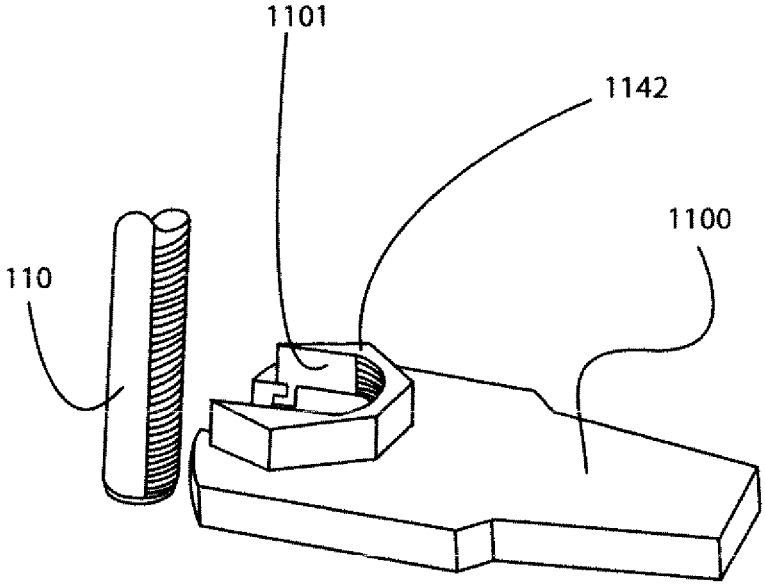
Figure 207:
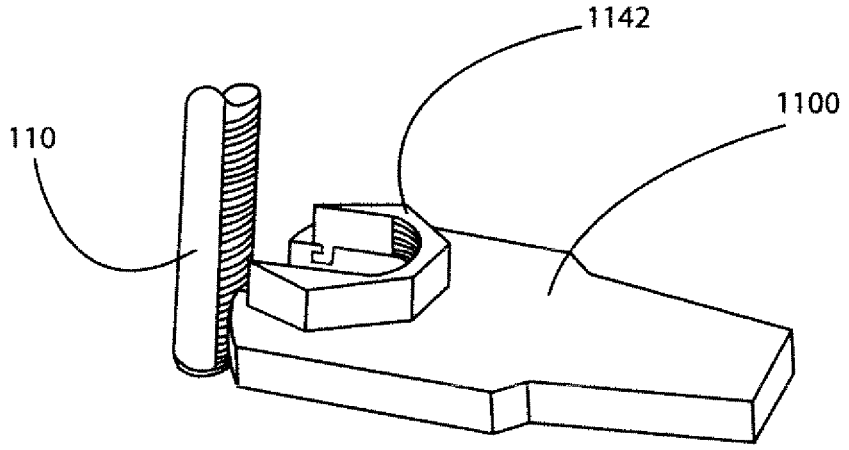
Figure 208:
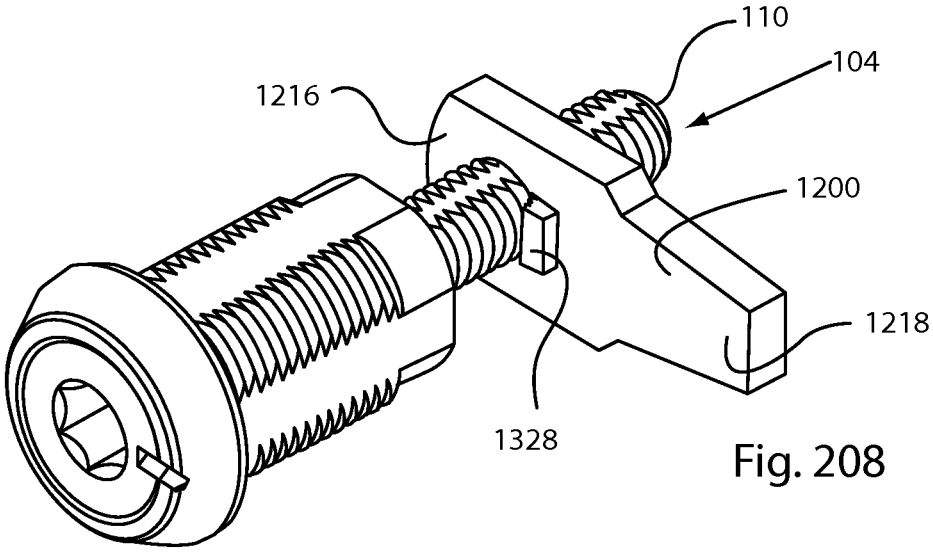
FIGS. 208-216 are views of a fifteenth embodiment of the present invention.
Figure 209:
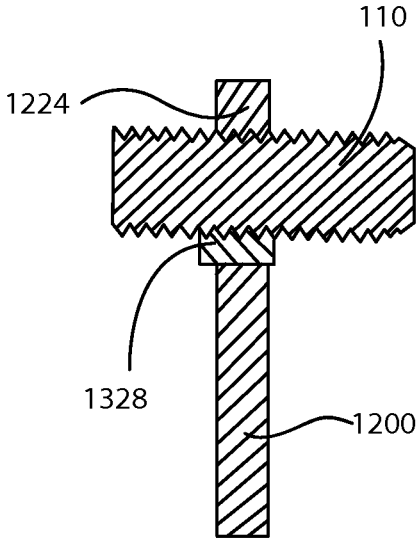
Figure 210:
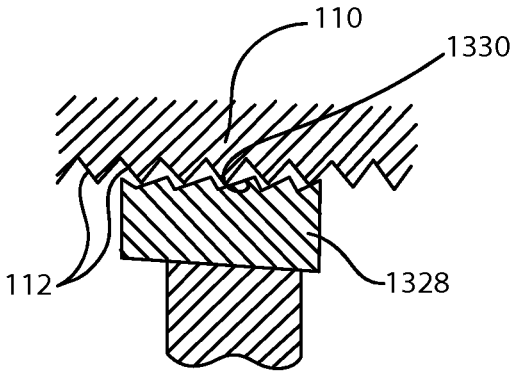
Figure 211:
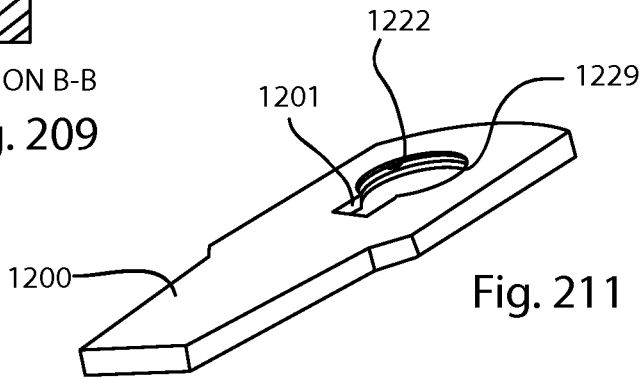
Figure 212:
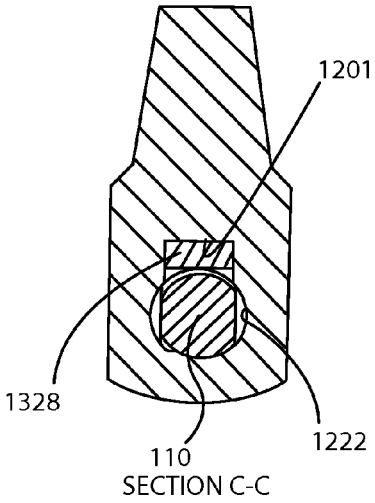

The flats 1126 of the slot 1122 in the pawl are a clearance fit to the flats 114 of the threaded shaft portion 110 to prevent rotation. The open end of the slot 1101 at least provides clearance for the width of the threaded shaft portion 110 measured from one flat 114 to the other flat 114, and the open end of the slot 1101 can be aligned in the same direction with the open end of the slot 1122 as shown in FIG. 204.

The width of the slot 1122 of the pawl 1100 corresponds to the width of the flats 114 on the threaded shaft portion 110. The shaft flats 114 are aligned with the flats 1126 of the pawl slot 1122 and the open ends of the slots 1122 and 1101 are aligned in the same direction for assembly. The pawl 1100 is placed at the desired position along the threaded shaft portion 110 with the threaded shaft portion 110 received in the slot 1122. The slotted lock nut 1142 is then turned 900 to 1800 to capture the threaded shaft portion 110 in the slot 1122. The pawl 1100 is now secured in the desired position. The partial threads 1124 prevent axial movement of the pawl 1100 while the interaction of the flats 114 with the flat sides 1126 of the slot 1122 prevents relative rotation between the pawl 1100 and the shaft 104. The pawl can be locked into position with a single wrench.

Referring to FIGS. 208-216, an embodiment of the pawl system of the present invention that includes a pawl 1200 and a wedge 1328 can be seen. The pawl 1200 is essentially identical to the pawl 100 except for the wedge slot 1201 that is formed in the side of hole 1222 for the wedge 1328. The wedge 1328 in this case is designed with a small angle so that it engages with the threaded shaft portion 110 and will be self locking. The wedge 1328 may have a saw tooth pattern 1330 to engage with the interrupted thread 112 of the threaded shaft portion 110. The wedge 1328 may also be used with a smooth shaft 204 that has no threads but has a double-D shape, or the wedge 1328 may be used with a plain round shaft with no threads. In either case the wedge 1328 would most likely be attached to the pawl exclusively, or with a small spring clip (not shown) which could be displaced allow the pawl to slide freely into position. After the pawl position on the shaft is adjusted as needed, the wedge retainer, or the wedge spring clip would be released, and allow the wedge 1328 to be jammed between the shaft 104 and the pawl 1200 as shown to fix the pawl 1200 to the shaft 104. By pushing on the wedge 1328 from the narrower end again so that it releases the shaft, adjustments in the pawl position can still be made. The wedge taper is designed so that the more load applied to the pawl, the tighter the wedging action is on the shaft.

Figure 213:
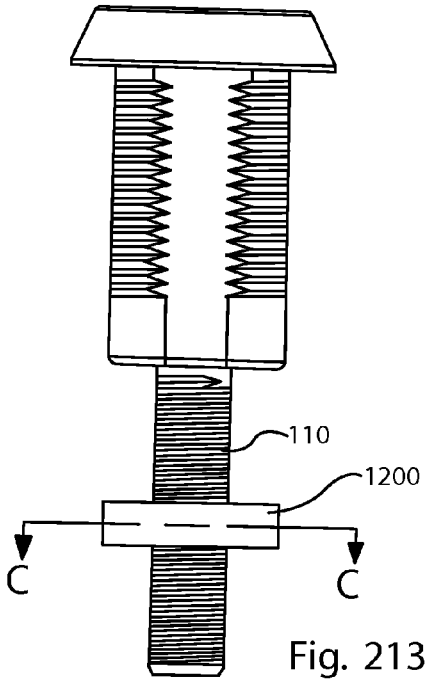

FIG. 213 shows the components required for one version of this embodiment. A threaded shaft 104 is required that has a double-D configuration as previously described. A pawl 1200 that incorporates interrupted internal threads 1224 in a portion of the through hole 1222, and a slot 1201 for the wedge 1328 to fit into to secure the assembly. The tapered wedge 1328 is serrated on one face thereof.

Figure 214:
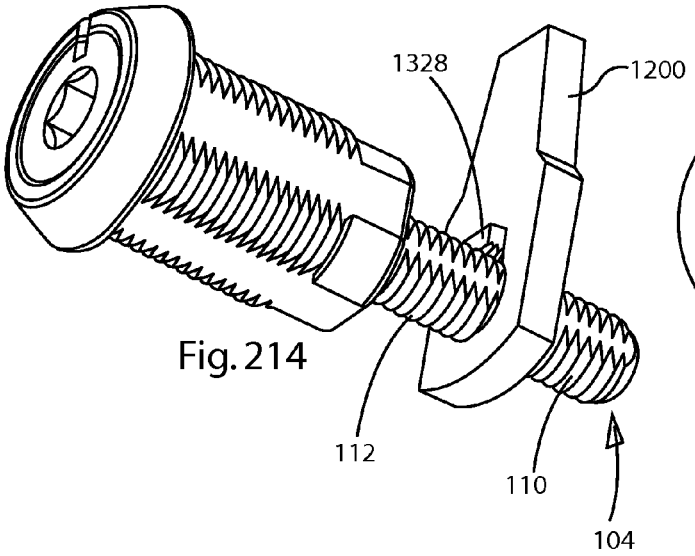

The pawl 1200 is oriented so that the threads 112 are out of alignment with the threads 124. Then the threaded shaft portion 110 is placed through the hole 1222 and the pawl 1200 is positioned axially onto the threaded shaft portion 110 to the desired position as shown in FIG. 214.

Figure 215:
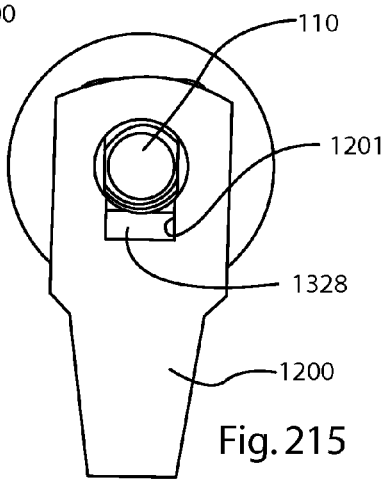
Figure 216:
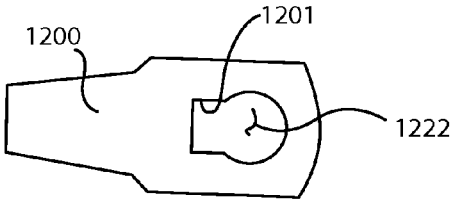

The pawl 1200 is rotated 90 degrees to engage the shaft threads 112 with the female threads 1224 on the pawl 1200 as shown in FIG. 215. The pawl 1200 is secured to the shaft 104 with a wedge retainer 1328. The wedge retainer 1328 is inserted into the slot 1201 to engage the threaded shaft portion 110 and fix the pawl 1200 to the shaft 104. The serrated teeth 1330 on the wedge 1328 engage the peaks of the shaft threads 112 form to complete the assembly. A tool such as pliers may be required to secure the wedge retainer 1328 in the slot 1201 with adequate force. The completed assembly is shown in FIG. 216.

Figure 217:
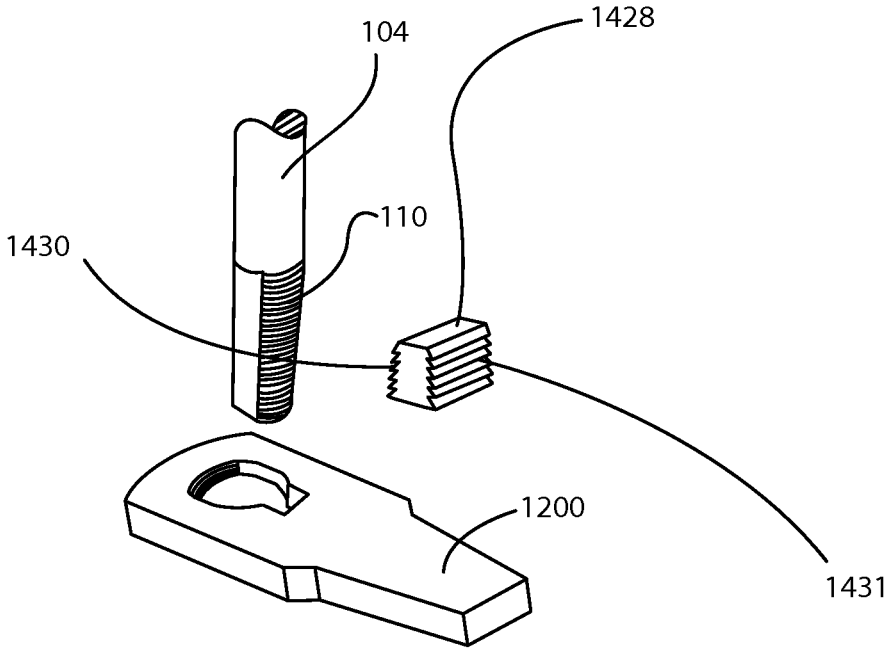
FIG. 217 is a view of a sixteenth embodiment of the present invention.

An alternative design 1428 shown in FIG. 217 for the wedge retainer would incorporate serrated surfaces 1430 and 1431 on both sides.

Figure 218:
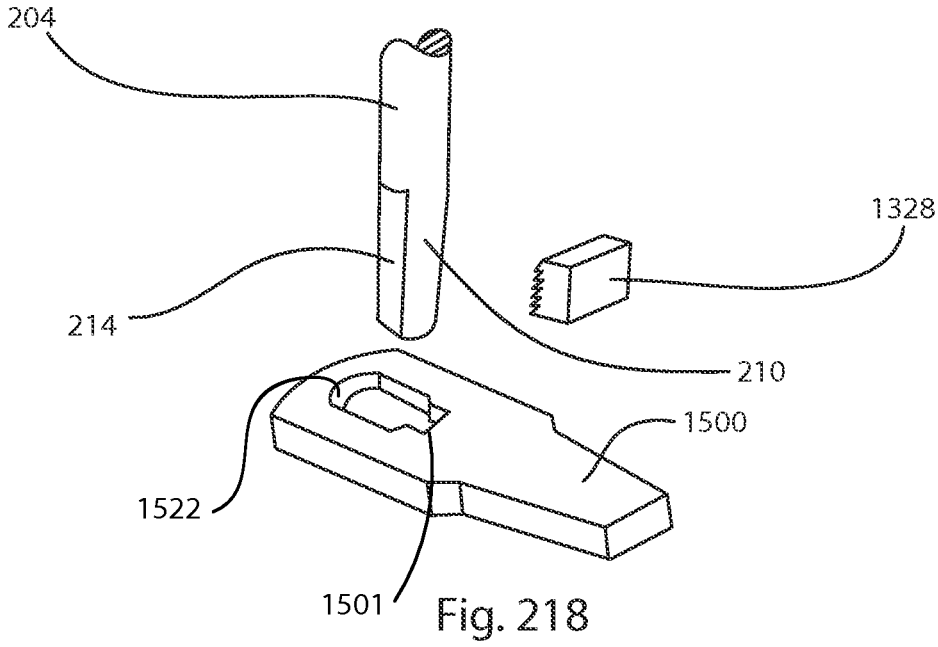
FIG. 218 is a view of a seventeenth embodiment of the present invention.
Figure 219A:
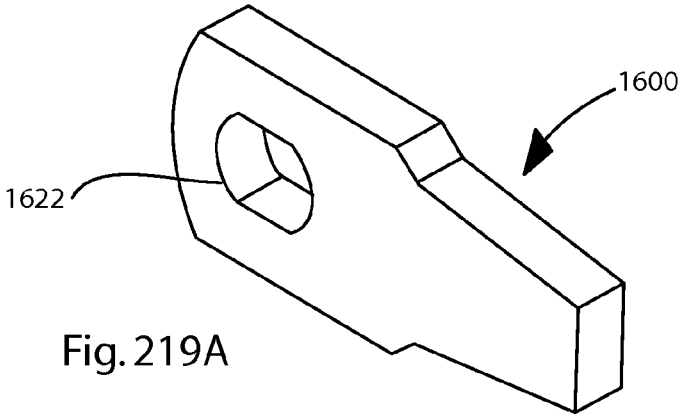
FIGS. 219A-222F are views of an eighteenth embodiment of the present invention.
Figure 219B:
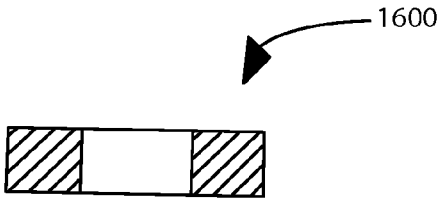
Figure 219C:
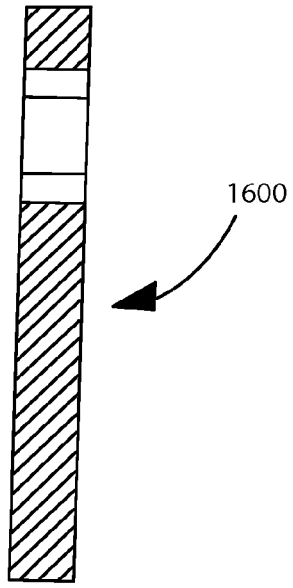
Figure 220A:
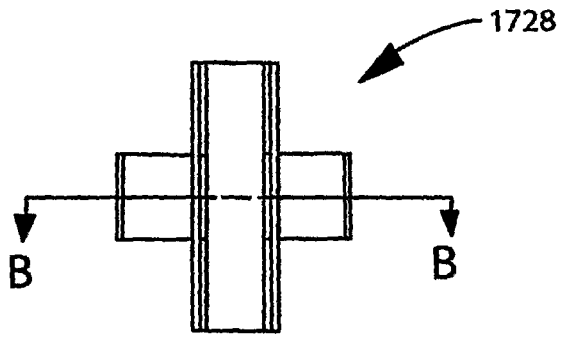
Figure 220B:
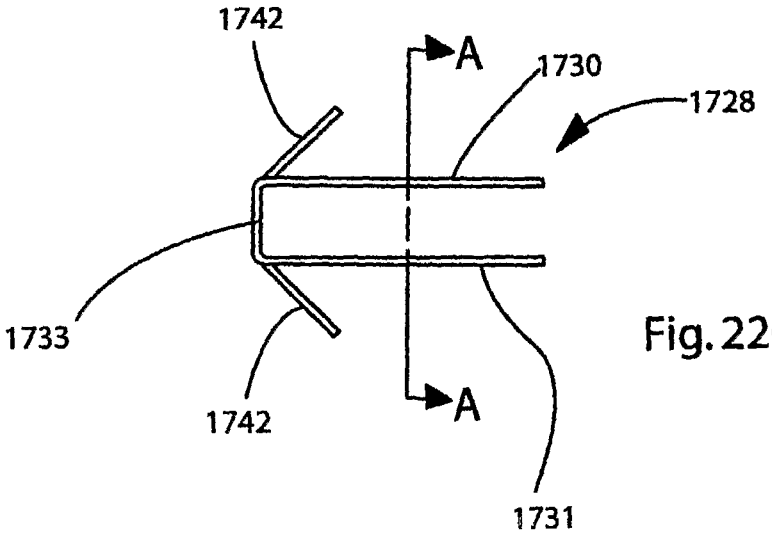
Figure 220C:
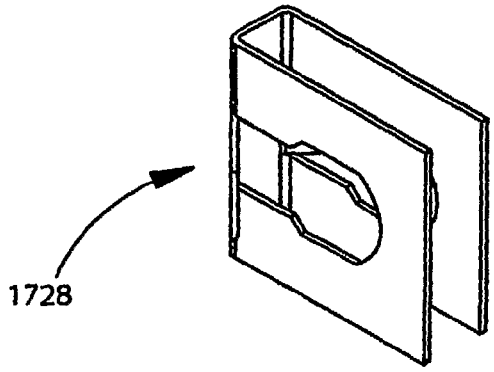
Figure 220D:
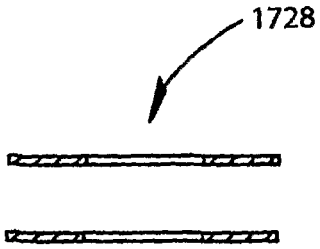
Figure 220E:
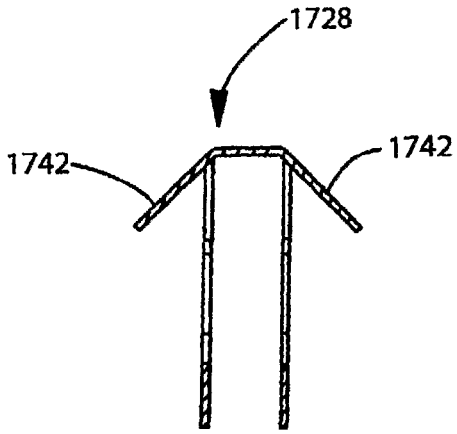
Figure 221A:
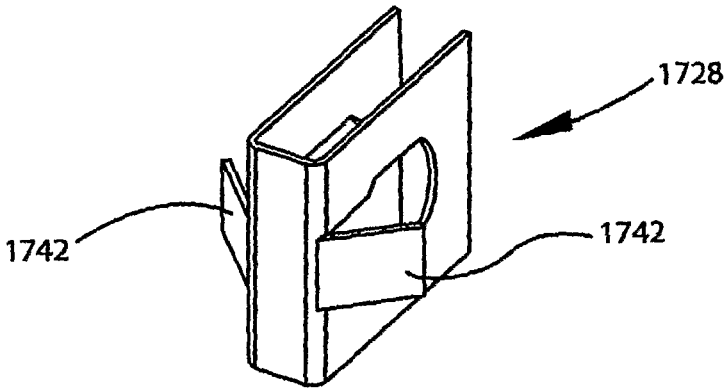
Figure 221B:
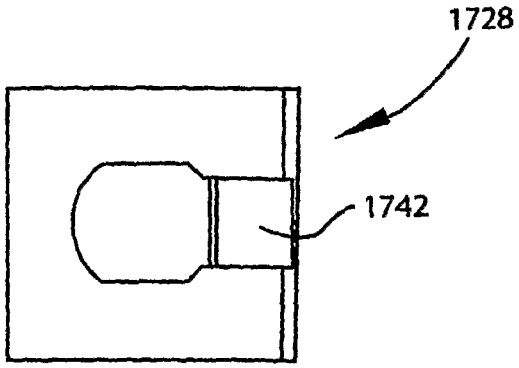
Figure 221C:
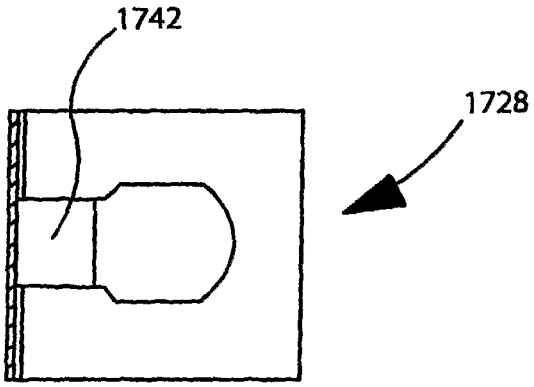
Figure 221D:
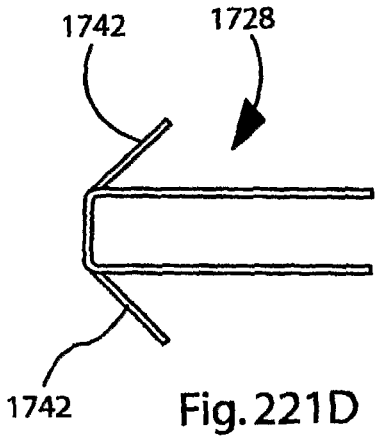
Figure 221E:
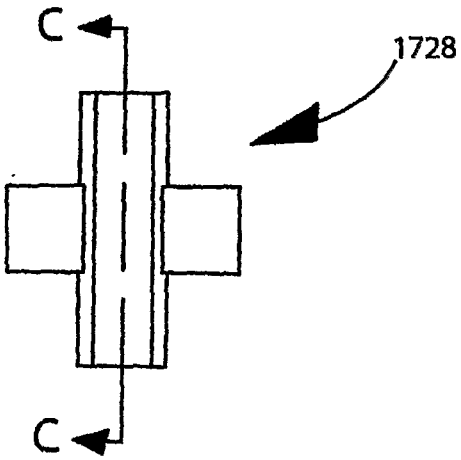
Figure 221F:
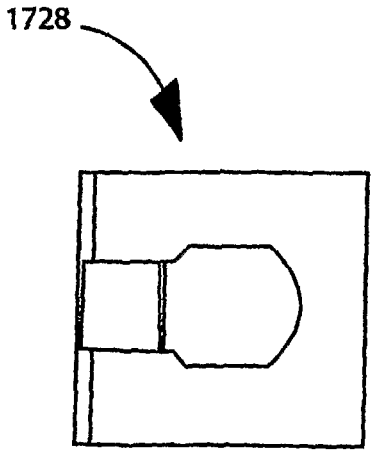
Figure 222A:
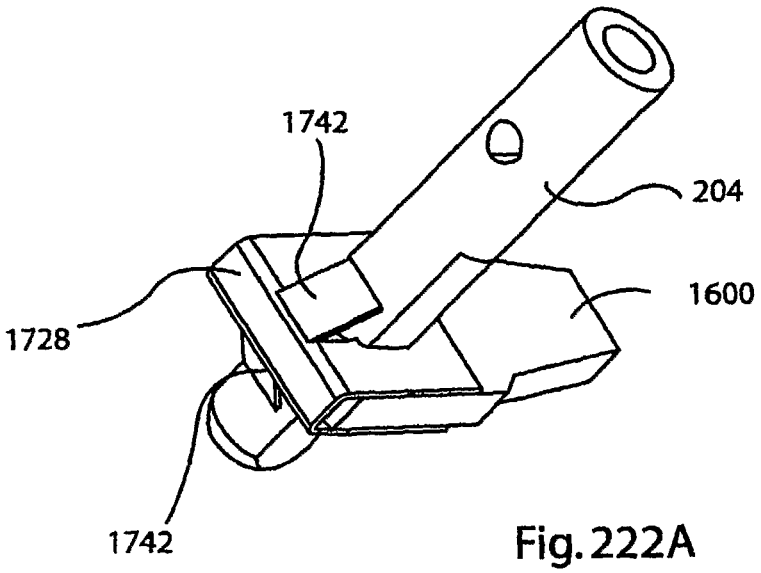
Figure 222B:
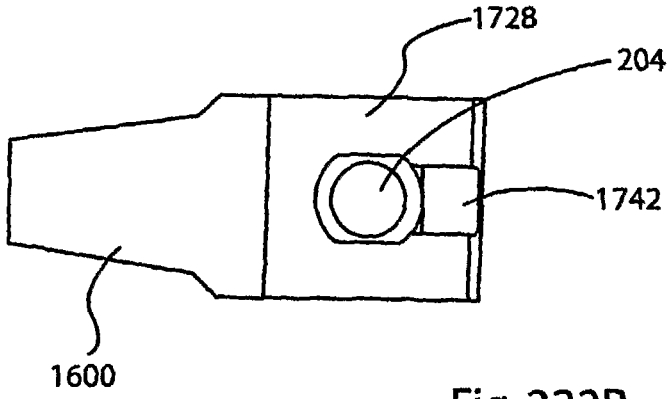
Figure 223A:
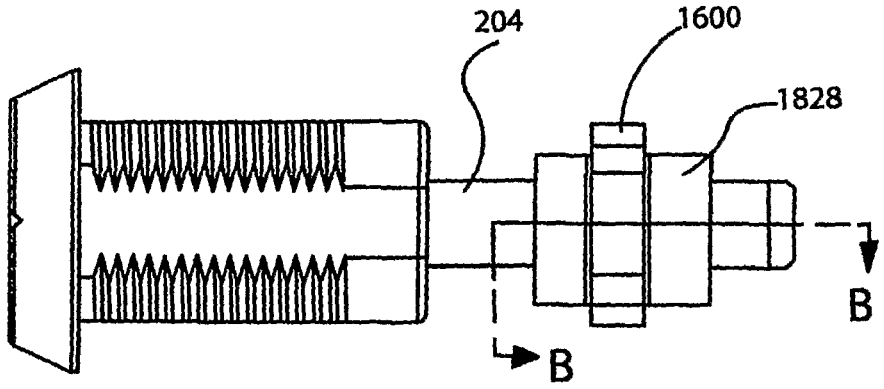
FIGS. 223A-224F are views of a nineteenth embodiment of the present invention.
Figure 223B:
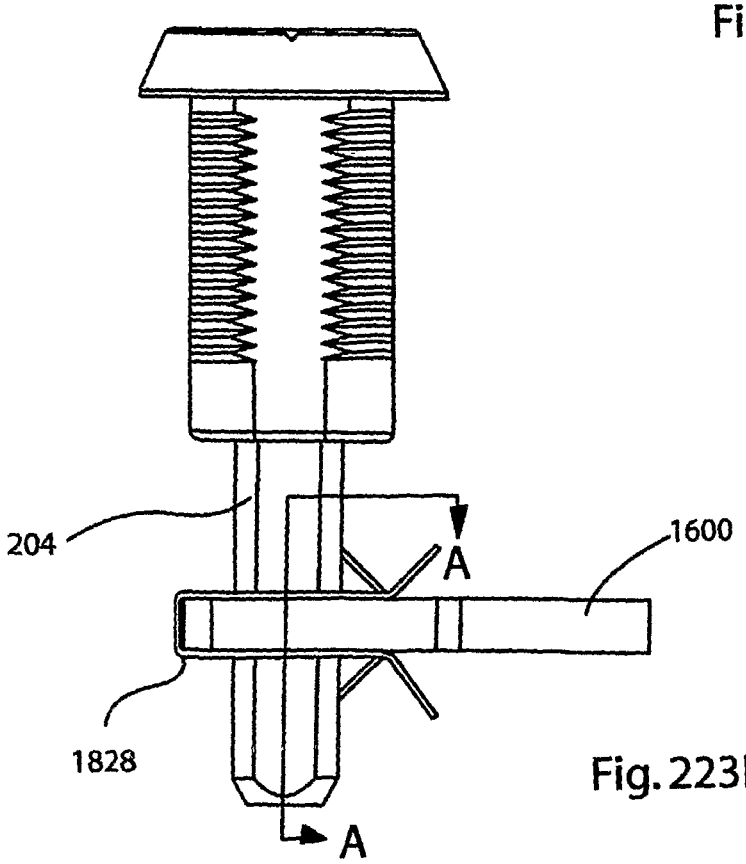
Figure 223C:
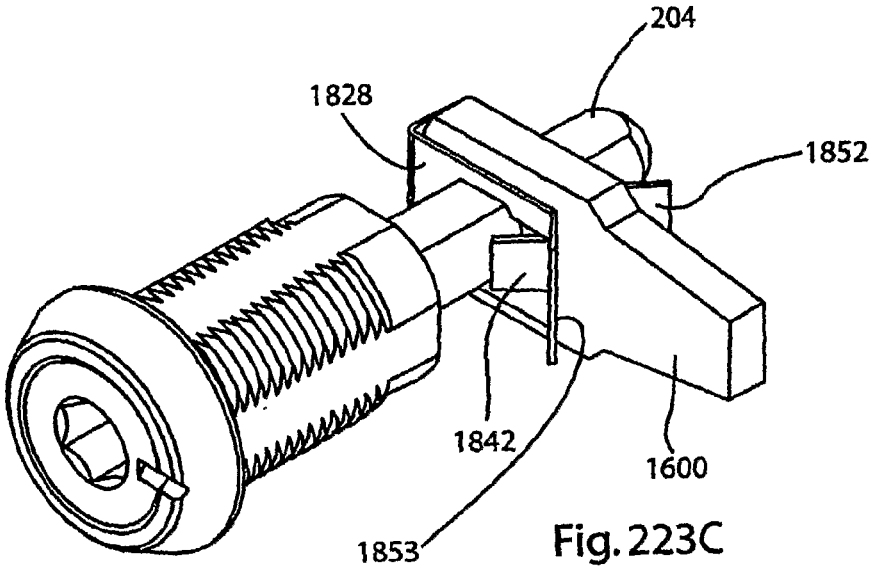
Figure 223D:
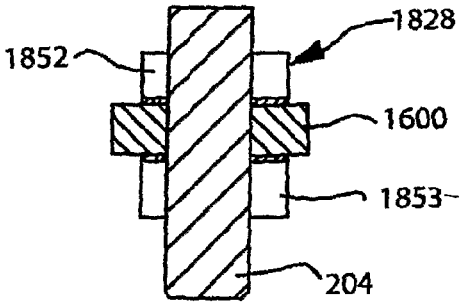
Figure 223E:
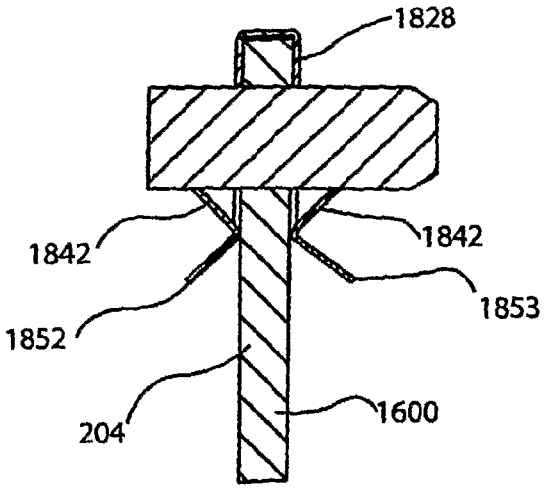
Figure 224A:
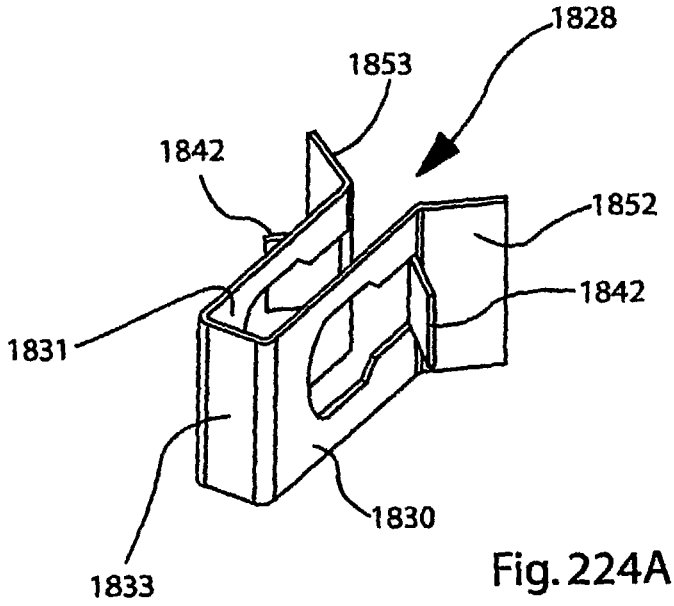
Figure 224B:
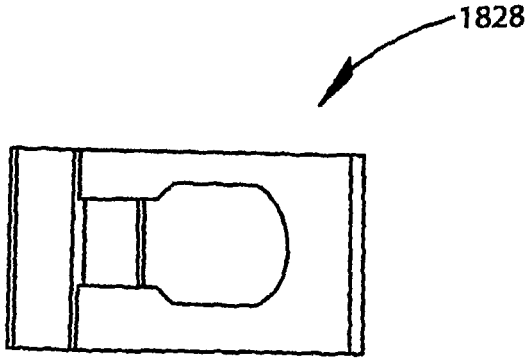
Figure 224C:
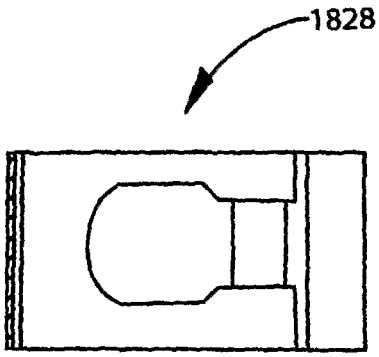
Figure 224D:
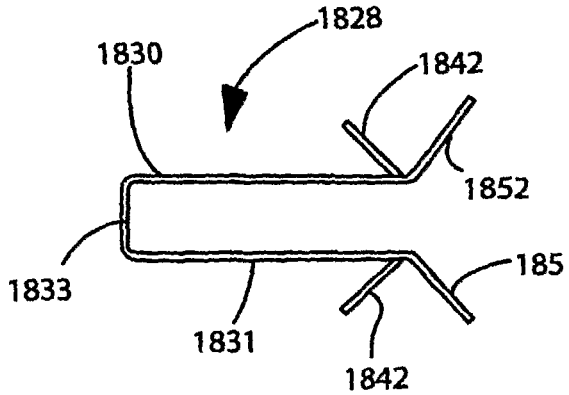
Figure 224E:
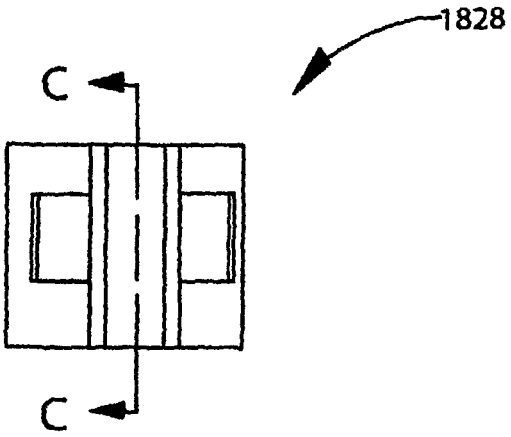
Figure 224F:
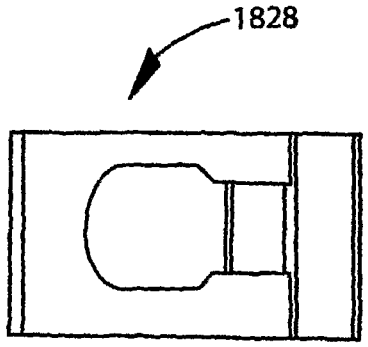

The design shown in FIG. 218 shows a smooth "double-D" shaft 204 with a pawl 1500 that has a double-D shaped hole 1522 with a slot 1501 for the wedge 1328 to engage. The shaft 204 being a double-D shaft means that the shaft 204 has flats 214 on either side similar to the flats 114 of shaft 104. The slot 1501 is shown on the round side of the double-D configured hole, but could be placed on the flat side. The flat side would yield more engagement of the serrations 1330 of the wedge retainer 1328 with the shaft 204. The wedge retainer could have serrations 1430, 1431 on one side or on both sides to improve retention. The material of the wedge retainer 1328, 1428 should be harder than the pawl or the shaft material.

Referring to FIGS. 219A-222F, this design uses a clip 1728 designed to engage a smooth surface shaft 204 to constrain the pawl axially in the desired position. The design uses a spring steel clip 1728 with cantilever angled or slanted tabs 1742 with a sharp edge designed to upset and engage the surface of the shaft material. The clip 1728 has an upper plate 1730, lower plate 1731, and a connecting plate 1733 that are connected together in a U-shaped profile. The upper and lower plates are parallel. The clip 1728 is resilient such that if the upper plate 1730 and the lower plate 1731 are spread apart they tend to go back to their original relative positions. The cantilever tabs 1742 are designed to allow the pawl 1600 and the clip 1728 to slide freely in along the shaft 204 when the upper plate 1730 and the lower plate 1731 are spread apart manually by a user. The pawl 1600 has a double-D shaped hole 1622. The edges of the cantilever tabs 1742 engage the Double-D shaft portion 210 when the plates 1730 and 1731 lie flat against the pawl 1600 due to the spring forces internal to the plates 1730, 1731 and the connecting plate 1733. The internal spring forces of the clip 1728 bring the edges of the cantilever tabs 1742 into frictional engagement with the Double-D shaft portion 210. Any axial movement of the pawl 1600 at this time will impart a moment on one or the other tab 1742 which will tend to even more forcefully wedge the particular tab 1742 between the shaft 204 and the pawl 1600. Thus axial movement of the pawl is prevented by the clip 1728. The hole 1622 and the shaft portion 210 both being of double-D configuration, relative rotation between the pawl 1600 and the shaft 204 is also prevented.

Referring to FIGS. 223A-224F, an alternative clip design 1828 using the same principle of operation as clip 1728 can be seen. This design improves upon the control of operation by the user and tool-free capabilities of the clip 1728. The clip 1828 has an upper plate 1830, lower plate 1831, and a connecting plate 1833 that are connected together in a U-shaped profile. The upper and lower plates are parallel. The clip 1828 is resilient such that if the upper plate 1830 and the lower plate 1831 are spread apart they tend to go back to their original relative positions. The slanted cantilever tabs 1842 are positioned near the edges of the plates 1830 and 1831 that are distal from the connecting plate 1833. Again the cantilever tabs 1842 tend to become wedged between the shaft 204 and the pawl 1600 in response to any force tending to axially displace the pawl 1600. Also attached to the edges of the plates 1830 and 1831 that are distal from the connecting plate 1833 are a pair slanted levers 1852, 1853. The levers 1852, 1853 are positioned in close proximity to the tabs 1842. When the levers 1852, 1853 are pinched to bring them closer together, they cause deformations in the edges of the plates 1830, 1831 distal from the connecting plate 1833, that move the tabs 1842 away from the shaft 204, thus allowing axial adjustment of the position of the pawl 1600 along the shaft 204.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A pawl assembly for use with a latch mechanism having a shaft to which the pawl assembly is to be mounted, the latch mechanism being adapted for mounting to a first member for use in selectively securing the first member in a closed position relative to a second member, the latch mechanism being operable to move the shaft between a latched position and an unlatched position, and the shaft having a longitudinal axis and a length, the pawl assembly comprising:

a pawl having an opening through which the shaft can extend; and means for preventing relative movement between the shaft and said pawl, said means for preventing relative movement between the shaft and said pawl preventing movement of said pawl relative to the shaft along the longitudinal axis of the shaft to thereby fix said pawl to the shaft at a desired location along the length of the shaft and preventing rotation of said pawl relative to the shaft about the longitudinal axis of the shaft such that said pawl is securely fastened to the shaft and said pawl and the shaft move as one unit as the shaft is caused to move by the latch mechanism to and from the latched position of the shaft and the unlatched position of the shaft to thereby move said pawl to and from a latched position of said pawl and an unlatched position of said pawl once said means for preventing relative movement between the shaft and said pawl is installed to the shaft, said means for preventing relative movement between the shaft and said pawl comprising a clip adapted to be capable of being fastened to said pawl, wherein said clip allows said pawl to be fastened to the shaft without the use of nuts.

2. A pawl assembly according to claim 1, wherein the shaft has external threads interrupted by at least one flat surface, and wherein said opening has internal threads interrupted by at least one smooth surface, and wherein said clip has at least one tab that can extend into a void between said at least one smooth surface and the at least one flat surface of the shaft in order to prevent relative rotation between said pawl and the shaft when said clip is fastened to said pawl and said internal threads are engaged to the external threads of the shaft.

3. A pawl assembly according to claim 1, wherein the shaft has external threads interrupted by at least one flat surface, and wherein said opening has internal threads interrupted by at least one smooth surface, and wherein said clip has at least one tab that can abut the at least one flat surface of the shaft in order to prevent relative rotation between said pawl and the shaft when said clip is fastened to said pawl and said internal threads are engaged to the external threads of the shaft.

4. A pawl assembly according to claim 1, wherein the shaft has external threads interrupted by at least one flat surface, and wherein said opening has internal threads interrupted by at least one smooth surface, and wherein said clip has at least one straight edge that can abut the flat surface of the shaft in order to prevent relative rotation between said pawl and the shaft when said clip is fastened to said pawl and said internal threads are engaged to the external threads of the shaft.

5. A pawl assembly according to claim 1, wherein the shaft has external threads interrupted by at least one flat surface, and wherein said opening has internal threads interrupted by at least one smooth surface, and wherein said clip has at least one edge that can engage the shaft in order to hold at least a portion of the external threads of the shaft in engagement with said internal threads when said clip is fastened to said pawl and said internal threads are engaged to at least a portion of the external threads of the shaft to thereby fix said pawl to the shaft.

6. A pawl assembly according to claim 5, wherein said clip has at least one tab that can extend into a void between said opening of said pawl and the shaft in order to prevent relative movement between said pawl and the shaft when said clip is fastened to said pawl and said internal threads are engaged to the external threads of the shaft.

7. A pawl assembly according to claim 1, wherein the shaft has external threads interrupted by at least one flat surface, said opening of said pawl has internal threads interrupted by at least one smooth surface; and wherein said clip has at least one key-hole shaped hole having a wide slot portion and a narrow slot portion, said clip includes means for guiding said clip for sliding motion along a portion of said pawl, said clip being rectilinearly movable relative to said pawl between locked and unlocked positions, wherein the shaft extends at least in part through said narrow slot portion and wherein the shaft is prevented from rotation relative to said pawl by interaction with sides of said narrow slot portion when said clip is in said locked position.

8. A pawl assembly according to claim 7, wherein said pawl assembly includes means for retaining said clip in said locked position.

9. A pawl assembly according to claim 1, wherein said clip has at least one slanted tab that can frictionally engage the shaft in order to prevent relative movement between said pawl and the shaft when said clip is fastened to said pawl and the shaft extends through said opening of said pawl.

10. A pawl assembly according to claim 1, wherein said clip has two slanted tabs that can frictionally engage the shaft in order to prevent relative movement between said pawl and the shaft when said clip is fastened to said pawl and the shaft extends through said opening of said pawl, said slanted tabs being mirror images of one another and counteracting one another.

11. A pawl assembly according to claim 10, wherein said opening in said pawl has flat sides that engage the flat side of the shaft in order to prevent relative rotation between said pawl and the shaft when the shaft extends through said opening of said pawl.

12. The pawl assembly according to claim 1, wherein said clip has portions located on opposite sides of said pawl when said pawl is fastened to the shaft using said clip.

13. A pawl assembly according to claim 12, wherein the shaft has external threads interrupted by at least one flat surface, and wherein said opening has internal threads interrupted by at least one smooth surface, and wherein said clip has at least one tab that can extend into a void between said at least one smooth surface and the at least one flat surface of the shaft in order to prevent relative rotation between said pawl and the shaft when said clip is fastened to said pawl and said internal threads are engaged to the external threads of the shaft.

14. A pawl assembly according to claim 12, wherein the shaft has external threads interrupted by at least one flat surface, and wherein said opening has internal threads interrupted by at least one smooth surface, and wherein said clip has at least one tab that can abut the at least one flat surface of the shaft in order to prevent relative rotation between said pawl and the shaft when said clip is fastened to said pawl and said internal threads are engaged to the external threads of the shaft.

15. A pawl assembly according to claim 12, wherein the shaft has external threads interrupted by at least one flat surface, and wherein said opening has internal threads interrupted by at least one smooth surface, and wherein said clip has at least one straight edge that can abut the flat surface of the shaft in order to prevent relative rotation between said pawl and the shaft when said clip is fastened to said pawl and said internal threads are engaged to the external threads of the shaft.

16. A pawl assembly according to claim 12, wherein the shaft has external threads interrupted by at least one flat surface, and wherein said opening has internal threads interrupted by at least one smooth surface, and wherein said clip has at least one edge that can engage the shaft in order to hold at least a portion of the external threads of the shaft in engagement with said internal threads when said clip is fastened to said pawl and said internal threads are engaged to at least a portion of the external threads of the shaft to thereby fix said pawl to the shaft.

17. A pawl assembly according to claim 16, wherein said clip has at least one tab that can extend into a void between said opening of said pawl and the shaft in order to prevent relative movement between said pawl and the shaft when said clip is fastened to said pawl and said internal threads are engaged to the external threads of the shaft.

18. A pawl assembly according to claim 12, wherein the shaft has external threads interrupted by at least one flat surface, said opening of said pawl has internal threads interrupted by at least one smooth surface; and wherein said clip has at least one key-hole shaped hole having a wide slot portion and a narrow slot portion, said clip includes means for guiding said clip for sliding motion along a portion of said pawl, said clip being rectilinearly movable relative to said pawl between locked and unlocked positions, wherein the shaft extends at least in part through said narrow slot portion and wherein the shaft is prevented from rotation relative to said pawl by interaction with sides of said narrow slot portion when said clip is in said locked position.

19. A pawl assembly according to claim 18, wherein said pawl assembly includes means for retaining said clip in said locked position.

20. A pawl assembly according to claim 12, wherein said clip has at least one slanted tab that can frictionally engage the shaft in order to prevent relative movement between said pawl and the shaft when said clip is fastened to said pawl and the shaft extends through said opening of said pawl.

21. A pawl assembly according to claim 12, wherein said clip has two slanted tabs that can frictionally engage the shaft in order to prevent relative movement between said pawl and the shaft when said clip is fastened to said pawl and the shaft extends through said opening of said pawl, said slanted tabs being mirror images of one another and counteracting one another.

22. A pawl assembly according to claim 21, wherein said opening in said pawl has flat sides that engage the flat side of the shaft in order to prevent relative rotation between said pawl and the shaft when the shaft extends through said opening of said pawl.

23. A pawl assembly for use with a latch mechanism having a shaft to which the pawl assembly is to be mounted, the latch mechanism being adapted for mounting to a first member for use in selectively securing the first member in a closed position relative to a second member, the latch mechanism being operable to move the shaft between a latched position and an unlatched position, and the shaft having a longitudinal axis and a length, the pawl assembly comprising:

a pawl having an opening through which the shaft can extend; and means for preventing relative movement between the shaft and said pawl, said means for preventing relative movement between the shaft and said pawl preventing movement of said pawl relative to the shaft along the longitudinal axis of the shaft to thereby fix said pawl to the shaft at a desired location along the length of the shaft and preventing rotation of said pawl relative to the shaft about the longitudinal axis of the shaft such that said pawl is securely fastened to the shaft and said pawl and the shaft move as one unit as the shaft is caused to move by the latch mechanism to and from the latched position of the shaft and the unlatched position of the shaft to thereby move said pawl to and from a latched position of said pawl and an unlatched position of said pawl once said means for preventing relative movement between the shaft and said pawl is installed to the shaft, said means for preventing relative movement between the shaft and said pawl comprising a clip adapted to be capable of being fastened to said pawl, wherein said clip has portions located on opposite sides of said pawl when said pawl is fastened to the shaft using said clip.

24. A pawl assembly according to claim 23, wherein the shaft has external threads interrupted by at least one flat surface, and wherein said opening has internal threads interrupted by at least one smooth surface, and wherein said clip has at least one tab that can extend into a void between said at least one smooth surface and the at least one flat surface of the shaft in order to prevent relative rotation between said pawl and the shaft when said clip is fastened to said pawl and said internal threads are engaged to the external threads of the shaft.

25. A pawl assembly according to claim 23, wherein the shaft has external threads interrupted by at least one flat surface, and wherein said opening has internal threads interrupted by at least one smooth surface, and wherein said clip has at least one tab that can abut the at least one flat surface of the shaft in order to prevent relative rotation between said pawl and the shaft when said clip is fastened to said pawl and said internal threads are engaged to the external threads of the shaft.

26. A pawl assembly according to claim 23, wherein the shaft has external threads interrupted by at least one flat surface, and wherein said opening has internal threads interrupted by at least one smooth surface, and wherein said clip has at least one straight edge that can abut the flat surface of the shaft in order to prevent relative rotation between said pawl and the shaft when said clip is fastened to said pawl and said internal threads are engaged to the external threads of the shaft.

27. A pawl assembly according to claim 23, wherein the shaft has external threads interrupted by at least one flat surface, and wherein said opening has internal threads interrupted by at least one smooth surface, and wherein said clip has at least one edge that can engage the shaft in order to hold at least a portion of the external threads of the shaft in engagement with said internal threads when said clip is fastened to said pawl and said internal threads are engaged to at least a portion of the external threads of the shaft to thereby fix said pawl to the shaft.

28. A pawl assembly according to claim 27, wherein said clip has at least one tab that can extend into a void between said opening of said pawl and the shaft in order to prevent relative movement between said pawl and the shaft when said clip is fastened to said pawl and said internal threads are engaged to the external threads of the shaft.

29. A pawl assembly according to claim 23, wherein the shaft has external threads interrupted by at least one flat surface, said opening of said pawl has internal threads interrupted by at least one smooth surface; and wherein said clip has at least one key-hole shaped hole having a wide slot portion and a narrow slot portion, said clip includes means for guiding said clip for sliding motion along a portion of said pawl, said clip being rectilinearly movable relative to said pawl between locked and unlocked positions, wherein the shaft extends at least in part through said narrow slot portion and wherein the shaft is prevented from rotation relative to said pawl by interaction with sides of said narrow slot portion when said clip is in said locked position.

30. A pawl assembly according to claim 29, wherein said pawl assembly includes means for retaining said clip in said locked position.

31. A pawl assembly according to claim 23, wherein said clip has at least one slanted tab that can frictionally engage the shaft in order to prevent relative movement between said pawl and the shaft when said clip is fastened to said pawl and the shaft extends through said opening of said pawl.

32. A pawl assembly according to claim 23, wherein said clip has two slanted tabs that can frictionally engage the shaft in order to prevent relative movement between said pawl and the shaft when said clip is fastened to said pawl and the shaft extends through said opening of said pawl, said slanted tabs being mirror images of one another and counteracting one another.

33. A pawl assembly according to claim 32, wherein said opening in said pawl has flat sides that engage the flat side of the shaft in order to prevent relative rotation between said pawl and the shaft when the shaft extends through said opening of said pawl.

* * * * *